US012201175B2

(12) United States Patent
Summersett et al.

(10) Patent No.: US 12,201,175 B2
(45) Date of Patent: Jan. 21, 2025

(54) SAFETY HEADWEAR AND ACCESSORIES

(71) Applicant: Milwaukee Electric Tool Corporation, Brookfield, WI (US)

(72) Inventors: Nicole Z. Summersett, Milwaukee, WI (US); Scott M. Hangartner, Hartland, WI (US); Scott Earl McKinster, Watertown, WI (US); Todd Andrew Zeilinger, Wauwatosa, WI (US); Patrick W. McCarthy, Milwaukee, WI (US); Craig A. Fluegge, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 421 days.

(21) Appl. No.: 17/461,195

(22) Filed: Aug. 30, 2021

(65) Prior Publication Data

US 2022/0047030 A1 Feb. 17, 2022

Related U.S. Application Data

(63) Continuation-in-part of application No. PCT/US2021/045504, filed on Aug. 11, 2021.

(60) Provisional application No. 63/217,589, filed on Jul. 1, 2021, provisional application No. 63/066,561, filed on Aug. 17, 2020.

(51) Int. Cl.
*A42B 3/04* (2006.01)
*A42B 3/22* (2006.01)

(52) U.S. Cl.
CPC ..... *A42B 3/0406* (2013.01); *A42B 3/22* (2013.01)

(58) Field of Classification Search
CPC ..... A42B 1/241; A42B 1/244
See application file for complete search history.

(56) References Cited

U.S. PATENT DOCUMENTS

| | | | |
|---|---|---|---|
| 2,144,870 | A | 1/1939 | Bullard |
| 2,177,145 | A | 10/1939 | Lewis |
| 2,631,286 | A | 3/1953 | Bowers |
| 2,729,820 | A | 1/1956 | Anderson |
| 2,798,222 | A | 7/1957 | Evans et al. |
| 2,934,767 | A | 5/1960 | Schoener |
| 3,176,314 | A | 4/1965 | Perry |

(Continued)

FOREIGN PATENT DOCUMENTS

| | | |
|---|---|---|
| CN | 2689737 | 4/2005 |
| CN | 206724092 | 12/2017 |

(Continued)

OTHER PUBLICATIONS

International Search Report and Written Opinion for International Application No. PCT/US2021/045504, dated Dec. 1, 2021, 11 pages.

(Continued)

*Primary Examiner* — Katherine M Moran
(74) *Attorney, Agent, or Firm* — Reinhart Boerner Van Deuren s.c.

(57) ABSTRACT

A coupling system for safety headwear is provided. Various embodiments of safety headwear accessories, such as a brim guard, are adjustable to couple to various configurations of safety headwear. The brim guard includes a mechanism to detachably couple accessories, such as a face shield, to the safety headwear.

18 Claims, 63 Drawing Sheets

(56) References Cited

U.S. PATENT DOCUMENTS 3,373,444 A 3/1968 Militello
3,475,766 A 11/1969 Raschke
3,514,787 A 6/1970 Kennedy, Jr.
3,668,705 A 6/1972 Garbisch
3,720,956 A 3/1973 Raschke
4,067,065 A 1/1978 Slosek
4,097,929 A 7/1978 Lowe et al.
4,210,972 A 7/1980 Baclit
4,224,694 A 9/1980 Palmaer
4,315,335 A 2/1982 Kennedy, Jr. et al.
4,316,289 A 2/1982 Hild
4,391,000 A 7/1983 Lonnstedt
4,479,738 A 10/1984 Kubnick
4,521,831 A 6/1985 Thayer
4,536,892 A 8/1985 Brinkhoff et al.
4,726,074 A 2/1988 Baclit et al.
4,752,974 A 6/1988 Haino
4,766,609 A 8/1988 Lane
4,793,007 A 12/1988 Barnett
4,928,324 A 5/1990 Evans et al.
4,993,081 A 2/1991 Fulghum
5,333,328 A 8/1994 Roberts
5,406,645 A 4/1995 Lin
5,544,361 A * 8/1996 Fine ..... A42B 1/0181 2/454
5,727,250 A 3/1998 Black
5,752,280 A 5/1998 Hill
5,802,616 A 9/1998 Watson
5,950,241 A 9/1999 Gomez
6,035,451 A 3/2000 Burns et al.
6,041,435 A 3/2000 Paulson et al.
6,173,447 B1 1/2001 Arnold
6,298,498 B1 10/2001 Burns et al.
6,352,383 B1 3/2002 Ristola
6,374,423 B1 4/2002 Anderson
6,381,750 B1 5/2002 Mangan
6,497,493 B1 12/2002 Theisen
6,546,559 B1 4/2003 Bronson
6,694,525 B1 2/2004 Murnan
6,807,679 B1 10/2004 Wang-Lee
6,889,391 B1 5/2005 Hitchins
6,892,393 B1 5/2005 Provost et al.
6,959,989 B2 11/2005 Holm
7,908,668 B2 3/2011 Folkesson
8,225,419 B2 7/2012 Hersick et al.
8,245,320 B2 8/2012 Provost et al.
8,286,269 B2 10/2012 Springer et al.
8,286,270 B2 10/2012 Higgins
8,291,513 B2 10/2012 Prinkey
8,434,167 B2 * 5/2013 Gleason ..... A42B 3/225 2/418
8,534,279 B2 9/2013 Brace et al.
8,539,613 B2 9/2013 Hersick et al.
8,555,424 B2 10/2013 Higgins
8,677,517 B1 3/2014 Morency et al.
8,893,313 B2 11/2014 Lowther
RE45,459 E 4/2015 Hersick et al.
9,049,896 B2 6/2015 Huh
9,149,085 B2 10/2015 Bryan
9,232,826 B2 1/2016 Vermillion
9,408,430 B2 8/2016 Guay et al.
9,456,649 B2 10/2016 Basson
9,480,292 B1 11/2016 Kazmierczak
9,578,916 B2 2/2017 Daniels et al.
9,655,396 B1 5/2017 Lacy
D792,652 S 7/2017 Tilley
9,848,667 B2 12/2017 Brace et al.
9,872,531 B2 1/2018 Uke et al.
9,885,471 B2 2/2018 Dirsa et al.
9,894,952 B2 2/2018 Hayes
10,098,398 B2 10/2018 Lacy
10,136,693 B1 11/2018 Paulson
10,154,704 B1 12/2018 Caito, III
10,165,819 B2 1/2019 Klotz et al.
10,219,579 B2 3/2019 Gotti
10,383,385 B2 8/2019 Moreau et al.
10,448,693 B2 10/2019 Noordzij et al.
10,492,558 B2 12/2019 Pfanner et al.
10,645,987 B2 5/2020 Maldonado et al.
10,709,194 B2 7/2020 Johnstone et al.
10,743,599 B2 * 8/2020 Silva ..... F21V 15/04
10,765,894 B2 9/2020 Balke et al.
10,772,374 B2 9/2020 Shida
10,874,159 B1 12/2020 Kinzer
10,912,344 B2 2/2021 Bohn et al.
11,019,870 B2 6/2021 Hyma
11,219,265 B2 1/2022 Pfanner
11,375,765 B2 7/2022 Bryan
11,452,327 B2 9/2022 Deshpande et al.
2004/0181856 A1 9/2004 Oleson
2006/0010550 A1 1/2006 Cheng
2006/0026741 A1 2/2006 Lang-Ree
2006/0031975 A1 2/2006 Hersick
2006/0109420 A1 5/2006 Holm
2006/0230496 A1 10/2006 Husbands
2007/0011794 A1 1/2007 Wang Lee
2008/0083053 A1 4/2008 Lin
2008/0250546 A1 10/2008 Watabiki
2009/0038056 A1 2/2009 Bobbin et al.
2009/0313745 A1 12/2009 Kang et al.
2011/0167544 A1 7/2011 Kim
2012/0204331 A1 8/2012 Lebel et al.
2013/0031693 A1 * 2/2013 Gleason ..... A42B 3/225 2/9
2013/0047323 A1 2/2013 Ireland
2013/0180035 A1 7/2013 Lowther
2013/0247283 A1 9/2013 Krause
2013/0312166 A1 11/2013 Hardy
2013/0318691 A1 12/2013 Krick et al.
2013/0326791 A1 12/2013 Woo
2014/0123367 A1 5/2014 Prenatt
2014/0173811 A1 6/2014 Finiel et al.
2014/0352033 A1 12/2014 Bryan
2015/0040297 A1 2/2015 Vermillion
2015/0201696 A1 7/2015 Pfanner
2015/0335093 A1 * 11/2015 Curci ..... A42B 3/225 2/424
2016/0066643 A1 3/2016 Squair
2016/0128416 A1 5/2016 Kim
2016/0143384 A1 5/2016 Moreau
2016/0157548 A1 6/2016 Copeland
2016/0183620 A1 6/2016 Moreau
2016/0183621 A1 6/2016 Reeves
2016/0331059 A1 11/2016 Basson et al.
2016/0360816 A1 12/2016 Bundy
2016/0360820 A1 12/2016 Sommers
2017/0049176 A1 2/2017 Giroux Bernier et al.
2017/0079364 A1 3/2017 Paulson
2017/0112224 A1 4/2017 Gotti
2017/0127745 A1 5/2017 Daniels et al.
2017/0231311 A1 8/2017 Chen et al.
2018/0242677 A1 8/2018 Pilenga
2018/0242678 A1 8/2018 Sommers
2018/0303190 A1 10/2018 Calilung et al.
2019/0036483 A1 1/2019 Kelly
2019/0075882 A1 3/2019 Caito, III
2019/0082765 A1 3/2019 Manning et al.
2019/0104800 A1 4/2019 Schuster et al.
2019/0223537 A1 7/2019 Pfanner
2019/0231016 A1 8/2019 Deshpande et al.
2019/0350291 A1 11/2019 Maldonado et al.
2019/0380421 A1 12/2019 Noordzij et al.
2019/0387827 A1 12/2019 Hylton
2020/0085148 A1 3/2020 Gall
2020/0154811 A1 * 5/2020 Hyma ..... A42B 3/042
2020/0170329 A1 6/2020 Bohn et al.
2020/0253311 A1 8/2020 Niedermeyer
2020/0329805 A1 10/2020 Wong
2020/0329806 A1 * 10/2020 Wong ..... H01M 50/10
2020/0383417 A1 12/2020 Bohn et al.
2021/0000208 A1 1/2021 Whedbee, II
2021/0106089 A1 * 4/2021 Hyma ..... A42B 3/0446
2021/0145104 A1 5/2021 Jones
2021/0153588 A1 5/2021 Tsai

(56) References Cited

U.S. PATENT DOCUMENTS

| | | | | |
|---|---|---|---|---|
| 2021/0361015 | A1 | 11/2021 | Kountz | |
| 2022/0015488 | A1 | 1/2022 | Adams | |
| 2022/0030977 | A1 | 2/2022 | Huh et al. | |
| 2022/0039501 | A1 | 2/2022 | Maltz | |
| 2022/0047030 | A1* | 2/2022 | Summersett | A42B 3/22 |
| 2022/0047033 | A1 | 2/2022 | Zeilinger | |
| 2022/0095735 | A1 | 3/2022 | Castillo | |
| 2022/0095736 | A1 | 3/2022 | Henshaw | |
| 2022/0248797 | A1* | 8/2022 | Zeilinger | A42B 3/185 |
| 2022/0295934 | A1 | 9/2022 | Adams | |
| 2023/0157398 | A1 | 5/2023 | Lombardi | |
| 2023/0165335 | A1 | 6/2023 | Baker | |

FOREIGN PATENT DOCUMENTS

| | | |
|---|---|---|
| CN | 108730931 | 11/2018 |
| CN | 211241881 | 8/2020 |
| DE | 1930542 | 1/1966 |
| DE | 1935115 | 3/1966 |
| DE | 2030546 | 12/1971 |
| DE | 2317580 | 10/1974 |
| DE | 7728179 | 1/1978 |
| DE | 8333228 | 3/1984 |
| DE | 3730202 | 4/1989 |
| DE | 9107264 | 12/1991 |
| DE | 202016105678 | 3/2017 |
| DE | 102012000820 | 5/2018 |
| DE | 202019001099 | 7/2019 |
| DE | 202020102502 | 8/2020 |
| EP | 0668029 | 8/1995 |
| EP | 0572760 | 9/1998 |
| EP | 2292112 | 11/2011 |
| EP | 2484318 | 5/2014 |
| JP | 10-110319 | 4/1998 |
| KR | 10-2009-0007329 | 1/2009 |
| WO | WO12006653 | 1/2012 |
| WO | WO13057745 | 4/2013 |
| WO | WO13110675 | 8/2013 |
| WO | WO16189265 | 11/2016 |
| WO | WO18154507 | 8/2018 |
| WO | WO20044020 | 3/2020 |
| WO | WO20079397 | 4/2020 |

OTHER PUBLICATIONS

International Search Report and Written Opinion for International Application No. PCT/US2021/045405, dated Nov. 29, 2021, 9 pages.

"Stihl Arborist Helmet (Kask Super Plasma)," YouTube, May 9, 2016, https://www.youtube.com/watch?v=IQ5almuqrbw, 1 page.

VCG Construction, "Milwaukee Tools New Safety Equipment Can Save Your A****", video published on YouTube on Jan. 13, 2020, Accessed from https://www.youtube.com/watch?v=HqmGM4MYCQQ (Year: 2020).

* cited by examiner

SAFETY HEADWEAR AND ACCESSORIES

CROSS-REFERENCE TO RELATED PATENT APPLICATION

The present application is a continuation of International Application No. PCT/US2021/045504, filed Aug. 11, 2021, which claims the benefit of and priority to U.S. Provisional Application No. 63/217,589, filed on Jul. 1, 2021, and U.S. Provisional Application No. 63/066,561, filed on Aug. 17, 2020, each of which are incorporated herein by reference in their entirety.

BACKGROUND OF THE INVENTION

The present invention relates generally to the field of safety equipment. The present invention relates specifically to safety headwear accessories that provide ear protection, face protection, and/or lighting assistance. Workers may attach accessories to safety headwear, such as hard hats or helmets. Safety headwear may include coupling mechanisms, such as coupling slots, at varying locations with respect to each other. Further, a lamp or flashlight can attach to the safety headwear to assist with vision in poorly lit or low visibility environments. In some situations face masks provide useful protection but in other situations face masks may be unnecessary.

SUMMARY OF THE INVENTION

One embodiment of the invention relates to a hard hat system including a hard hat, a brim guard and a face shield. The hard hat includes a shell formed from a rigid material and a mounting element extending from a front of the hard hat. The brim guard includes a visor positioned at the front of the hard hat, a first lateral wall and a second lateral wall. The first lateral wall extends upward from the visor, and the first lateral wall includes a first inner surface. The second lateral wall opposes the first lateral wall and extends upward from the visor. The second lateral wall includes a second inner surface, and the second inner surface and the first inner surface face towards each other. The first lateral wall and the second lateral wall slidably engage with opposing portions of the mounting element coupling the brim guard to the hard hat. The face shield is coupled to the brim guard. The face shield is moveable between a lowered position and a raised position. The face shield is positioned below the visor when the face shield is in the lowered position and the face shield is above the visor when the face shield is in the raised position.

Another embodiment of the invention relates to a brim guard for hard hats including a body and a mounting bracket coupled to the body. The body is configured to couple to a hard hat such that a front of the body is positioned at a front of the hard hat. The mounting bracket includes a first channel and a second channel. The first channel extends vertically above the body and includes a first lateral opening. The second channel extends vertically above the body and includes a second lateral opening. The second lateral opening and the first lateral opening face towards each other. The first channel and the second channel slidably engage with opposing portions of a mounting element of the hard hat.

Another embodiment of the invention relates to a hard hat system including a hard hat, a brim guard, and a face shield. The hard hat includes a shell formed from a rigid material and a mounting element extending from a front of the hard hat. The brim guard is coupled to the mounting element of the hard hat. The face shield is pivotally coupled to the brim guard. The face shield is moveable between a lowered position and a raised position. The face shield is positioned below the brim guard when the face shield is in the lowered position and the face shield is positioned above the brim guard when the face shield is in the raised position. The brim guard extends between the hard hat and an upper end of the face shield when the face shield is in the lowered position.

Another embodiment of the invention relates to a hard hat system including a hard hat, a brim guard, a face shield, a first adaptor receiver and a first adaptor. The hard hat includes a shell formed from a rigid material. The brim guard is configured to couple to the hard hat such that a front of the brim guard is positioned at a front of the hard hat. The face shield is reversibly coupled to the brim guard. The face shield is moveable between a lowered position and a raised position. The face shield is positioned below the brim guard when the face shield is in the lowered position and the face shield is above the brim guard when the face shield is in the raised position. The first adaptor receiver is coupled to the brim guard. The first adaptor is received in the first adaptor receiver. The first adaptor includes an arm extending along a primary longitudinal axis between a first end and an opposing second end. The first adaptor is positionable in the first adaptor receiver in a first orientation in which the first end of the arm extends downward from the first adaptor receiver and in a second orientation in which the second end of the arm extends downward from the first adaptor receiver. The arm of the first adaptor is a first distance from the front of the brim guard when the first adaptor is in the first orientation, and the arm of the first adaptor is a second distance from the front of the brim guard when the first adaptor is in the second orientation, and the second distance is greater than the first distance.

Another embodiment of the invention relates to a hard hat system including a brim guard, a first adaptor receiver coupled to the brim guard, and a first adaptor received in the first adaptor receiver. The brim guard is configured to couple to a hard hat such that a front of the brim guard is positioned at a front of the hard hat. The brim guard is configured to reversibly couple with a face shield moveable between a lowered position and a raised position. The face shield is positioned below the front of the hard hat when the face shield is in the lowered position. The first adaptor is received in the first adaptor receiver. The first adaptor is positionable in the first adaptor receiver in a first orientation and in a second orientation different than the first orientation. The first adaptor includes a first ledge and a second ledge. The first ledge includes a first coupling surface facing upward when the first adaptor is in the first orientation. The first coupling surface defines a first distance from a bottom of the first adaptor receiver when the first adaptor is in the first orientation. The second ledge includes a second coupling surface facing upward when the first adaptor is in the second orientation. The second coupling surface defines a second distance from the bottom of the first adaptor receiver when the first adaptor is in the second orientation, and the second distance is greater than the first distance.

Another embodiment of the invention relates to a hard hat system including a brim guard, a first adaptor receiver coupled to the brim guard, and a first adaptor received in the first adaptor receiver. The brim guard is configured to couple to a first hard hat and a second hard hat. The brim guard is configured to mechanically and reversibly couple with a face shield that is positionable below the brim guard. The first adaptor is positionable in the first adaptor receiver in a first orientation and a second orientation. When the first adaptor is positioned in the first orientation, the first adaptor is configured to couple to the first hard hat and the first adaptor is configured to not couple to the second hard hat. When the first adaptor is positioned in the second orientation, the first adaptor is configured to not couple to the first hard hat and the first adaptor is configured to couple to the second hard hat.

One embodiment of the invention relates to a hard hat with front and rear mounting locations and two auxiliary ridges. The front and rear mounting locations have side ridges on either side of the mounting location. Each auxiliary ridge has three ports located on opposite sides of the hard hat. The first port is in the front, the second port is in the middle, and the third port is located in the rear of the auxiliary ridge. The third port is also associated with an axial axis at the center of the neck of an operator.

The hard hat includes a brim guard removably mounted to the front mounting location of the hard hat. The brim guard includes a second mounting location, a mounting bracket, and an extended ridge. The mounting location of the brim guard has side ridges on either side of the second mounting location. The mounting bracket has side clips on either side of the mounting bracket. The side clips are configured to couple to the side ridges at the first mounting location of the hard hat. The extended ridge projects radially outward from the mounting location.

Various additional embodiments of the invention relate to a four-bar mechanism, a pivot and sliding mechanism, and a locking mechanism for coupling a visor of a face shield to the brim guard. The various mechanisms ensure the visor couples to and abut against the extended ridge, for example, to create a watertight seal. The brim guard enables the coupling of various accessories, e.g., a headlamp, to the mounting locations of the hard hat. The brim guard also leaves the ports available for accessories coupled to auxiliary ridges of the hard hat. In this way, the brim guard enables the face shield to rotate from an operative position to a storage position without adjustment or removal of the attached accessories at the mounting locations and/or ports of the auxiliary ridge.

Another embodiment of the invention relates to a protective system for headwear including a brim guard, a face shield, and a cover. The brim guard is configured to couple to a front portion of a protective headwear. The brim guard extends circumferentially partially around the protective headwear (e.g. from a front-left to a front-right). The face shield is positionable in front of a face of a person wearing the protective headwear. The cover is detachably coupled to the brim guard. The cover pivots with respect to the brim guard about a first axis between a secured position and an unsecured position. The face shield is coupled to the brim guard when the cover is in the secured position and the face shield is detachable from the brim guard when the cover is in the unsecured position.

In a specific embodiment, the cover includes a curved guide that interfaces with a curved ledge of the brim guard when the cover is in the secured position. In a specific embodiment, the curved guide of the cover and the curved ledge of the brim guard are each radially centered about the first axis.

In various embodiment, the protective system includes an adaptor and an adaptor housing extending from the brim guard. The adaptor includes an arm having a first end and an opposing second end. The adaptor is positionable in the adaptor housing in a first orientation in which the first end of the arm extends downward and a second orientation in which the second end of the arm extends downward.

In a specific embodiment, the arm of the adaptor is closer to the front of the brim guard when the adaptor is in the first orientation compared to when the adaptor is in the second orientation. In various embodiments, the adaptor is rotated 180 degrees when the adaptor is repositioned from the first orientation to the second orientation.

Another embodiment of the invention relates to a brim guard, a face shield, a cover, a first adaptor housing, and a first adaptor. The brim guard is configured to couple to a front portion of protective headwear. The brim guard extends circumferentially partially around the protective headwear from a front-left to a front-right. The cover secures the face shield to the brim guard. The first adaptor housing extends from the brim guard. The first adaptor is received in the first adaptor housing. The first adaptor includes an arm that extends from a first end to an opposing second end. The first adaptor is positionable in the first adaptor housing in a first orientation in which the first end of the arm extends downward and in a second orientation in which the second end of the arm extends downward. The arm of the adaptor is closer to the front of the brim guard when the adaptor is in the first orientation compared to when the adaptor is in the second orientation.

In a specific embodiment, the protective system includes a second adaptor housing extending from the brim guard, and a second adaptor received in the second adaptor housing. The second adaptor includes an arm extending from a first end to an opposing second end. The second adaptor is positionable in the second adaptor housing in a first orientation in which the first end of the arm extends downward and in a second orientation in which the second end of the arm extends downward. The arm of the second adaptor is closer to the front of the brim guard when the second adaptor is in the first orientation compared to when the second adaptor is in the second orientation.

In a specific embodiment, the arm of the first adaptor and the arm of the second adaptor each include a first ledge and a second ledge. The first ledge extends from the first end of the arm inwards towards a center of the protective headwear. The first ledge includes a first coupling surface facing upward when the first end of the arm is extending downward. The second ledge extends from the second end of the arm inwards towards a center of the protective headwear. The second ledge includes a second coupling surface facing upward when the second end of the arm is extend downwards.

In various embodiments, the first adaptor housing includes a first coupling component that prevents the second adaptor from being fully received within the first adaptor housing, and the second adaptor housing includes a second coupling component that prevents the first adaptor from being fully received within the second adaptor housing.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which:

FIGS. 126-129 are perspective views of a protective system for safety headwear, according to an exemplary embodiment.

FIGS. 130-132 are schematic views of a protective system for safety headwear, according to an exemplary embodiment.

FIG. 133 is a perspective view of a portion of a protective system for safety headwear, according to an exemplary embodiment.

FIGS. 134-136 are perspective views of a protective system for safety headwear, according to an exemplary embodiment.

FIG. 137 is a top view of a protective system for safety headwear, according to an exemplary embodiment.

FIG. 138 is a side view of the protective system of FIG. 137, according to an exemplary embodiment.

FIG. 139 is various views of a protective system for safety headwear, according to an exemplary embodiment.

FIG. 140 is a side view of a protective system for safety headwear, according to an exemplary embodiment.

FIG. 141 is a perspective view of a protective system for safety headwear, according to an exemplary embodiment.

FIG. 142 is a schematic view of a protective system for safety headwear, according to an exemplary embodiment.

FIG. 143 is a perspective view of a protective system for safety headwear, according to an exemplary embodiment.

FIG. 144 is a detailed cross-section view of a protective system for safety headwear, according to an exemplary embodiment.

Figure 143:
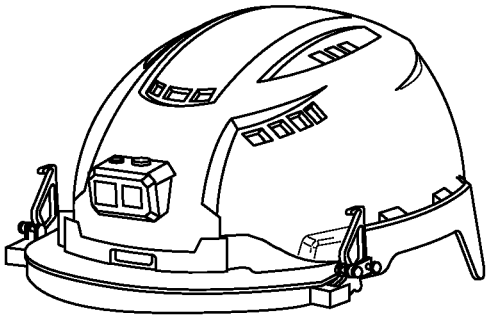
Figure 144:
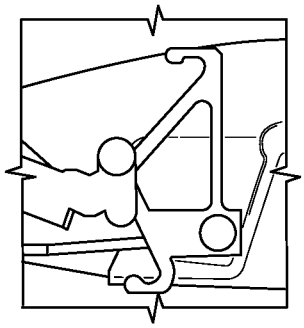
Figure 145:
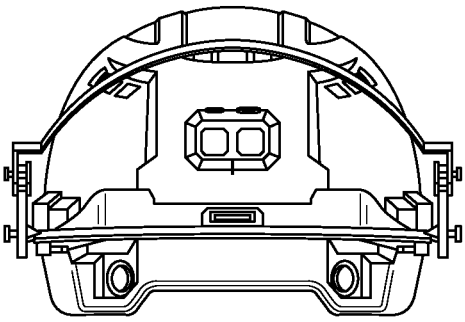
Figure 146:
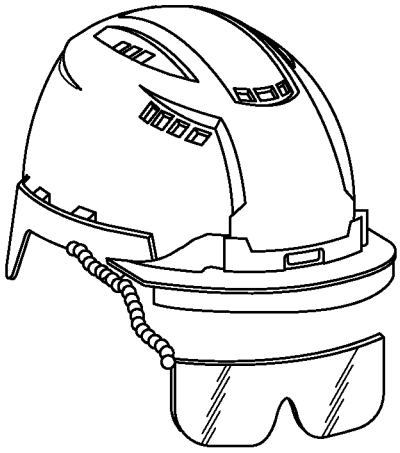
Figure 147:
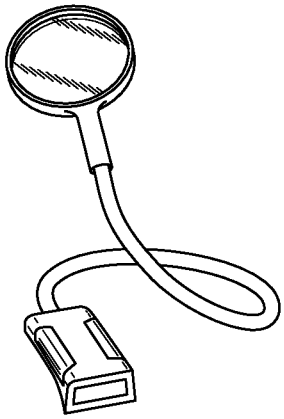
Figure 148:
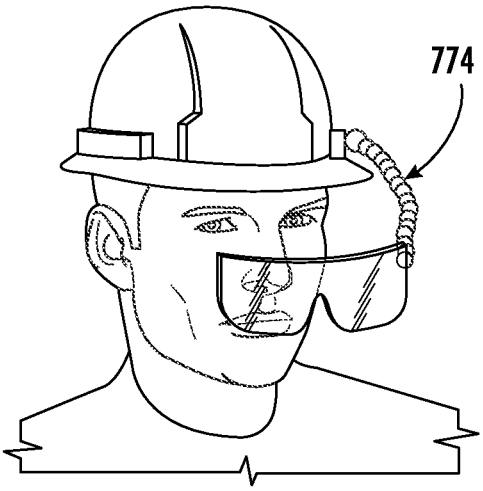
Figure 149:
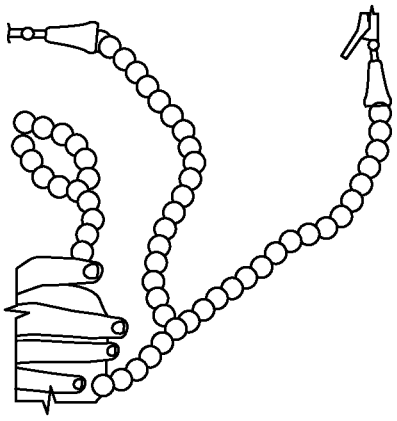
Figure 150:
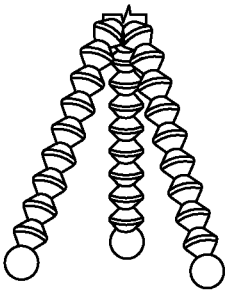

FIG. 145 is a front view of the protective system of FIG. 143, according to an exemplary embodiment.

FIGS. 146-150 are various views of a protective system for safety headwear, according to an exemplary embodiment.

Figure 151:
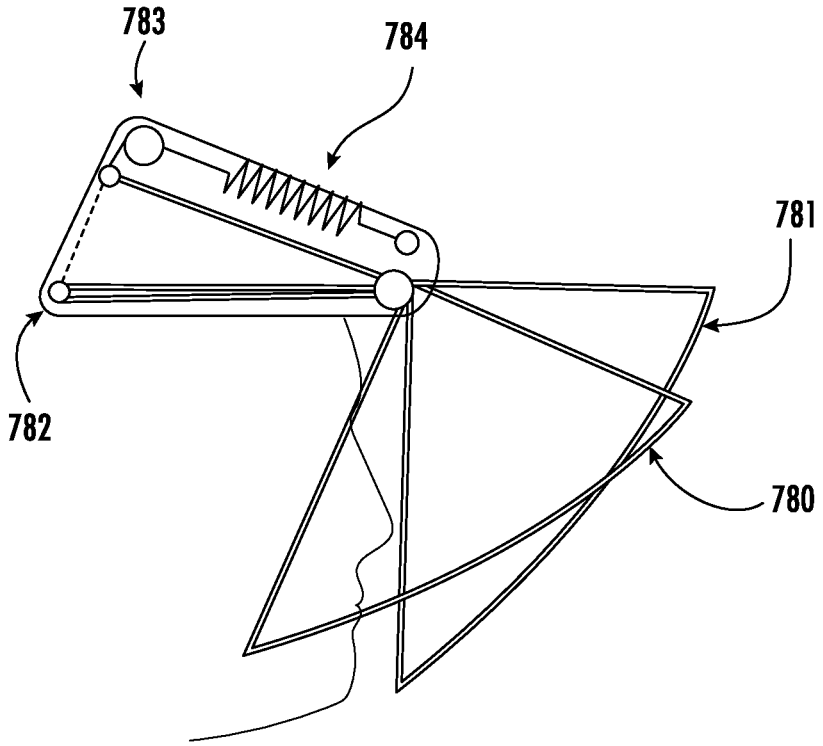

FIG. 151 is a schematic view of a protective system for safety headwear, according to an exemplary embodiment.

DETAILED DESCRIPTION

Referring generally to the figures, a hard hat accessory system is shown and described. Various hard hats include a variety of mounting locations and side accessory support ridges or auxiliary ridges to mount various accessories. Accessories generally include a lamp, a face shield, and earmuffs, but can also include a reflector, a magnetic tool carrier, hand/power tools, and/or an eyeglass holder.

Applicant has found that the attachment of a face shield to different sized hard hats often results in gaps or a poor fit between a visor of the face shield and a brim of the hard hat. Using a bridge or brim guard that attaches to the mounting locations ensures a proper fit where the visor reliably abuts the hard hat, regardless of the size or configuration of the hard hat. Various embodiments of brim guards described herein include an adjustable coupling mechanism that is configured to couple to varying configurations of safety headwear. The coupling mechanisms can be adjusted in multiple orientations, each orientation configured to couple with a different configuration of safety headwear. For example, the couple slots in safety headwear (e.g., hard hats, helmets) can be at different locations with respect to each other. Providing a brim guard with an adjustable coupling mechanism permits the brim guard to be coupled to different embodiments of safety headwear that include coupling slots at different locations.

Also provided is a detachable coupling mechanism that permits an accessory, such as a face shield, to be detachably coupled to the safety headwear. For example, the face shield may be coupled to a brim guard via a detachable cover. When the detachable cover is coupled to the brim guard, the face shield is secured to the brim guard in front of the face of the user. When the detachable cover is decoupled from the brim guard, the face shield can be removed and optionally replaced with a different face shield.

Figure 1:
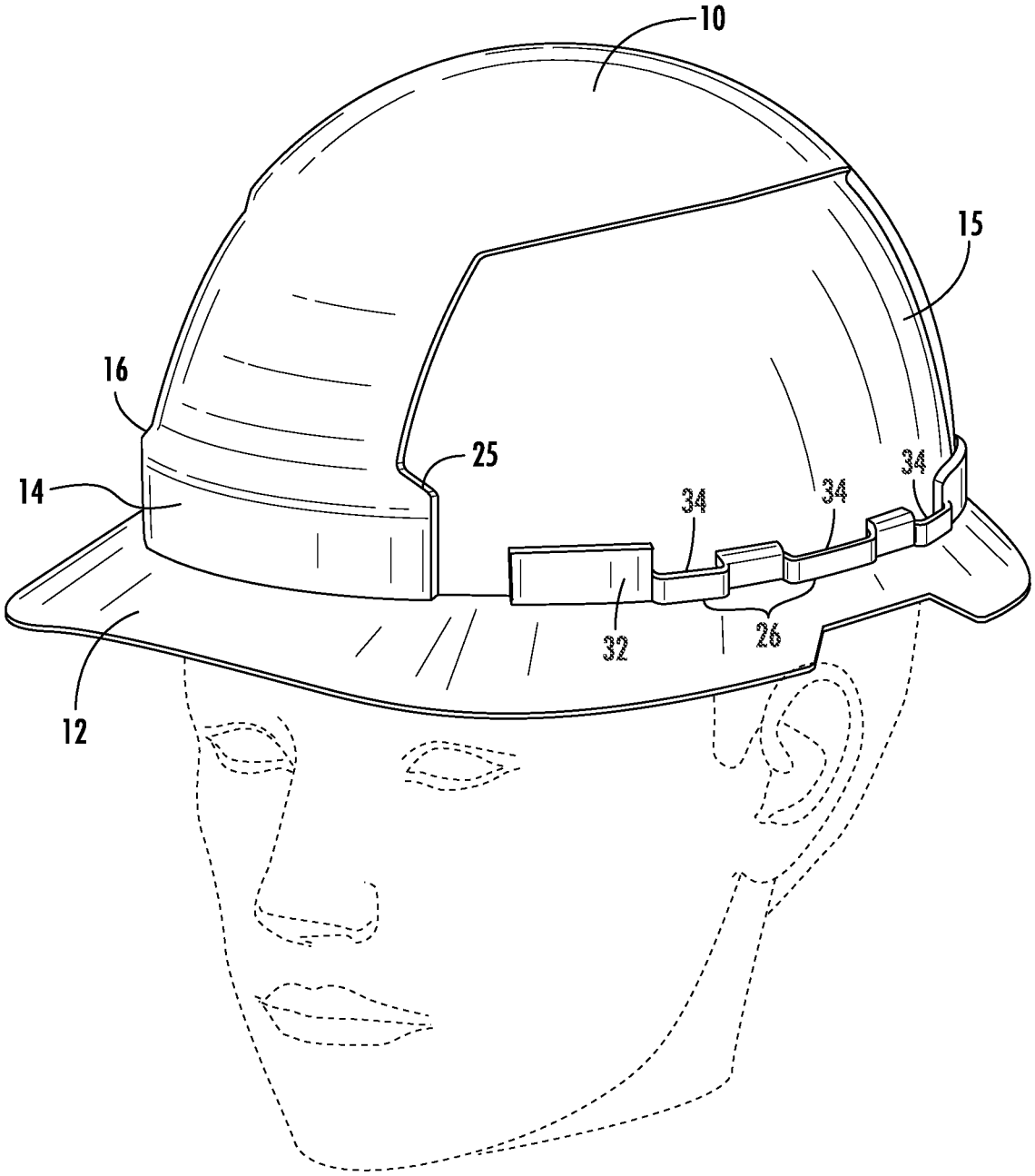
FIG. 1 is a hard hat with a forward accessory mounting location worn with the brim facing forward, according to an exemplary embodiment.

FIG. 1 shows an operator wearing a hard hat 10. FIG. 1 is said to be brim 12 styled because brim 12 surrounds and/or extends around a front 14 and rear 15 of hard hat 10. As illustrated, hard hat 10 is oriented in a forward-facing direction with a front mounting location 16 above a visor, ridge, bill, or brim 12 of the front 14 of hard hat 10. In this configuration, front brim 12 is located at the front 14 of hard hat 10, shields the operator's eyes, e.g., from the sun. In the illustrated position, a rear 15 of hard hat 10 is in the back of the user's head and provides a smaller brim 12 to shade to the user's neck.

Figure 2:
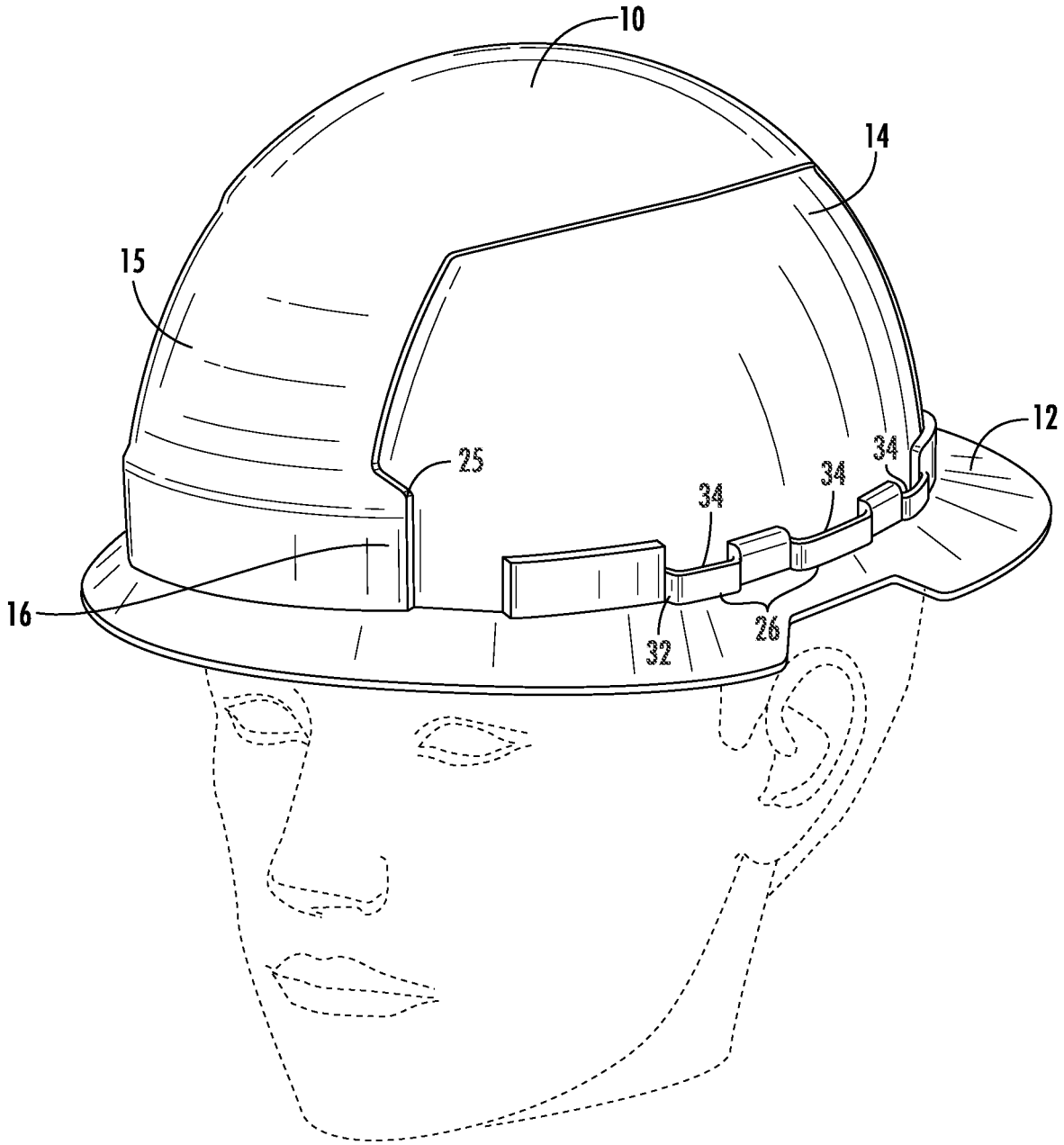
FIG. 2 is a hard hat with a rearward accessory mounting location worn with the brim facing backward, according to an exemplary embodiment.

FIG. 2 shows a reversed hard hat 10, such that the front 14 is at the back of the user's head, and the rear 15 is above the eyes. A rear mounting location 16, the same as or similar to the front 14 mounting location 16, is reversed. In other words, the rear 15 mounting location 16 is located above the user's eyes and available for attachment of an accessory 18 (FIGS. 3 and 9, e.g., a lamp 20 or face shield 22) to hard hat 10. In both FIGS. 1 and 2, each attached accessory 18, such as a headlamp and/or face visor, includes a mounting bracket 24 (FIG. 3) that securely attaches to ridges 25 on front 14 or rear 15 mounting locations 16 of hard hat 10.

Figure 3:
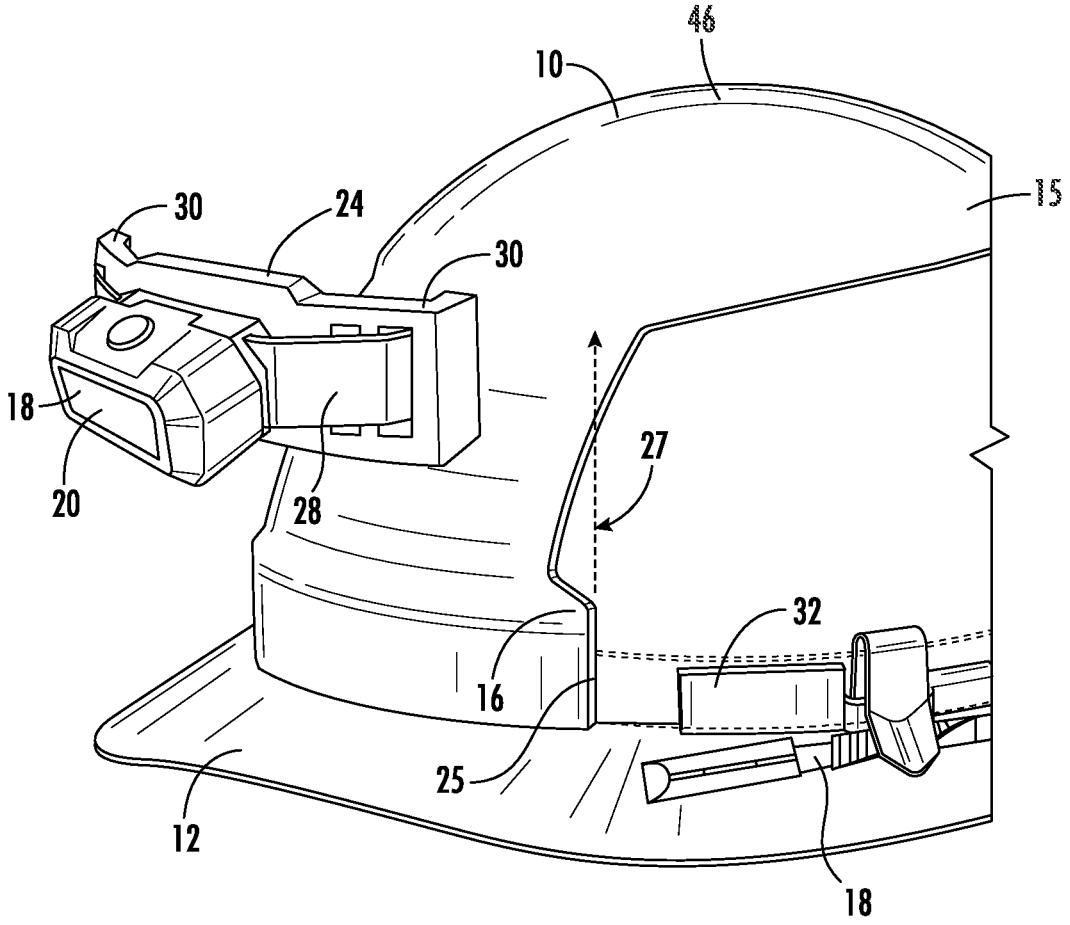
FIG. 3 is a detailed view of a disconnected lamp accessory connected to a rigid bracket at the forward mounting location, according to an exemplary embodiment.

FIG. 3 illustrates bracket 24 attachment of a lighting element, shown as headlamp or lamp 20, at mounting location 16 on hard hat 10. In some embodiments, the attachment system includes mounting bracket 24, lamp 20, and a strap 28. Bracket 24 includes clips or receiving slots 30 that interface with ridges 25 on front or rear mounting locations 16 of hard hat 10. Bracket 24 provides structural support to lamp 20 and provides a rigid attachment location to secure lamp 20 on hard hat 10. Strap 28 interconnects lamp 20 to bracket 24 and provides a mechanism to attach a variety of lamps 20, including aftermarket lamps with strap 28 at receiving or mounting locations 16 of hard hat 10.

A strap or band 32 wraps around the circumference of hard hat 10 without interfering with the mounting locations 16 or auxiliary ridges 26. For example, band 32 passes through openings under auxiliary ridges 26. Band 32 supports hand tools and/or other equipment suitable for storage along brim 12 or auxiliary ridges 26 of hard hat 10.

Similarly, various accessories 18 attach or couple to ports 34 in an auxiliary ridge 26 of hard hat 10. In some embodiments, tools and/or other accessories 18 include a fastener or receiving slot 30 that couples with one or more ports 34.

FIGS. 1 and 2 show different sized ports 34. A smaller port 34 accommodates a smaller accessory 18 (e.g., tool or eyeglass carrier). Similarly, a larger port 34 is used for a larger accessory 18 (e.g., earmuffs 38). In some embodiments, a front, middle, and/or rear port 34 are interchangeable to receive and/or support various accessories 18. For example, a rear port 34 is located along an axial axis 40, which is located at a centerline of the operator's neck. When an accessory 18 is coupled, the rear port 34, the accessory 18 is aligned with the axial axis 40 to reduce the moment or load on the user's neck.

Figure 4:
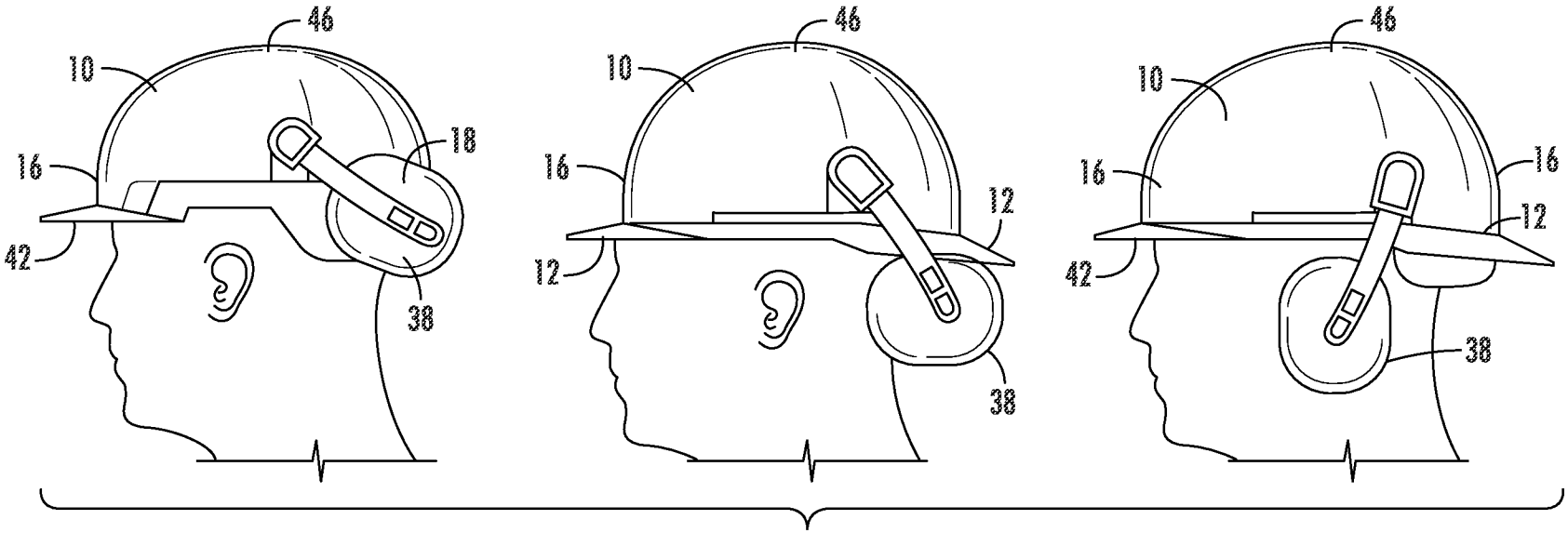
FIG. 4 is a comparison of a bill style hard hat and a brim hard hat supporting earmuffs, according to an exemplary embodiment.

FIG. 4 is a comparison of a white bill 42 style on the left and a green brim 12 style hard hat 10 in the middle. Bill 42 styled hard hats 10 have a bill 42 in front 14 (e.g., over the user's eyes), but no brim 12 surrounding the sides (e.g., ear) and/or rear 15 (e.g., neck) of hard hat 10. In contrast, brim 12 styled hard hats 10 have a brim 12 at least partially surrounding and extending about the front 14, rear 15, and/or sides of hard hat 10. For example, FIGS. 1-3 show a brim 12 styled hard hat 10. Applicant has found that users have preferences for different styles of hard hats 10. For example, brim 12 styles can be symmetric/balanced from front 14 to rear 15, whereas bill 42 styles enable a user to rotate earmuffs further upwards without interference from the surrounding brim 12. As will be discussed in more detail below, different styles of hard hats 10 may have different geometries but can have the same or similar mounting locations 16 to support the same accessories 18.

The composite image of bill 42 and brim 12 hard hats 10 is shown on the left of FIG. 4. In this composite image, the white bill 42 (e.g., of bill 42 styled hard hat 10) is shown extending further in front 14, and the extended brim 12 is shown extending further from the side and rear 15 of hard hat 10. Both bill 42 and brim 12 hard hats 10 are shown supporting earmuffs 38 in the rearward port 34. As shown, white bill 42 hard hat 10, on the left, does not interfere with rotation of earmuffs 38 to a position above and/or behind the user's ear. The middle image shows earmuff 38 stored behind the operator's ear, but under brim 12 to minimize interference of the earmuff 38 with the rearward brim 12 of hard hat 10.

Often the user attaches various accessories 18 at different locations (e.g., mounting location 16 and/or ports 34) to maximize utility (e.g., accommodate more accessories 18) and/or comfort. The composite image on the right shows earmuffs 38 in the rear port 34. In this position, earmuff 38 extends substantially parallel to axial axis 40 and over the user's ears, when earmuffs 38 are in the shown operating position. For example, a user places earmuff 38 in the third or rear port 34 because this attachment location for earmuff 38 is closer to a centerline, or axial axis 40, of the operator's neck (e.g., the base of the user's head). Alternative positions for accessories 18 may aid with shade and/or muscle comfort, e.g., by keeping the mass or CG as close to the axial axis 40 at the centerline.

Stated differently, accessories 18 fit differently on hard hats 10 of different styles and/or geometries. However, where the mounting locations 16 and/or auxiliary ridges 26 are the same, or similar, for different hard hats 10 they interchangeably receive the various accessories 18 with a complimentary mounting bracket 24.

Figure 5:
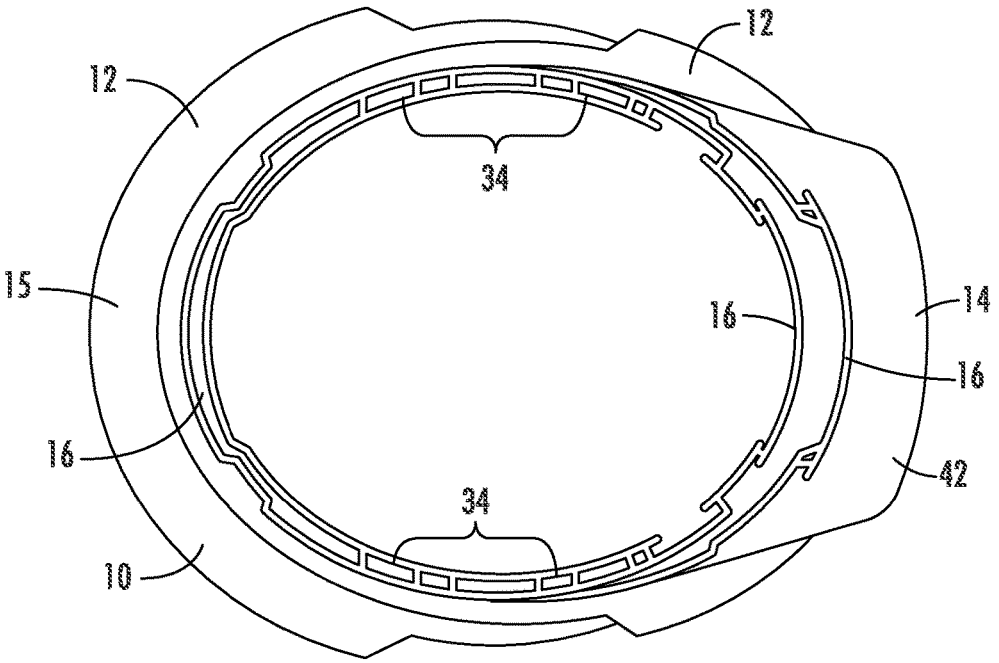
FIG. 5 is a cross-sectional comparison of the bill style hard hat and the brim hard hat of FIG. 3, according to an exemplary embodiment.

FIG. 5 is a cross-sectional comparison of the bill 42 style and the brim 12 style hard hats 10 of FIG. 4. As shown, in various embodiments, hard hat 10 has a full brim 12 (e.g., brim 12 style) or a large bill 42 without a surrounding brim 12 (e.g., bill 42 style). Mounting locations 16 for the bill 42 and brim 12 style hard hats 10 are different. For example, comparably sized hard hats 10 have an offset between the mounting location 16 on the short brim 12 (brim 12 style) and long bill 42 (bill 42 style) hard hat 10.

Figure 6:
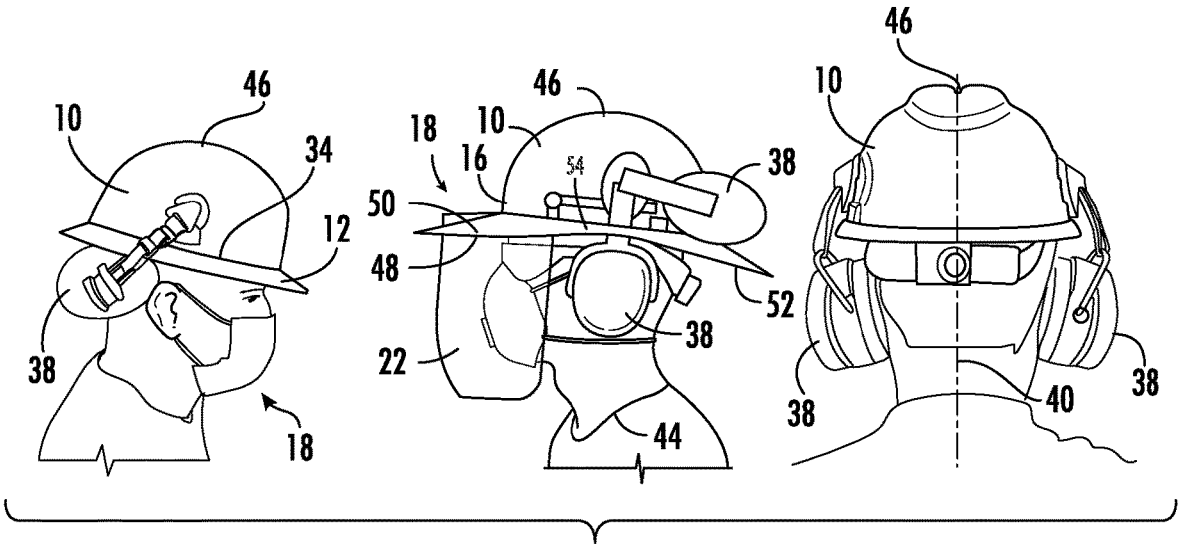
FIG. 6 shows the mounting locations of hard hat to mount hardware (e.g., earmuffs) over the neck foundation, according to an exemplary embodiment.

FIGS. 5-6 show the mounting locations 16 and auxiliary ridges 26 of hard hat 10 that are accessible to mount hardware and/or accessories 18 interchangeably. Applicant has found that accessory 18 attachment over a foundation 44 of the user's neck, e.g., at a central structural location of the user's neck, minimizes the effort and wear user experiences wearing the hard hat 10. As shown in the middle of FIG. 6, the foundation 44 is a centrally supported location of the user's neck. Applicant has found that foundation 44 is anatomically situated to best support the weight of accessories 18 and/or hard hat 10 for prolonged use.

In some embodiments, accessories 18 are symmetrically oriented about the foundation 44 of the user's neck, as shown in the image on the right. Each component balances its center of gravity (or CG) with an equal and opposite CG location. In other words, each part is balanced for the same part symmetrically supported on the opposite side of the neck. For example, hard hat 10 symmetrically locates and secures the attachment point or receiving slot 30, the extension arm, and muff of each earmuff 38 relative to axial axis 40. Axial axis 40 extends through the foundation 44 of the operator's neck to a crown 46 of hard hat 10 on the user's head.

By organizing accessories 18 to align with the foundation 44 of the operator's neck, Applicant has found that the hard hat 10 and accessories 18 are more comfortable to wear for prolonged periods, and user compliance with proper wear is enhanced. In some embodiments, the weight of a front accessory 18 is balanced with a rear accessory 18. For example, when earmuffs 38 are attached in the rear port 34, they balance a face shield 22 mounted at the front. Mounting earmuffs 38 in the rear port 34 also provide additional space at the front 14 of hard hat 10 for face shield 22, e.g., in a stored position.

FIG. 6 also shows an extendible visor attachment 48 that surrounds and couples to auxiliary ridges 26 and/or mounting locations 16 of hard hat 10, similar to band 32. Visor attachment 48 couples under mounting locations 16 and/or auxiliary ridges 26 in such a way as to leave ports 34 and mounting locations 16 available for additional accessories 18. Visor attachment 48 is made from a flexible material, such as a polymer or plastic. In one embodiment, visor attachment 48 includes a front portion 50 and a rear portion 52 interconnected by an elastic section 54. Elastic section 54 enables a user to stretch the visor attachment 48 around the auxiliary ridge 26 and mounting locations 16.

Visor attachment 48 is coupled under the mounting locations 16 and the auxiliary ridge 26 of hard hat 10 and rotates to move an earmuff 38 from below the visor attachment 48 in an operation position 56 to a stored position 58 for earmuff 38 above the visor attachment 48. In addition, the elastic section 54 enables the visor attachment 48 to provide slack when earmuff 38 is moved over the visor attachment 48 from an operation position 56 to a stored position 58. In this way, the flexible nature of visor attachment 48 and/or elastic section 54 facilitates the movement from use or operation position 56 to stored position 58 and back.

FIGS. 7A-7D show a brim guard 60 with a mounting bracket 24 that attaches to the mounting locations 16 on hard hat 10. Brim guard 60 acts like a bridge for face shield 22.

Brim guard 60 enhances face shield 22 compatibilities with different styles and sizes of hard hats 10, e.g., brim 12 and bill 42 styles.

Brim guard 60 includes a visor, shown as ridge extension 62, a first lateral wall 59 extending upward from ridge extension 62, and a second lateral wall 63 opposing the first lateral wall 59 extending upward from ridge extension 62. The first lateral wall 59 includes a first inner surface 61, and the second lateral wall 63 includes a second inner surface 65, the second inner surface 65 and the first inner surface 61 facing towards each other. The first lateral wall 59 and the second lateral wall 63 slidably engage with opposing portions, shown as ridges 25, of mounting element 17 of hard hat 10, thereby coupling brim guard 60 to hard hat 10. In various embodiments ridges 25 extend away from each other, and each of first lateral wall 59 and second lateral wall 63 of mounting bracket 24 includes a rib 67, 71 that engages between the opposing ridges 25 and the shell 11. In various embodiments, each of opposing ridges 25 defines a primary longitudinal axis 27 (FIG. 3). In various embodiments, hard hat 10 includes a mounting element 17 at a front 14 of hard hat 10, and a mounting element 19 at a rear 15 of hard hat 10. Mounting element 17 and mounting element 19 are each configured to slideably engage with brim guard 60.

Figure 7A:
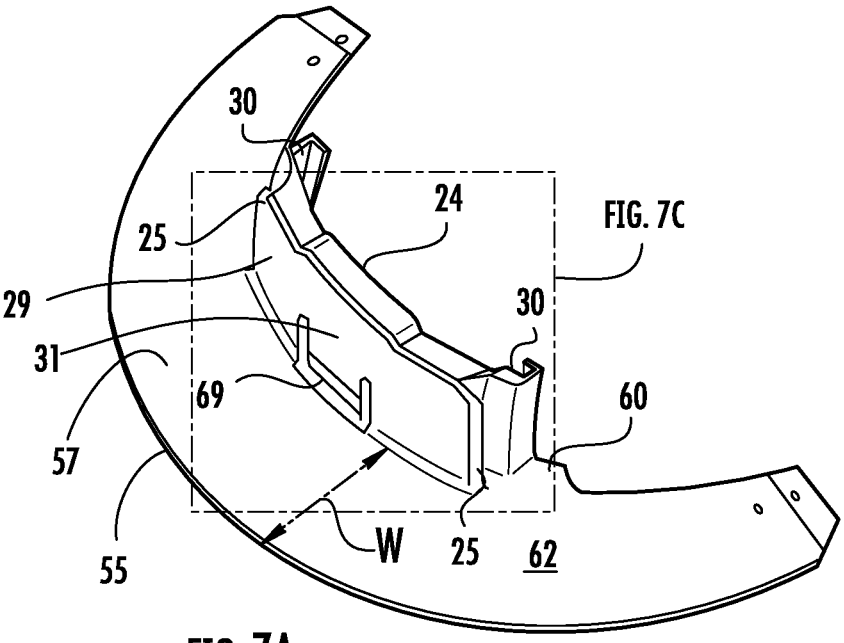
FIG. 7A is a perspective view of a brim guard, according to an exemplary embodiment.
Figure 7B:
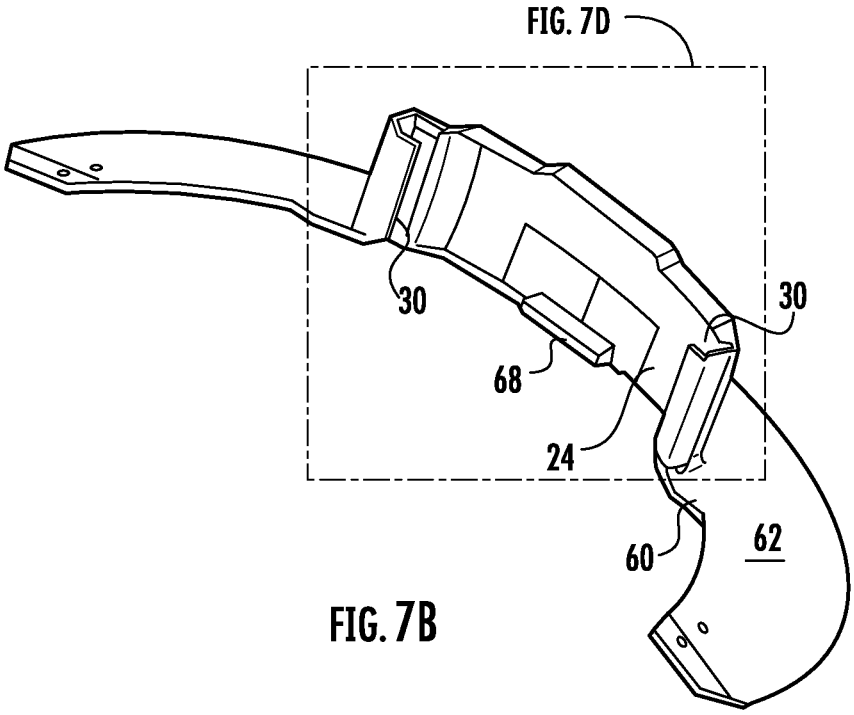
FIG. 7B is a perspective view of the brim guard of FIG. 7A, according to an exemplary embodiment.
Figure 7C:
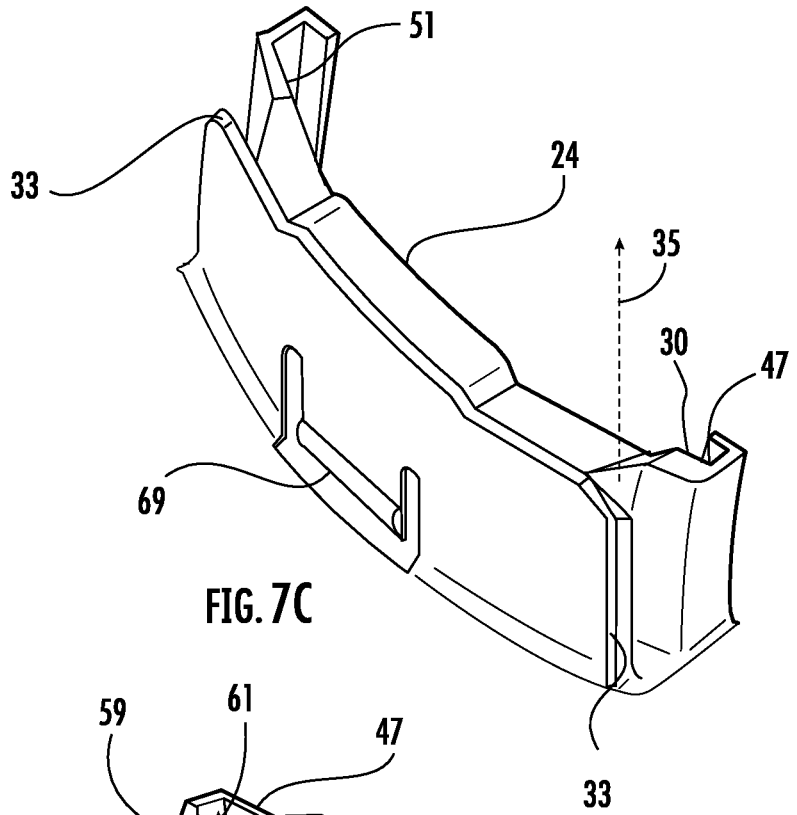
FIG. 7C is a detailed perspective view of a portion of the brim guard of FIG. 7A identified in FIG. 7A, according to an exemplary embodiment.

In various embodiments, brim guard 60, such as mounting bracket 24 of brim guard 60, includes mounting location 29 on an exterior 31 of brim guard 60 opposite the first lateral wall 59 and the second lateral wall 63 and/or first channel 47 and second channel 51. Stated another way, in various embodiments mounting bracket 24 of brim guard 60 includes mounting location 29 on an exterior 31 of brim guard 60 opposite the first lateral wall 59 and the second lateral wall 63, and mounting location 29 includes opposing ridges 33 that extend away from each other. Mounting location 29 includes opposing ridges 33 that extend away from each other. In various embodiments, each of opposing ridges 33 of brim guard 60 defines a primary longitudinal axis 35 that extends vertically (FIG. 7C). In various embodiments, lamp 20 (FIG. 3) is slideably engaged with the opposing ridges 33 of the brim guard 60.

Figure 7D:
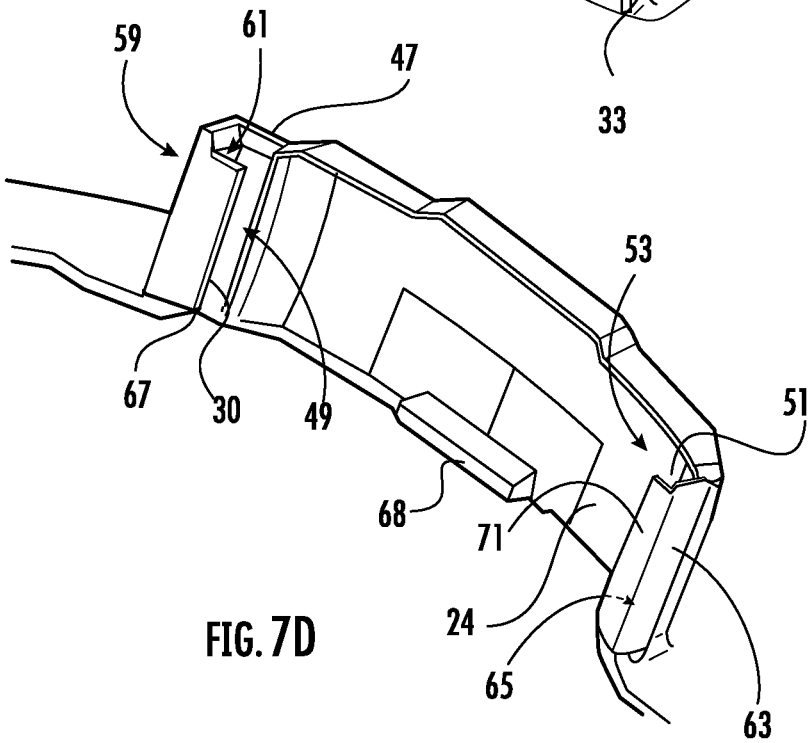
FIG. 7D is a detailed perspective view of a portion of the brim guard of FIG. 7A identified in FIG. 7B, according to an exemplary embodiment.

In various embodiments, brim guard 60 includes a mounting bracket 24 that each of the first lateral wall 59 and the second lateral wall 63 extend from. In various embodiments, brim guard 60 is coupled to mounting element 17 and/or mounting element 19 of hard hat 10 via mounting bracket 24. In various embodiments, brim guard 60 includes an overhang 68 extending from the mounting bracket radially inward towards a center 9 of the hard hat 10. In various embodiments, overhang 68 includes a generally horizontal structure (FIG. 7D).

Figure 8:
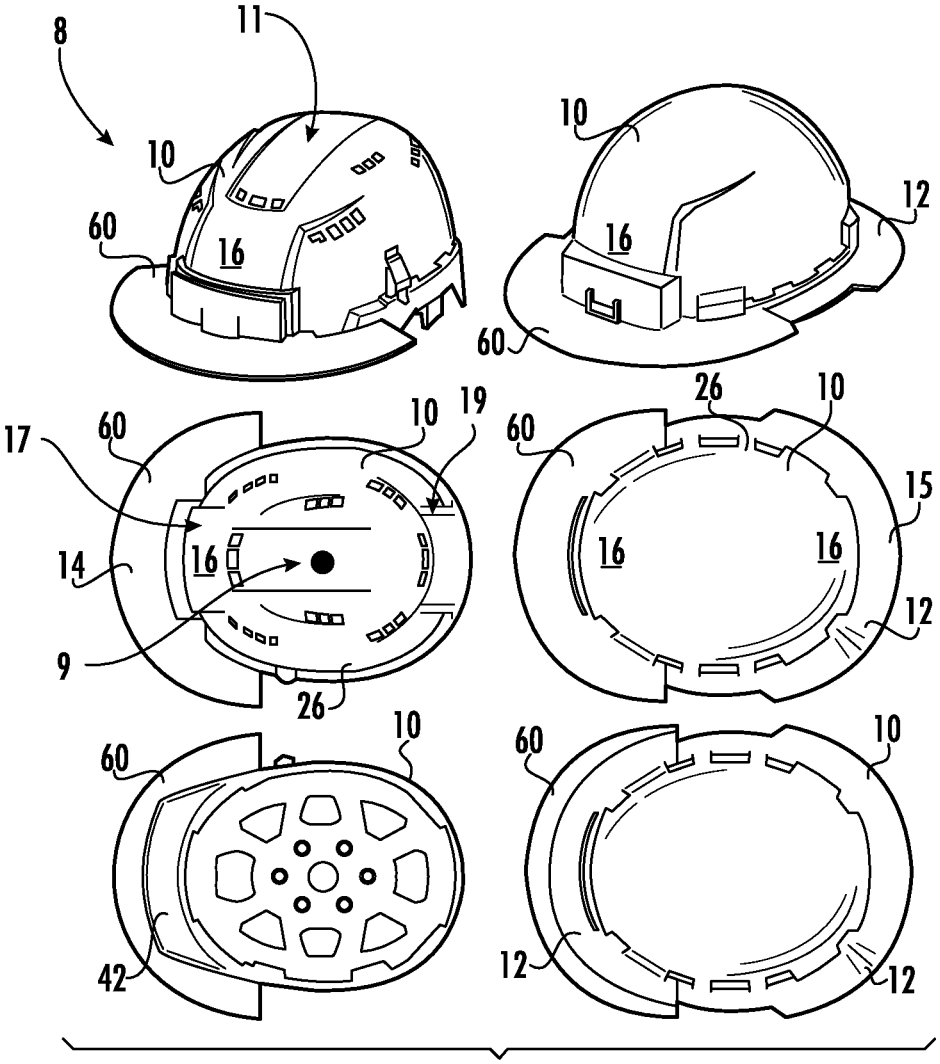
FIG. 8 shows how the brim guard of FIGS. 7A-7D couples to both the bill style and brim hard hats, according to an exemplary embodiment.

In various embodiments, brim guard 60 includes body 57 configured to couple to hard hat 10 such that a front 55 of body 57 is positioned at a front 14 of hard hat 10. In various embodiments, brim guard 60 includes mounting bracket 24 coupled to body 57. The mounting bracket 24 includes a first channel 47 extending vertically above the body 57, and a second channel 51 extending vertically above the body 57. The first channel 47 includes a first lateral opening 49 and the second channel 51 includes a second lateral opening 53, the second lateral opening 53 and the first lateral opening 49 facing towards each other. The first channel 47 is defined at least in part by first lateral wall 59 and rib 67, and second channel 51 is defined at least in part by second lateral wall 63 and rib 71. The first channel 47 and the second channel 51 slidably engage with opposing portions (e.g., ridges 25) of a mounting element 17 of the hard hat 10. In various embodiments, body 57 includes a flat and generally flat and horizontal structure that defines a visor, shown as ridge extension 62, the ridge extension 62 extending radially away from the hard hat 10 (FIGS. 7-8).

Mounting locations 16 on brim guard 60 support accessories 18 on hard hat 10 and a peak or visor, shown as ridge extension 62, protrudes radially outward between the mounting location 16 and an edge of brim guard 60. As such, brim guard 60 provides cross-compatibility between different hard hats 10 of different sizes and styles, including bills 42 and brims 12.

Brim guard 60 provides a space, or bridge, for accessories 18, such as lamp 20 to remain attached to hard hat 10 when an operator moves the face shield 22 from an operation position 56 to a stored position 58 and back. Also, brim guard 60 provides a reliable structural abutment, or seal, between the face shield 22 and any style of hard hat 10 with mounting locations 16 configured for the bracket 24 on brim guard 60.

In other words, brim guard 60 provides a structural and spacial bridge between hard hat 10 and face shield 22. Brim guard 60 provides support for an attached accessory 18 at the mounting location 16 of hard hat 10. And ridge extension 62 provides a structural offset or bridge from hard hat 10 to visor 64.

Brim guard 60 also has a duplicated mounting location 16 on an exterior of brim guard 60 to accommodate mounted accessories 18. For example, on one side (e.g., an inner surface) of brim guard 60 is a mounting bracket 24 that has ridges 25 similar to lamp 20. When this bracket 24 of brim guard 60 is coupled to a mounting location 16 of hard hat 10 an opposite, exposed side (e.g., outer surface) of brim guard 60 forms an available external mounting location 16 to receive and support an additional mounted accessory 18, such as a lamp 20, on hard hat 10.

Figure 18:
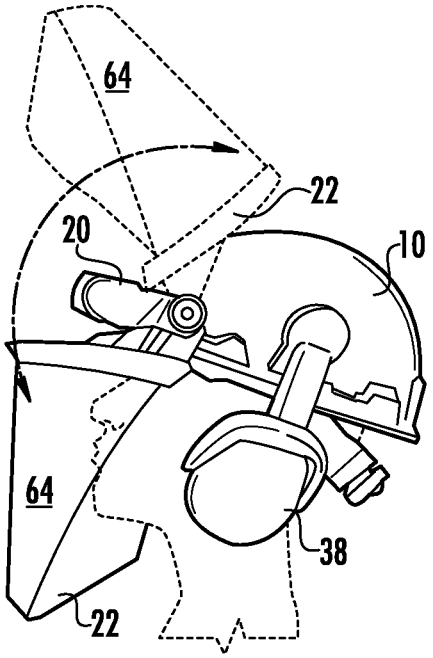
FIG. 18 shows a combination use of a brim guard to support a face shield and headlamp, such that the auxiliary ridge of the hard hat supports the earmuffs, according to an exemplary embodiment.
Figure 19:
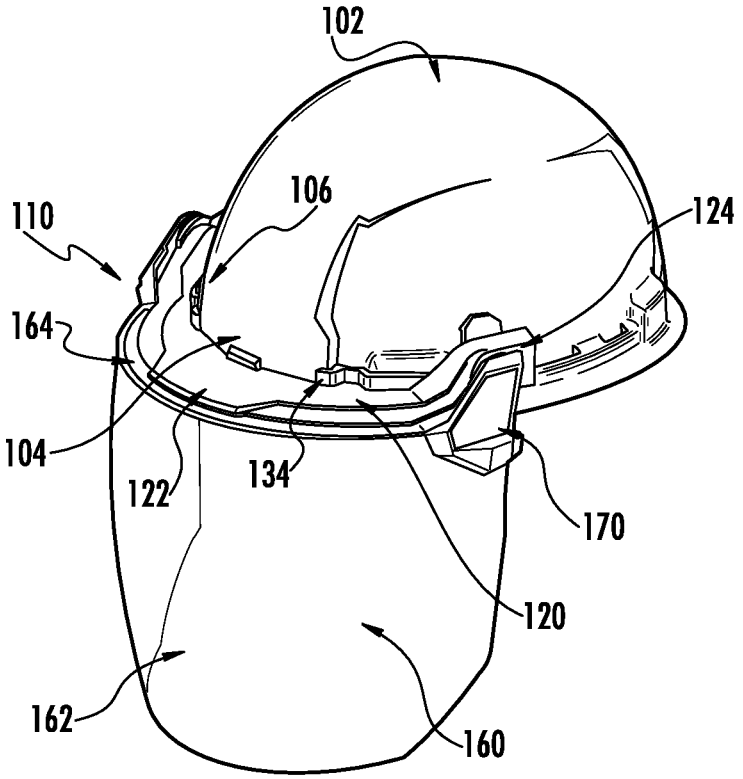
FIG. 19 is a perspective view of a protective system coupled to safety headwear, according to an exemplary embodiment.

To support accessory 18 and/or brim guard 60, each mounting location 16 has side ridges 25 on both sides of mounting location 16. Mounting bracket 24 has a complimentary side receiving slots 30 on both sides of mounting bracket 24. Side receiving slots 30 are configured to couple to ridges 25 at the mounting locations 16. For example, the couping of receiving slots 30 to ridges 25 mounts brim guard 60 to hard hat 10 and similarly mounts a lamp 20 to brim guard 60 (FIG. 18). In this way, brim guard 60 serves as a bridge between an accessory 18 and the mounting locations 16 of different sizes and styles of hard hats 10.

Applicant has found that having a mounting location 16 for the face shield 22 with the same, or similar, ridge extension 62 dimensions ensures the proper abutting visor 64 position for the face shield 22 in the operation position 56 to protect a user's eyes and/or face. Ridge extension 62 structurally interconnects face shield 22 over the brim 12 of hard hat 10. Stated another way, brim guard 60 extends from hard hat 10 and an upper end 23 of face shield 22 (FIG. 9) when the face shield is in a lowered position. In one embodiment, ridge extension 62 and face shield 22 abut to form a seal, such as a watertight or hermetic seal. The seal protects the user from intruding or splashed liquids.

Different users prefer different bills 42, brims 12, and/or hard hat 10 geometries. Different geometries are also advantageous for various worksites and/or jobs. For example, the same user may have one hard hat 10 with a large bill 42 for outdoor worksites and a second hard hat 10 with a small surrounding brim 12 to support a lamp 20 for indoor job sites.

Applicant has found that using an intermediary brim guard 60 enables the user to attach one face shield 22 that reliably abuts and/or seals against the brim 12 of a variety of hard hats 10. Brim guard 60 creates a reliable fitment regardless of the style, size, or geometry of the brim 12 or bill 42 on the hard hat 10. In this way, an operator with two hard hats 10 can attach, abut, and/or seal the face shield 22 to brim guard 60, and then interchangeably attach and detach the brim guard 60 and face shield 22 to the operator's preferred hard hat 10 for a particular environment or job. Alternatively, the same user attaches a welding face shield 22 for a welding job and attaches a protective eyeglass shield for woodworking. In other words, brim guard 60 bridges different sizes and shapes of various hard hats 10 (or face shields 22) and permits the use of one face shield 22 to fit various sizes of hard hats 10 with complimentary mounting locations 16.

In one embodiment, brim guard 60 includes an oblong locking protrusion 66 in mounting location 16. An overhang 68 on bracket 24 engages protrusion 69 to lock brim guard 60 on mounting locations 16 of hard hat 10. The coupled protrusion 69 and overhang 68 protect against inadvertent bumping or jostling of accessories 18 when brim guard 60 is coupled to hard hat 10.

FIG. 8 shows perspective, top, and bottom views, respectively, of a hard hat system 8 including brim guard 60. Hard hat 10 includes a shell 11 formed from a rigid material and a mounting element 17 extending from a front 14 of hard hat 10. The connection of brim guard 60 to hard hat 10 creates a ridge extension 62 that covers both bill 42 and brim 12 styled hard hats 10. The top row shows top perspective views of the brim guard 60 attachment to both bill 42 (left) and brim 12 styled (right) hard hats 10. Brim guard 60 attaches to both styles and creates a uniform ridge extension 62 with a consistent brim width W. The brim width W extends between the mounting location 16 of hard hat 10 to an edge of the ridge extension 62 on brim guard 60. As shown, the brim width W is greater than either bill 42 or brim 12 dimensions. The middle row shows how the brim guard 60 creates a uniformly sized attachment for an accessory 18 or face shield 22. The bottom row shows how the brim width W is longer than either extension of the bill 42 or brim 12 styled hard hats 10. Specifically, the black brim guard 60 is longer than the bill 42 (left) or brim 12 (right) of either hard hat 10.

In a specific embodiment, hard hat system 8 includes hard hat 10, brim guard 60, and a face shield (e.g., face shield 22 shown in FIG. 9) coupled to the brim guard 60. The face shield is moveable between a lowered position and a raised position such that the face shield is positioned below the brim guard 60 and/or the visor of the brim guard 60 (e.g., a majority of the face shield is below the visor) when the face shield is in the lowered position and the face shield is above the brim guard 60 and/or the visor of the brim guard 60 (e.g., a majority of the face shield is above the visor) when the face shield is in the raised position (see FIG. 9). In various embodiments, the face shield is pivotally coupled to brim guard 60.

In a specific embodiment, hard hat system 8 includes hard hat 10 including a shell 11 formed from a rigid material, that hard hat 10 including a mounting element 17 extending from a front 14 of hard hat 10, brim guard 60 coupled to hard hat 10, and a face shield (e.g., face shield 22 shown in FIG. 9) pivotally coupled to the brim guard 60.

Figure 9:
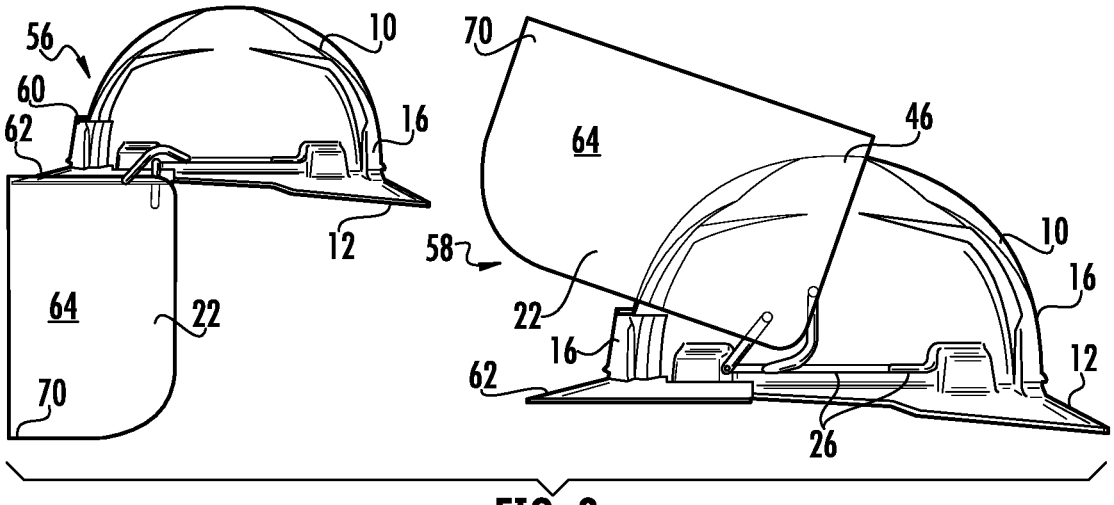
FIG. 9 shows the use or operating position and the storage position of a face shield, according to an exemplary embodiment.

FIG. 9 compares an operation position 56 and a stored position 58 of face shield 22. In the operation position 56, face shield 22 firmly abuts and/or seals against brim guard 60. When face shield 22 rotates into the stored position 58, the face shield 22 is rotated about hard hat 10 in such a way as not to interfere with other accessories 18 mounted at mounting locations 16 and or ports 34. Face shield 22 partially surrounds crown 46 to reduce the storage space and prevent interference with an attached accessory 18. As shown, a tip or end 70 of face shield 22 is located above crown 46 of hard hat 10. For example, a line from end 70 along visor 64 would form an obtuse angle with axial axis 40 when in the stored position 58. In some embodiments, end 70 is lowered such that the visor 64 extends in an orthogonal direction to axial axis 40. In other words, visor 64 extends in a perpendicular direction to axial axis 40 of the user's neck in the stored position 58.

Figure 10:
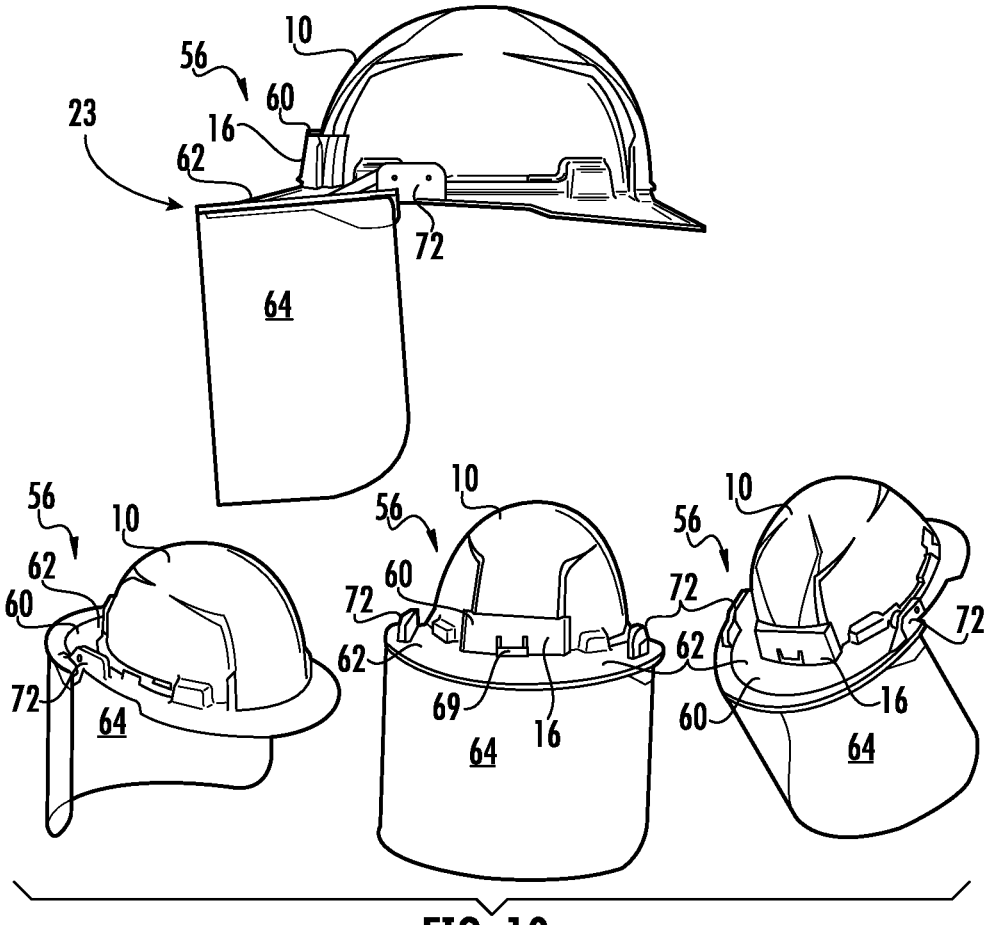
FIG. 10 shows various perspective views of a hard hat with a four-bar brim guard mounted face shield in the operating position, according to an exemplary embodiment.

FIG. 10 shows various perspective views of hard hat 10 with a four-bar attached brim guard 60 and mounted face shield 22, shown in the operation position 56. Visor 64 is coupled to brim guard 60 through a mechanism with a four-bar linkage 72. The four-bar linkage 72 interconnects visor 64 to brim guard 60 and defines locations or positions of visor 64 relative to brim guard 60 between and in the operation position 56 and the stored position 58. The four-bar linkage 72 shown in FIG. 10 shows a double-rocker mechanism that abruptly rotates face shield 22 about ridge extension 62 of brim guard 60 in a non-continuous motion.

Figure 11:
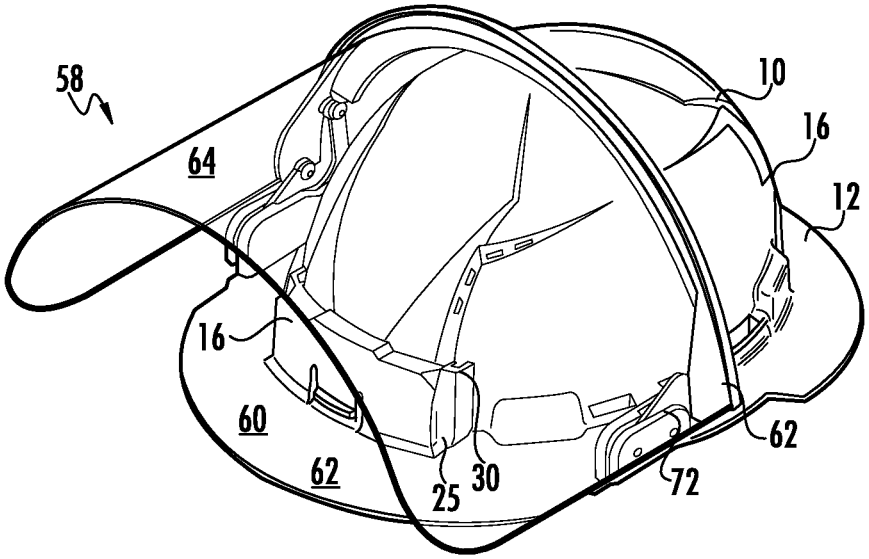
FIG. 11 is a top perspective view of a hard hat with a four-bar brim guard mounted face shield in the storage position, according to an exemplary embodiment.
Figure 12:
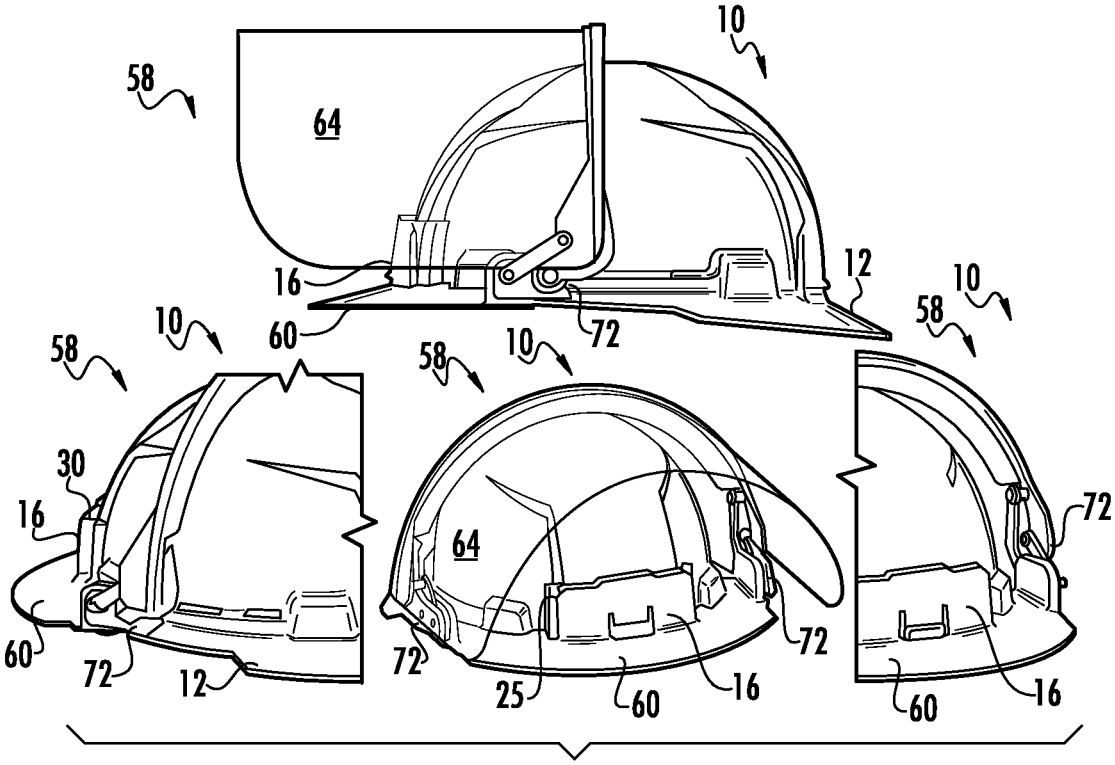
FIG. 12 shows various perspective views of a hard hat with a four-bar brim guard mounted face shield in the storage position, according to an exemplary embodiment.

FIG. 11 is a top perspective view of a hard hat 10 with a four-bar linkage 72 brim guard 60 mounting a face shield 22 in the stored position 58. FIG. 12 shows various perspective views of a hard hat 10 with the four-bar linkage 72 brim guard 60 mounting face shield 22 in the stored position 58. Comparison of FIG. 12 with FIG. 9 shows that the four-bar linkage 72 brim guard 60 of FIG. 12 lowers the visor 64 in the stored position 58. The end 70 of visor 64 in FIG. 12 is not rotated above crown 46. In other words, a line along visor 64 from end 70 towards crown 46 is perpendicular to axial axis 40 of the user's neck when worn in the stored position 58. Applicant has found that this configuration prevents the inadvertent catching of end 70 on overhead fixtures and also provides enough space, so visor 64 does not interfere with coupled accessories 18 at mounting locations 16 or the middle and/or rear ports 34 of auxiliary ridge 26.

Four-bar linkages 72 can provide either a smooth continuous motion or a non-continuous motion, such as a rocker motion. Four-bar linkages 72 define the position and rotation of visor 64 in and between the operation position 56 and the stored position 58. For example, drag-link and crank-rocker four-bar linkages 72 provide a continuous rotation for face shield 22, such that a user rotates the face shield 22 in one sweeping motion from an operation position 56 to a stored position 58. In contrast, a double-rocker four-bar linkage 72 mechanism does not have continuous motion. Rather, it is used to slide face shield up (e.g., vertically) to a rotation point, where face shield 22 rotates and/or slides linearly (e.g., 90 degrees) into a stored position 58 above crown 46 of hard hat 10. In various embodiments, four-bar linkage 72 includes a continuous motion parallelogram linkage mechanism, a drag-link continuous motion linkage mechanism, a crank-rocker continuous motion mechanism, and/or a double-rocker non-continuous motion mechanism.

Figure 13:
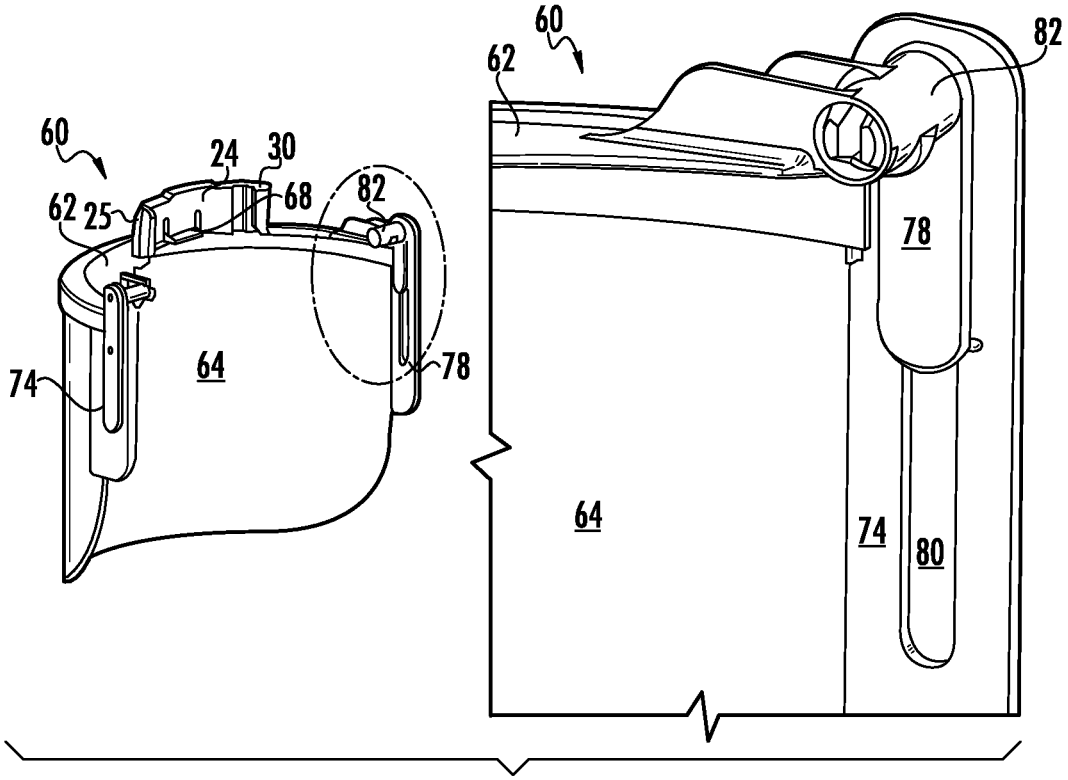
FIG. 13 is an isolated view of the sliding beam face shield showing the sliding mechanism, according to an exemplary embodiment.
Figure 14:
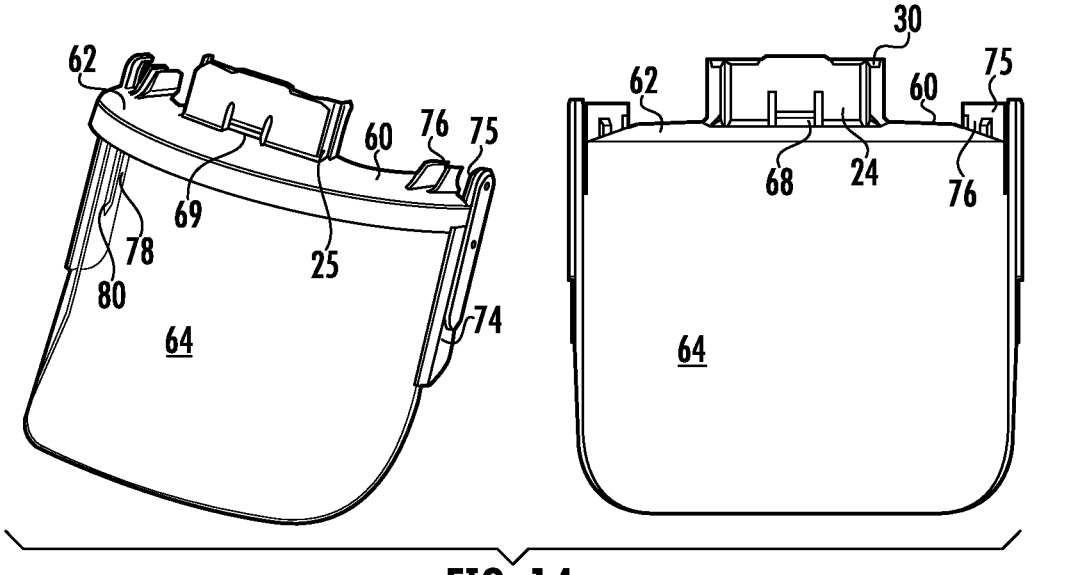
FIG. 14 is a front and rear view of the brim guard coupled to the face shield in an abutting position, according to an exemplary embodiment.

FIGS. 13-14 are isolated views of a sliding beam 74 face shield 22. A detailed cut-out view is shown on the right zooming in on the sliding mechanism or beam 74 between the face shield 22 and the brim guard 60. Brim guard 60 includes a socket 76 that couples to a slider 78 with a protruding pivot 75 through socket 76. Slider 78 follows a track 80 on face shield 22 assembly to elevate and lower face shield 22 relative to socket 76 on brim guard 60. Slider 78 and/or track 80 pivot about protruding pivot 75 within a socket 76 to move visor 64 away from the operator's face.

In one embodiment, slider 78 and socket 76 are a continuous part, and protruding pivot 75 is captured within track 80.

Protruding pivot 75 rotates within socket 76 of brim guard 60 to rotate face shield 22 between the operation position 56 and the stored position 58. The combined sliding action of slider 78 and pivoting/rotational movement of protruding pivot 75 within socket 76 enables the operator to store face shield 22 at any position along track 80 and/or rotated about socket 76. This prevents interference with mounted accessories 18 and facilitates rapid switches between the operation position 56 and the stored position 58.

FIG. 14 shows the inner bracket 24 and outer mounting locations 16 of brim guard 60. Ridges 25 couple to mounting locations 16 on hard hat 10. Overhang 68 couples to a protrusion 69 and locks face shield 22, for example, in an abutting or operation position 56 while in use. Brim guard 60 also includes an exterior mounting location 16, such that a lamp 20, or another accessory 18, can attach to the exterior of brim guard 60. Slider 78 and socket 76 enable the rotation of face shield 22, e.g., from the operation position 56 to the stored position 58.

Figure 15:
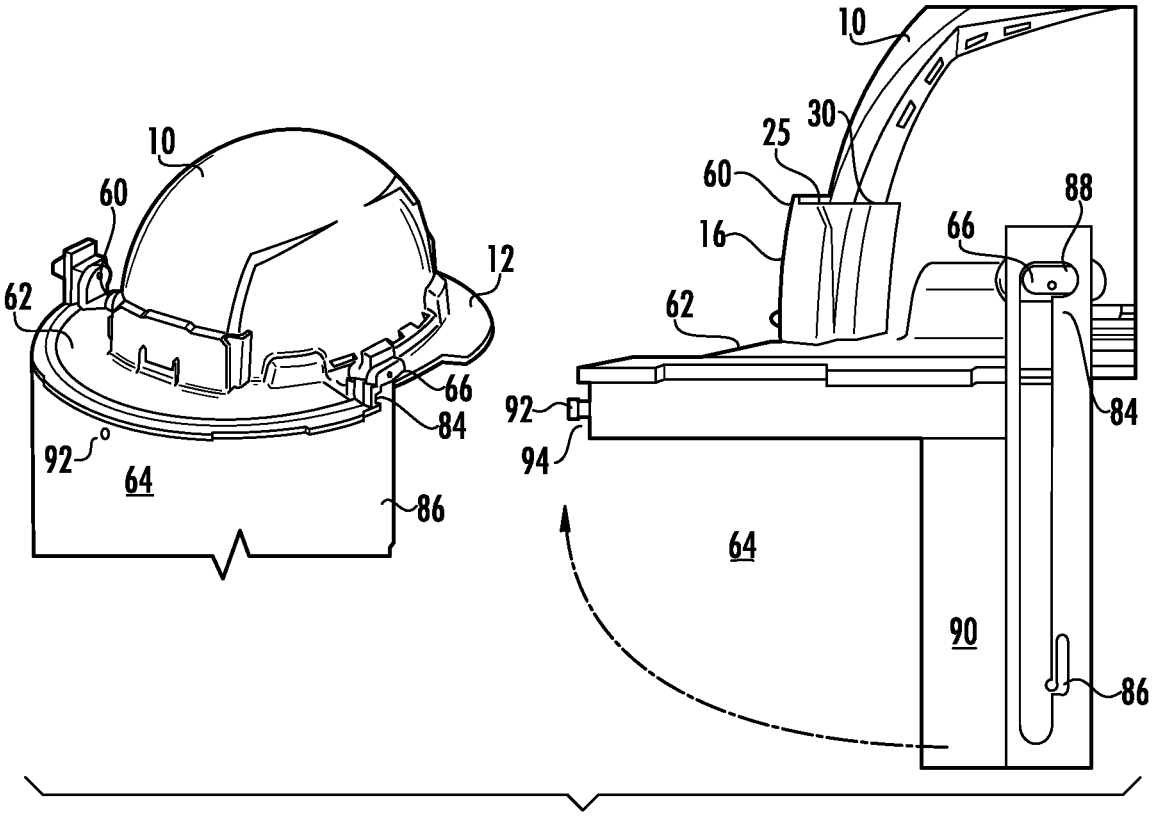
FIG. 15 shows perspective views of a locking pivot and slide mechanism that interconnects the face shield to the brim guard, according to an exemplary embodiment.

FIG. 15 shows perspective views of another embodiment of a locking face shield 22 with a locking pivot 84 and locking slide mechanism 86. Locking face shield 22 interconnects visor 64 to the brim guard 60 to mount locking face shield 22 on hard hat 10.

Figure 16:
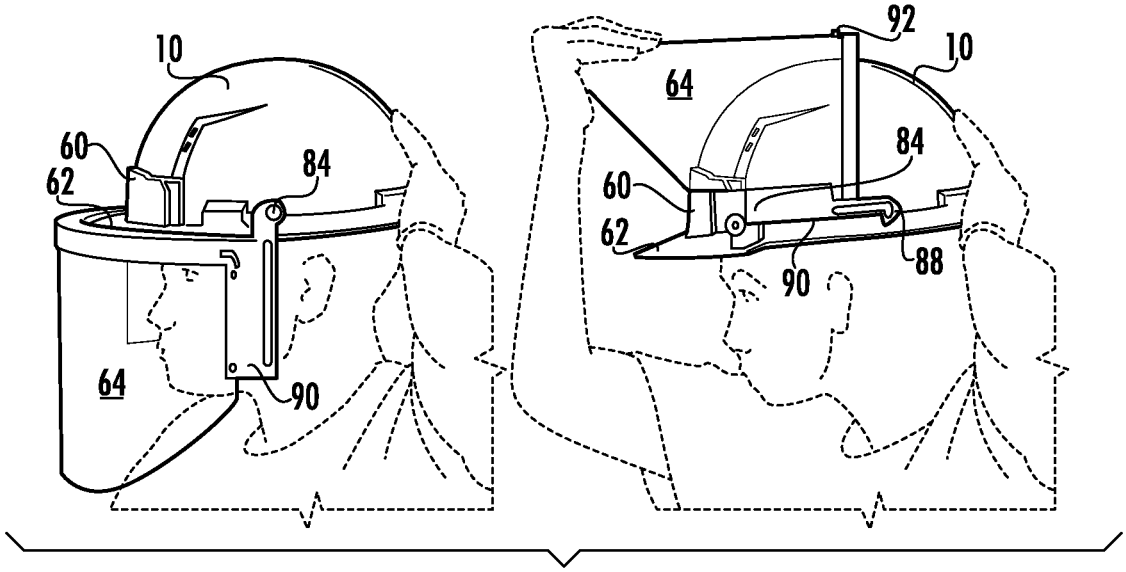
FIG. 16 is an operator using the locking pivot and slide mechanism of FIG. 15 in a locked operating position and a storage position, according to an exemplary embodiment.

FIG. 16 shows an operator unlocking the locking pivot 84 and locking slide mechanism 86 to rotate and slide the visor 64 from a locked operation position 56 to a secure stored position 58. Clasps or receiving slots 30 locking face shield 22 secure and/or lock visor 64 in a downward orientation in the operating position. The locking slide mechanism 86 prevents inadvertent displacement of visor 64 during the use of locking face shield 22. Similar receiving slots 30 capture and/or locking slide mechanism 86 in the stored position 58. For example, receiving slots 30 lock face shield 22 in a perpendicular direction to axial axis 40, such that an end 70 of visor 64 is in line with a crown 46 of hard hat 10 and extends perpendicular to axial axis 40.

Figure 17:
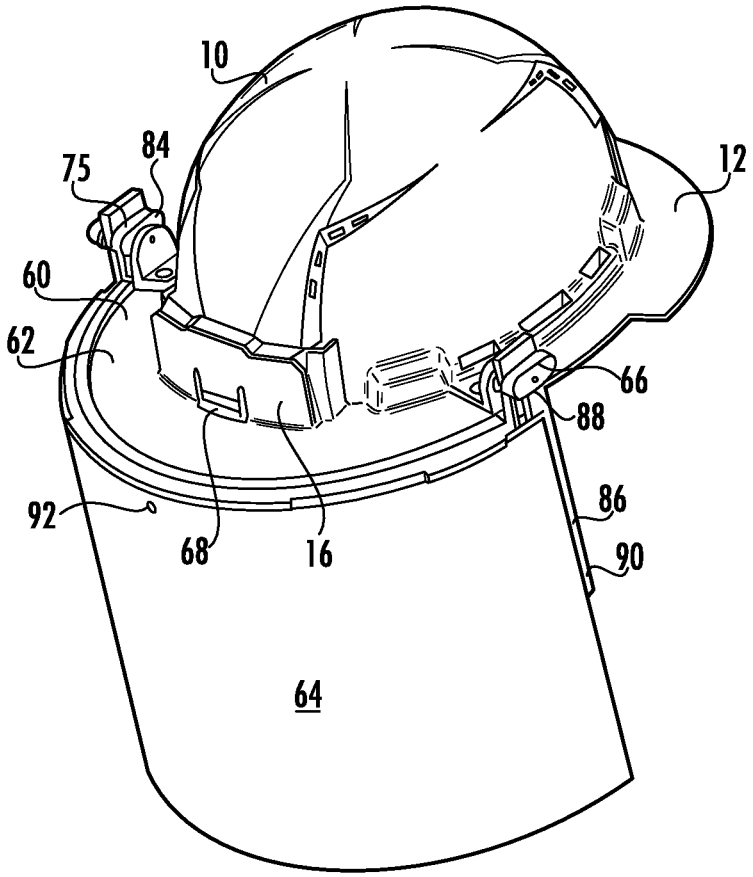
FIG. 17 is a top perspective view of the locking pivot mechanism of FIG. 15, according to an exemplary embodiment.

FIG. 17 is a top perspective view of the locking pivot 84 mechanisms. As shown, locking pivot 84 has a partial circular hole 88 and an oblong locking protrusion 66. Locking pivot 84 requires rotation of oblong locking protrusion 66 through a slot or partial circular hole 88 before the linear displacement of locking slide mechanism 86 through rails 90 on visor 64. Thus, locking pivot 84 mechanism is capable of locking visor 64 in an operation position 56 where visor 64 abuts brim guard 60, or in a storage position, where visor 64 is rotated and pulled back over the crown 46 of user's head. In one embodiment, a pin 92 on face shield 22 is configured to fit within an aperture 94 of visor 64 to further lock visor 64 in either an operating or stored position 56 or 58.

In one embodiment, a shape of partial circular hole 88 restrains the user motion to a rotation action first, before a linear sliding motion from the operation position 56 to the stored position 58. In other words, the restraint locks the operation position 56 and protects against inadvertent bumping or jostling of the face shield 22 during use. For example, a locking slide mechanism 86 on either track 80 or slider 78 prevents linear displacement of visor 64 in the operation position 56. Similarly, partial circular hole 88 provides a locking pivot 84 in the operation position 56 to prevent inadvertent movement of face shield 22 from the operation position 56.

FIG. 18 shows a combination use of a brim guard 60 rotated in the operation position 56 or the stored position 58. Brim guard 60 is coupled to the front 14 mounting location 16 and creates a new or replacement mounting location 16 for the lamp 20 so that an operator can attach lamp 20 to brim guard 60 of face shield 22 on the same mounting location 16 of hard hat 10.

As shown, brim guard 60 support face shield 22 and lamp 20. Ports 34 support additional accessories 18 (e.g., earmuffs 38) on either side of hard hat 10. FIG. 18 illustrates rotation of face shield 22 can be rotated/slide between an operating position and a stored position 58 without interfering with other mounted accessories 18. For example, an operator is free to open face shield 22 from operation position 56 to stored position 58 without removing or adjustment of lamp 20 coupled to mounting locations 16 of brim guard 60 or earmuffs coupled to auxiliary ridges 26 on either side of hard hat 10. Similarly, the operator can close face shield 22 from stored position 58 to operation position 56 without adjustment of accessories at mounting locations 16 or the auxiliary ridge 26 of hard hat 10.

Referring to FIGS. 19-24, various aspects of protective system 110 for safety headwear 102 are shown. Protective system 110 includes brim guard 120. Brim guard 120 is configured to couple to a front portion 104 of safety headwear 102, such that the brim guard 220 extends circumferentially partially around the safety headwear 102 from a front-left to a front-right. When brim guard 120 is coupled to safety headwear, a front 122 of brim guard 120 is adjacent front portion 104 of protective headwear 102. Slot 134 of brim guard 120 couples to bracket 106 of safety headwear 102.

Cover 170 is pivotally and detachably coupled to brim guard 120. Cover 170 pivots with respect to brim guard 120 about axis 182 between a secured position and an unsecured position. The face shield 160 is coupled to the brim guard 120 when the cover 170 is in the secured position and the face shield 160 is detachable from the brim guard 120 when the cover 170 is in the unsecured position Cover 170 couples a protective shield, shown as face shield 160, to coupling structure 124 of brim guard 120 and to protective headwear 102. Face shield 160 includes a primary panel 162, which is positionable in front of a face of a person wearing the safety headwear 102. In a specific embodiment, face shield 160 includes an upper ledge 164 that extends above a front brim of safety headwear 102 and/or a horizontal portion of brim guard 120. In another embodiment, the face shield 160 is formed of a mesh structure (e.g., wire and/or other elongate materials).

Figure 20:
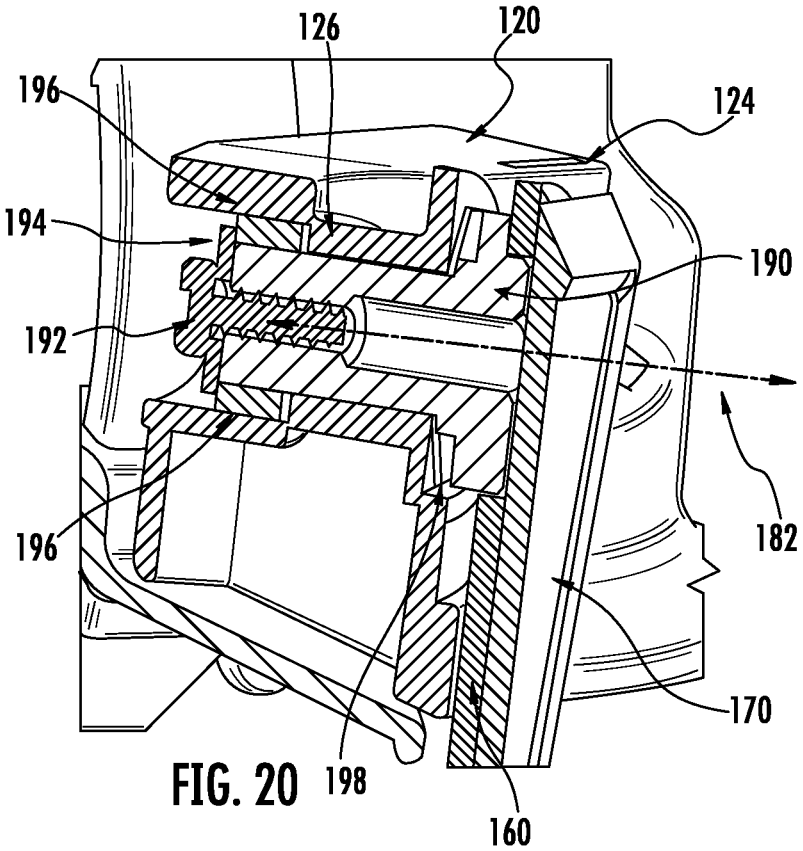
FIG. 20 is a detailed perspective view of a cross-section of the protective system and safety headwear of FIG. 19, according to an exemplary embodiment.

Referring to FIG. 20, cover 170 rotates with respect to brim guard 120 about axis 182. In a specific embodiment, a coupler 190 extends within cylinder 126 defined by brim guard 120. Coupling elements, shown as screw 192 and washer 194, couple coupler 190 to brim guard 120. Biasing elements, shown as spring 196 and detent 198, bias the cover 170 to remain in the secured position.

Figure 21:
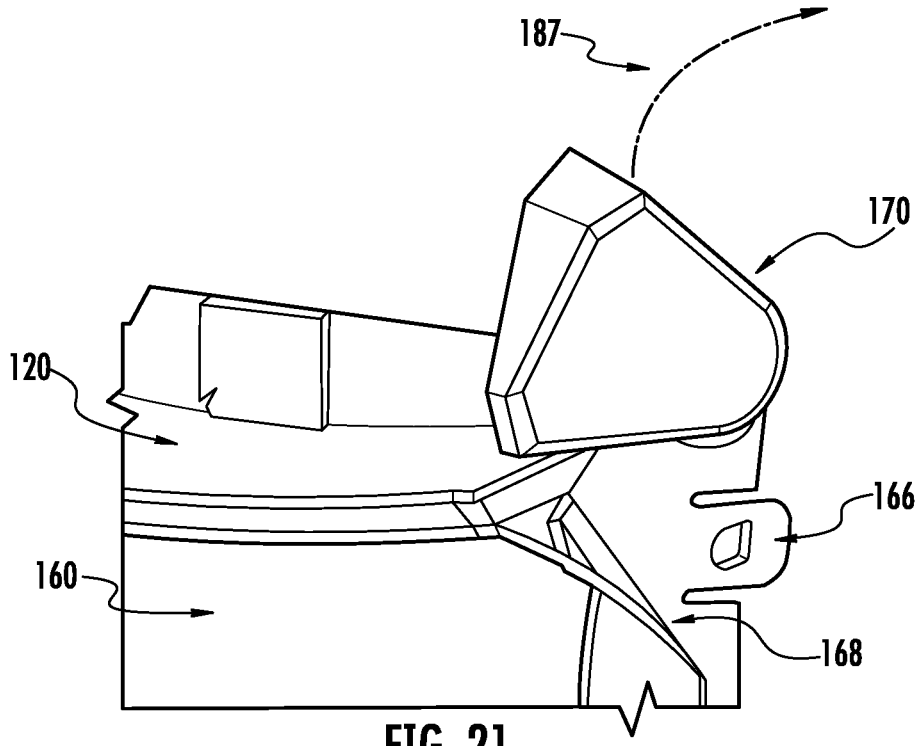
FIG. 21 is a perspective view of the protective system of FIG. 19, according to an exemplary embodiment.
Figure 22:
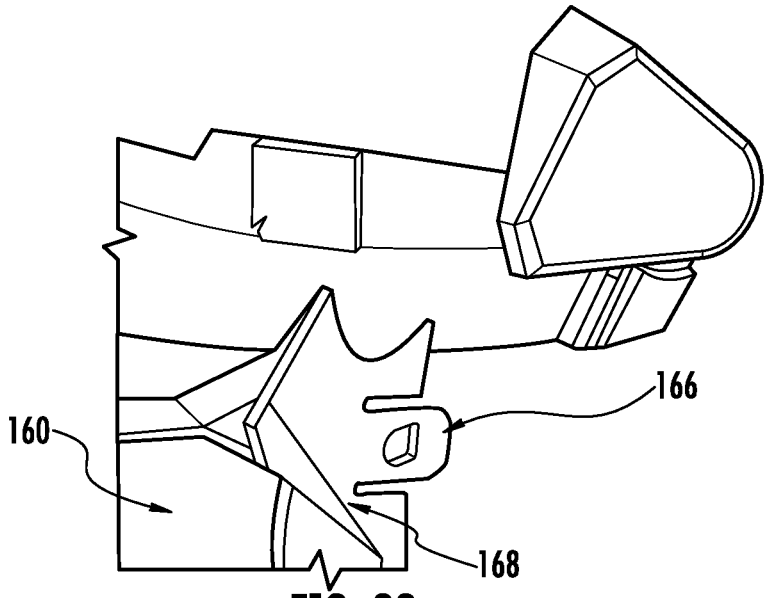
FIG. 22 is a perspective view of the protective system of FIG. 19, according to an exemplary embodiment.

Referring to FIGS. 21-22, a process of decoupling cover 170 to remove face shield 160 from brim guard 120 is shown. Cover 170 interfaces with curved ledge 168 to secure face shield 160 to brim guard 120. First, projection 166 is decoupled from cover 170 and then cover 170 is rotated in direction 187, thereby exposing coupling element, shown as projection 166, and curved ledge 168 of face shield 160. Then, face shield 160 is pulled from brim guard 120 (FIG. 22).

Figure 23:
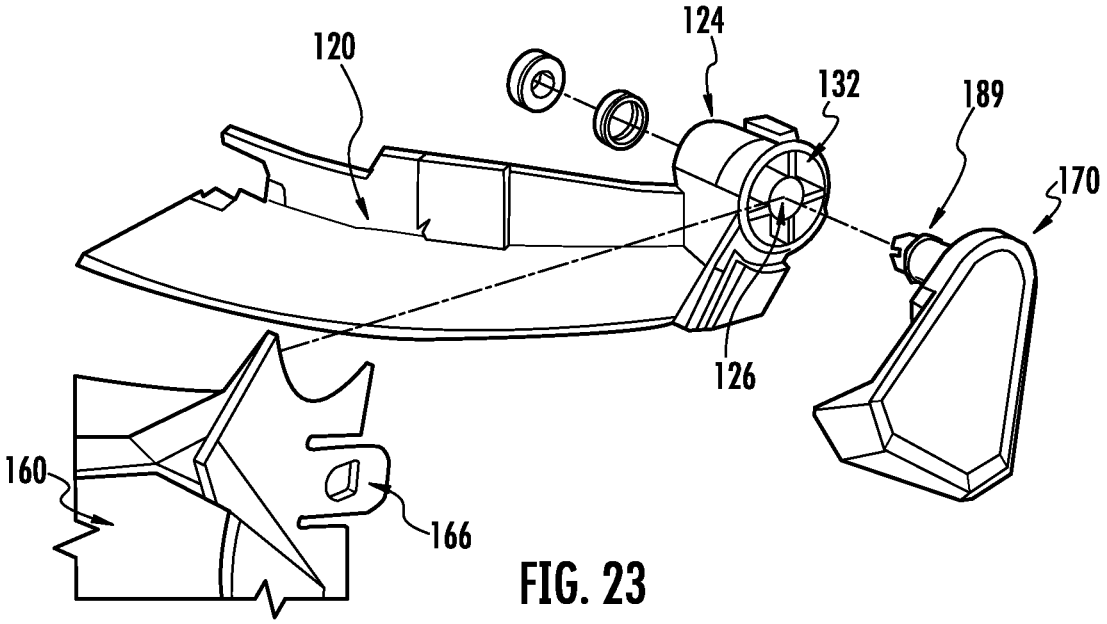
FIG. 23 is a perspective view of the protective system of FIG. 19, according to an exemplary embodiment.
Figure 24:
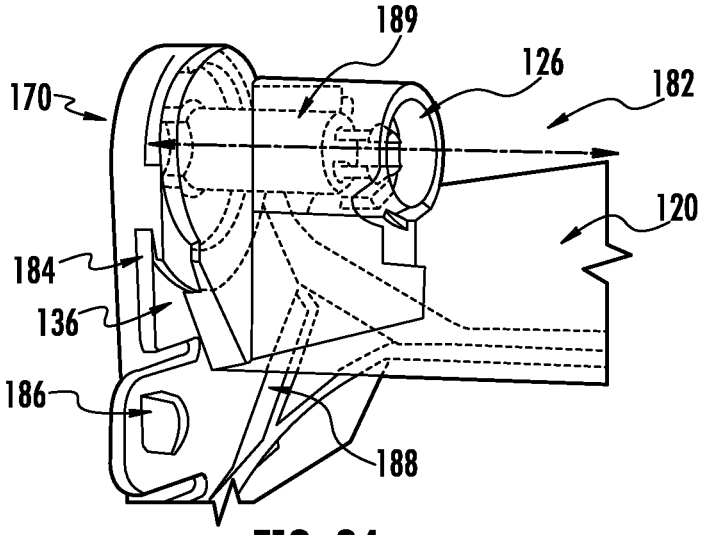
FIG. 24 is a rear view of the cover and a ghost view of the brim guard of the protective system of FIG. 19, according to an exemplary embodiment.
Figure 25:
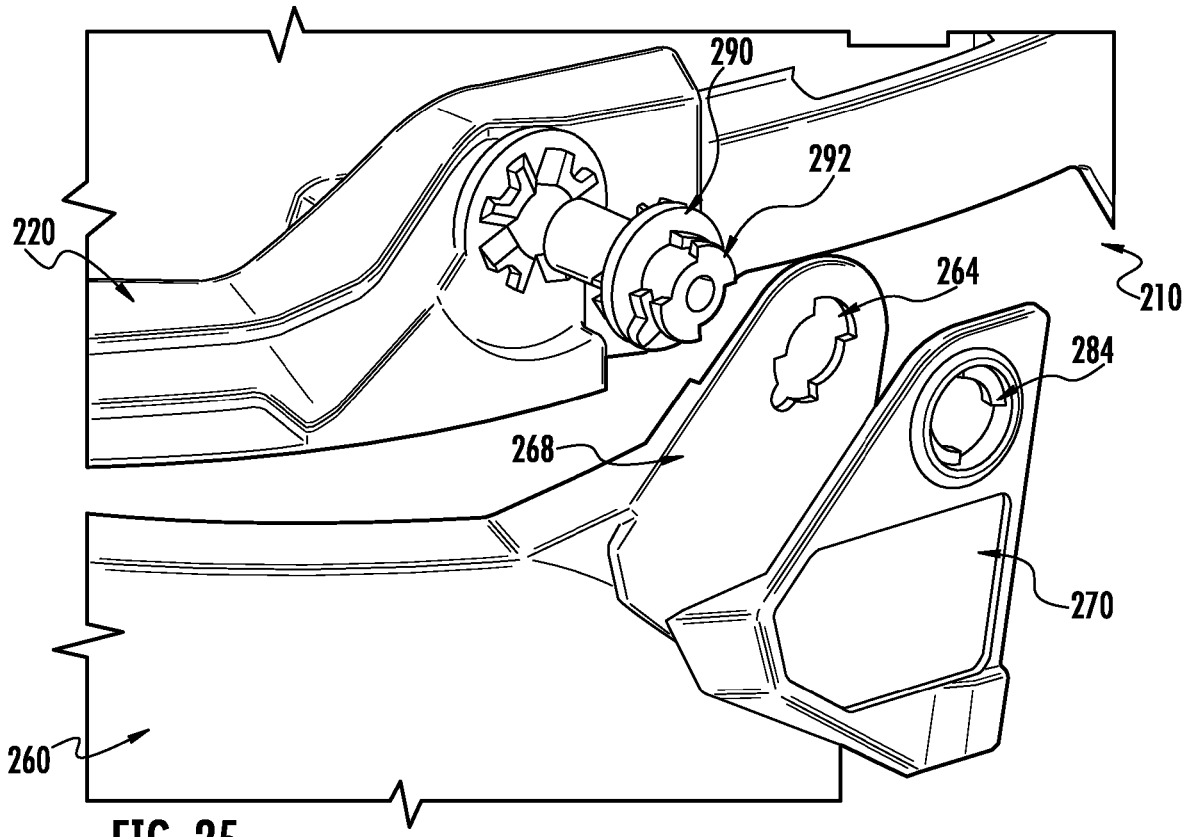
FIG. 25 is a perspective view of a protective system, according to an exemplary embodiment.
Figure 26:
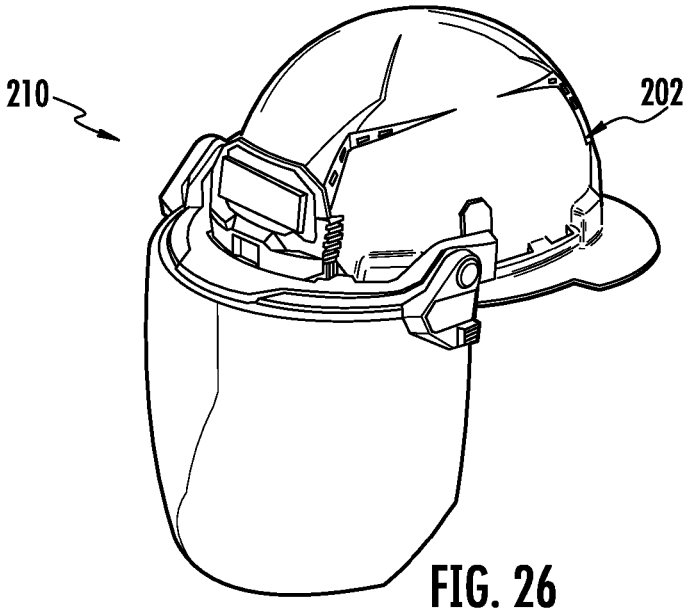
FIG. 26 is a perspective view of the protective system of FIG. 25, according to an exemplary embodiment.

Referring to FIGS. 23-24, an exploded view of various aspects of brim guard 120, cover 170, and face shield 160 is shown. Coupling structure 124 of brim guard 120 includes one or more coupling elements, shown as projections 132. In a specific embodiment, projections 132 are arranged circumferentially around cylinder 126 and interface with cover 170. Projection 189 extends from cover 170 into cylinder 126 to couple cover 170 and brim guard 120.

Referring to FIG. 24, various aspects of cover 170 and brim guard 120 are shown. Projection 189 of cover 170 extends within cylinder 126 of brim guard 120. Cover 170 includes a curved guide 184 that interfaces with curved ledge 136 of brim guard 120. In a specific embodiment, curved guide 184 of cover 170 and curved ledge 136 of brim guard 120 are centered around axis 182. A coupling element, shown as catch 186 of cover 170, engages with projection 166 of face shield 160 to secure face shield 160 to cover 170. Cover 170 includes a rib guide surface 188 facing towards axis 182. Rib guide surface 188 interfaces with face shield 160 when cover 170 is in the secured position to secure the face shield 160.

Referring to FIG. 25-31, protective system 210 is shown according to an exemplary embodiment. Protective system 210 is substantially the same as protective system 110 except for the differences discussed herein. In particular, protective system 210 includes an innovative system for coupling brim guard 220, face shield 260, and cover 270.

Pivot 290 is inserted into brim guard 220. Pivot 290 includes a coupling element, shown as hourglass projection 292. Cover 270 includes a coupling element, shown as hourglass aperture 284, shaped to receive hourglass projection 292. Face shield 260 includes a coupling element, shown as hourglass aperture 264, shaped to receive hourglass projection 292.

Referring to FIGS. 26-30, an exemplary process of removing face shield 260 from brim guard 220 is shown. Starting at FIG. 26, cover 270 secures face shield 260 to brim guard 220. Hourglass projection 292 of pivot 290 restrains face shield 260 and cover 270 to brim guard 220.

Figure 27:
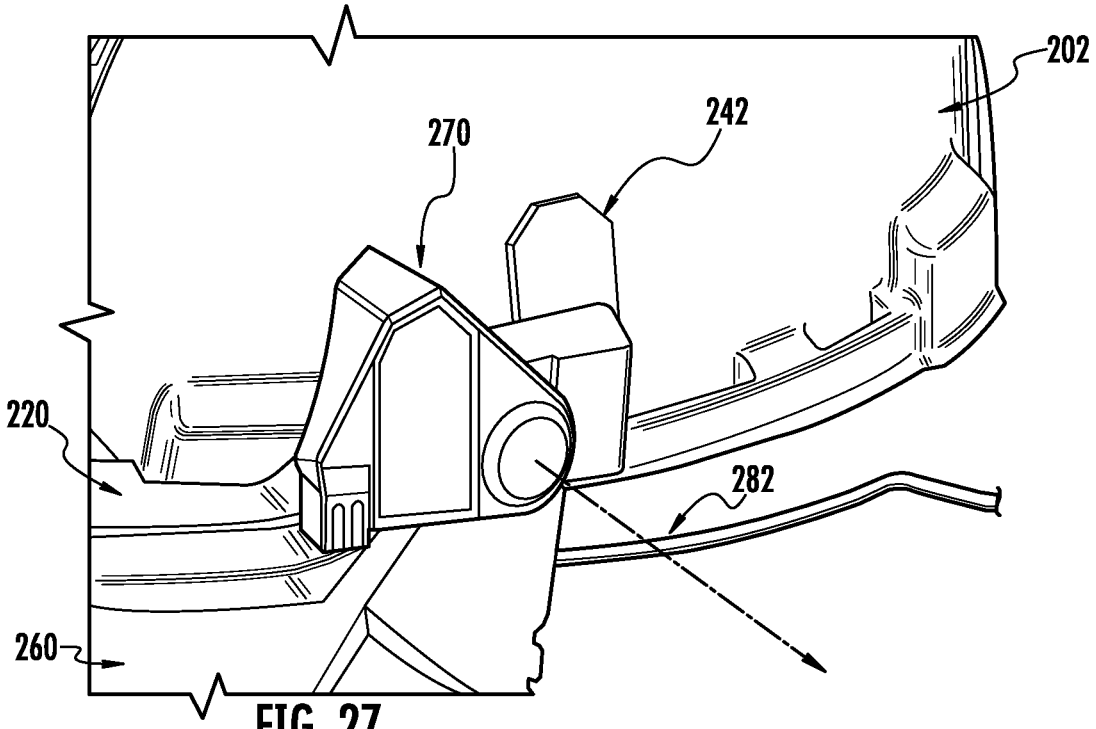
FIG. 27 is a perspective view of the protective system of FIG. 25, according to an exemplary embodiment.
Figure 28:
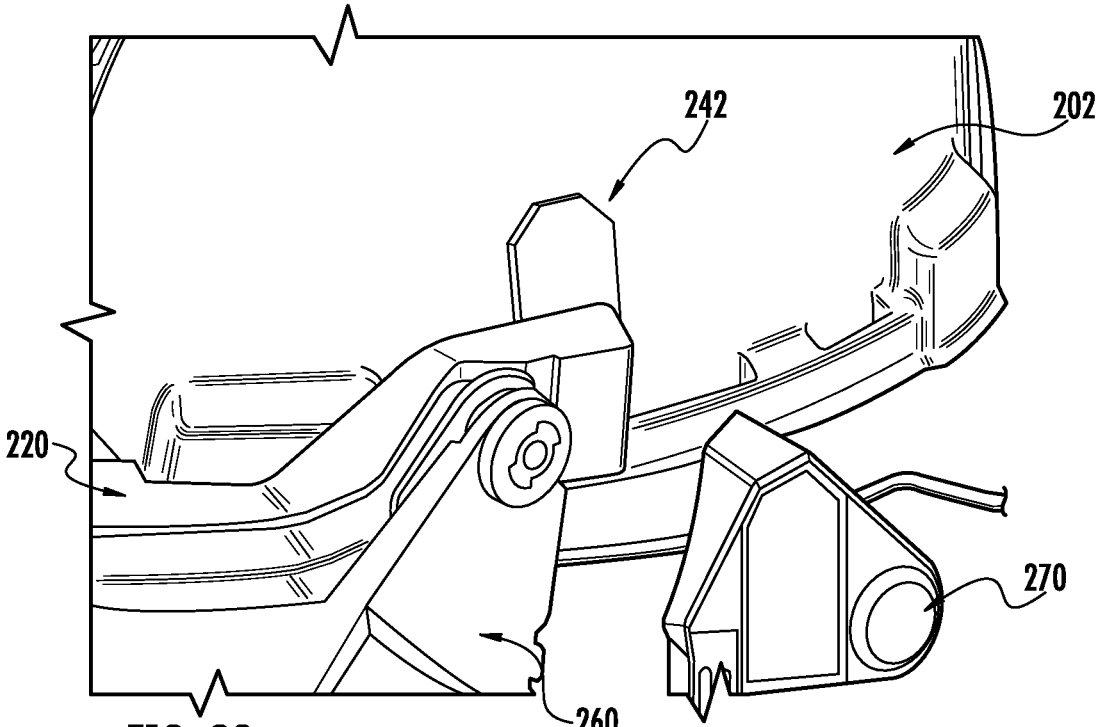
FIG. 28 is a perspective view of the protective system of FIG. 25, according to an exemplary embodiment.

To remove face shield 260, cover 270 is rotated around axis 282 with respect to brim guard 220 (e.g., clockwise from the perspective shown in FIG. 27), until hourglass aperture 284 of cover 270 is aligned with hourglass projection 292 of pivot 290 (FIG. 27). Then, cover 270 is removed from pivot 290 and brim guard 220 (FIG. 28).

Figure 29:
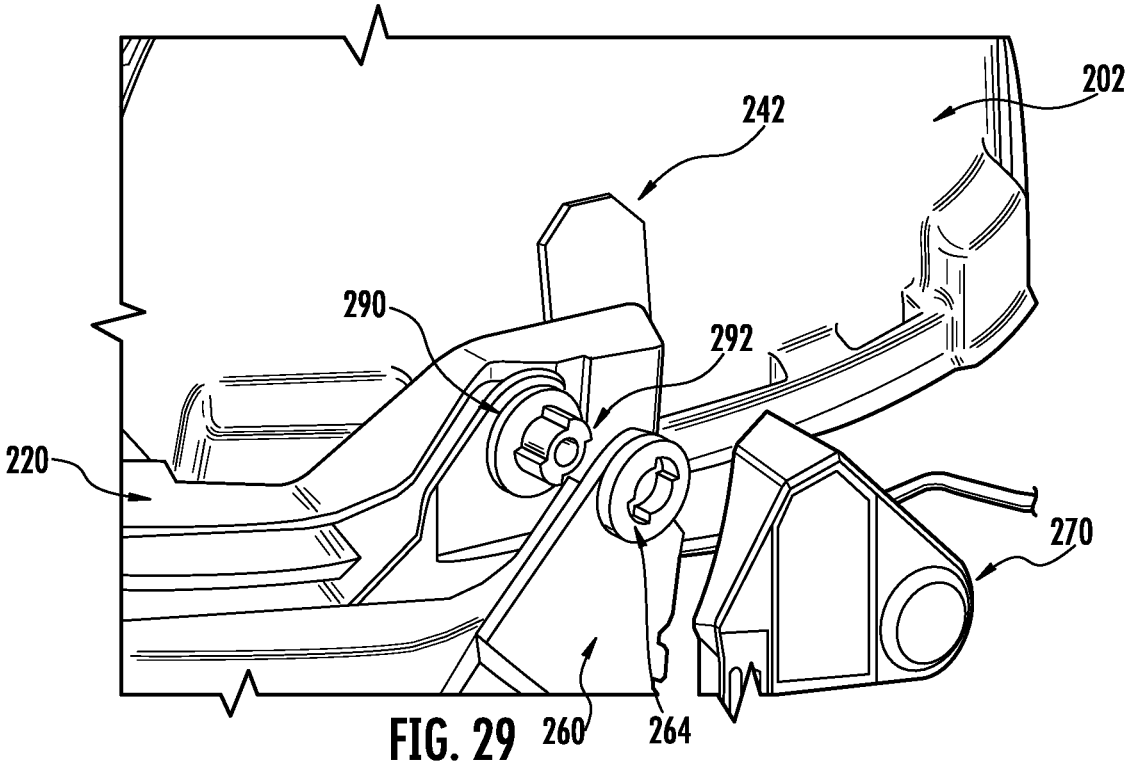
FIG. 29 is a perspective view of the protective system of FIG. 25, according to an exemplary embodiment.
Figure 30:
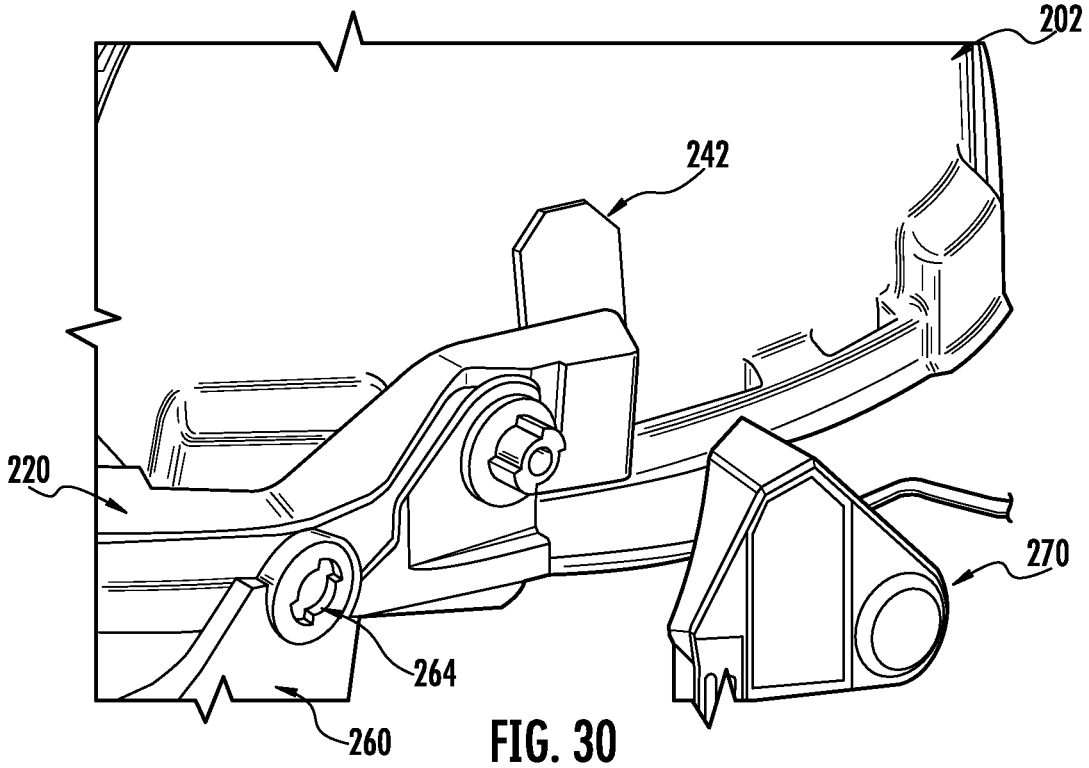
FIG. 30 is a perspective view of the protective system of FIG. 25, according to an exemplary embodiment.

In a specific embodiment, hourglass aperture 264 of face shield 260 is aligned with hourglass projection 292 of pivot 290 when face shield 260 is positioned in front of brim guard 220 (FIG. 29). Thus, face shield 260 can be slideably removed from pivot 290 and brim guard 220 after cover 270 is removed (FIGS. 29-30).

Figure 31:
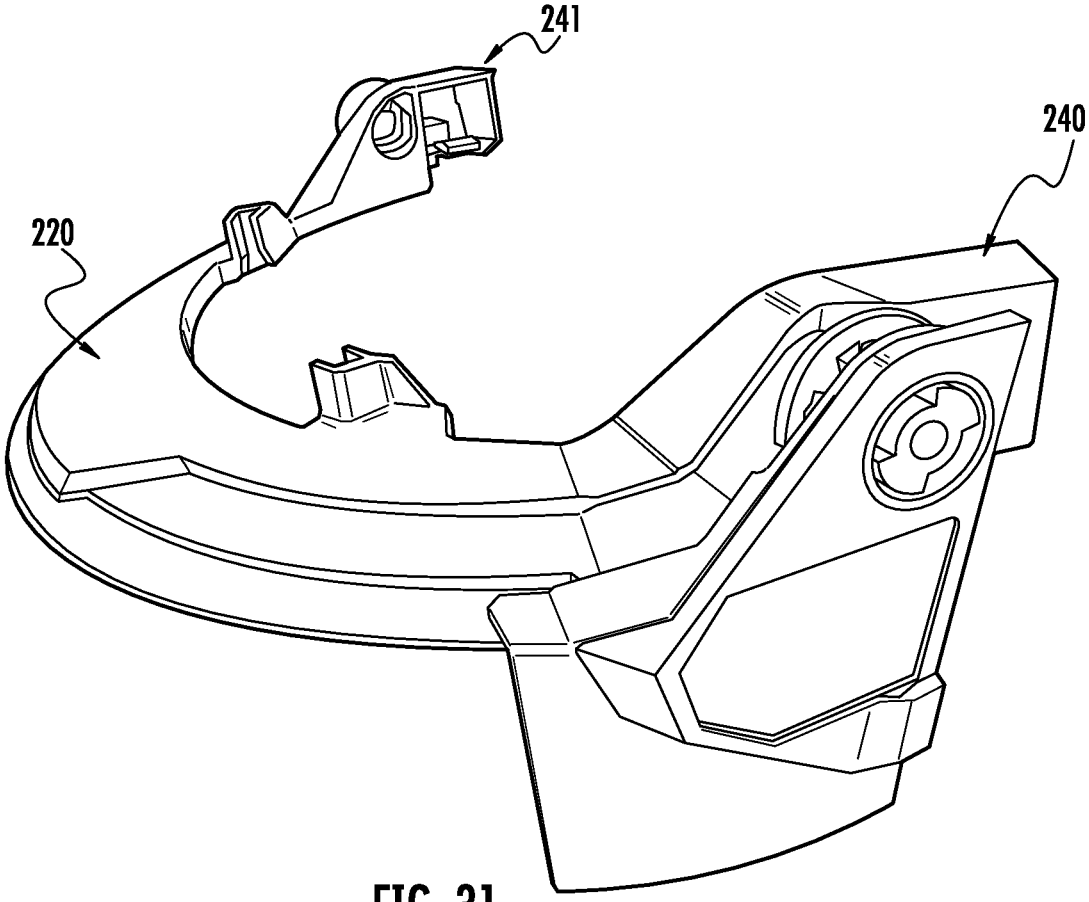
FIG. 31 is a perspective view of a brim guard of the protective system of FIG. 25, according to an exemplary embodiment.

Referring to FIG. 31, brim guard 220 includes a first adaptor housing 240 and a second adaptor housing 241, each extending from brim guard 220. As will be explained, first adaptor housing 240 and second adaptor housing 241 each receive an adaptor configured to couple protective system 210 to various embodiments of safety headwear.

Referring to FIG. 32-36, protective system 310, is shown according to an exemplary embodiment. Protective system 310 is substantially the same as protective system 110 or protective system 210 except for the differences discussed herein. In various embodiments, protective system 310 is incorporated with a hard had system as described herein.

In a specific embodiment, a hard hat system includes a hard hat, such as hard hat 10, a brim guard, such as brim guard 320, and a face shield (e.g., face shield 22) reversibly coupled to the brim guard, and the face shield is positionable in front of a person. In various embodiments, brim guard 320 is configured to couple to a hard hat such that a front 322 of the brim guard 320 is positioned at a front of the hard hat.

Figure 32:
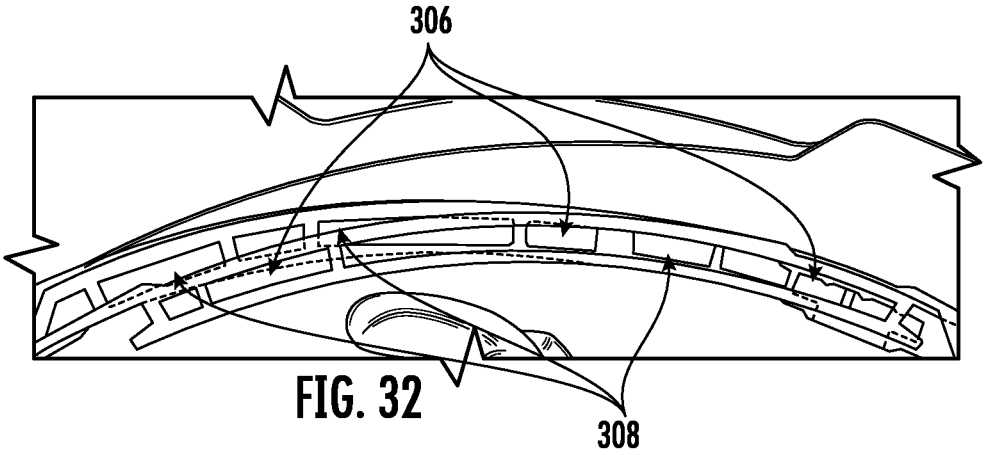
FIG. 32 is two top views overlaid on each other of the slots of a hard hat and a helmet, according to exemplary embodiments.

Referring to FIG. 32, various embodiments of safety headwear include coupling slots at different locations with respect to each other. For example, coupling slots for first hard hat 306 are at different locations than coupling slots for second hard hat 308. A coupling mechanism for brim guards is provided in which an adaptor (e.g., first adaptor 341) is received in an adaptor receiver (e.g., first adaptor housing 340), and the adaptor is positionable in the adaptor receiver in a first orientation and a second orientation. In the first orientation the first adaptor 341 is configured to couple to the first hard hat 306 and the first adaptor 341 is configured to not couple to the second hard hat 308. In the second orientation the first adaptor 341 is configured to not couple to the first hard hat 306 and the first adaptor 341 is configured to couple to the second hard hat 308.

In FIG. 32, coupling slots for an exemplary helmet are at different locations than coupling slots for an exemplary hard hat. As will be explained, adaptors coupled to a brim guard can be rotated to adjust a position of the arm, thereby enabling the protective system 310 to be coupled to safety headwear of varying configurations (e.g., having varying locations of coupling slots).

Figure 33A:
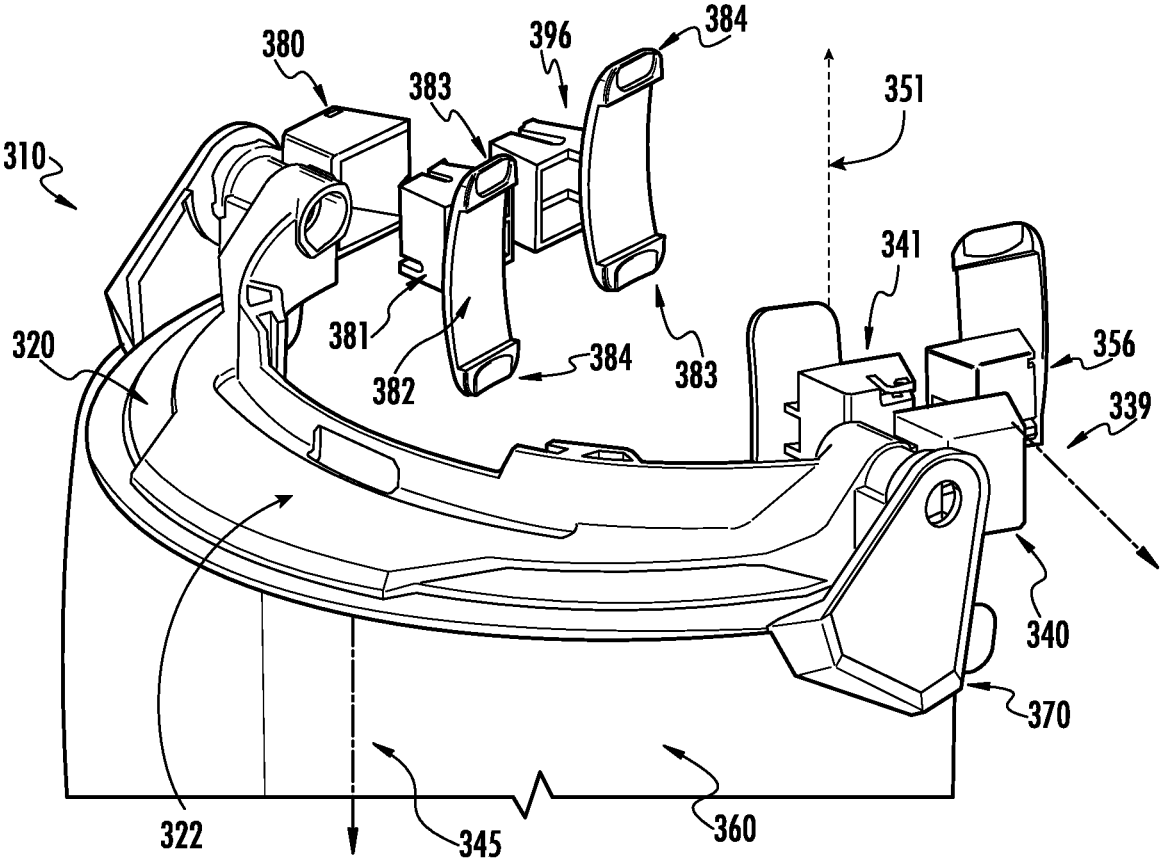
FIG. 33A is a perspective view of a protective system, according to an exemplary embodiment.

A first adaptor receiver, shown as first adaptor housing 340, and a second adaptor receiver, shown as second adaptor housing 380, each of which are coupled to (e.g., extending from brim guard 320) brim guard 320, such as at opposite ends of brim guard 320. First adaptor housing 340 is configured to receive first adaptor 341 in at least two different orientations. Referring to FIG. 33A, first adaptor housing 340 is configured to receive the first adaptor in a first orientation, shown as the orientation of first adaptor 341. First adaptor housing 340 is also configured to receive the first adaptor in a second orientation, shown as the orientation of the ghost image 356 of first adaptor. It will be understood that the ghost image 356 of first adaptor is the same as the primary image of first adaptor 341, except that the ghost image 356 of first adaptor has been rotated 180 degrees about axis 339. Second adaptor housing 380 is similarly configured to receive the second adaptor in a first orientation (e.g., the orientation of second adaptor 381) and a second orientation (e.g., the orientation of the ghost image 396 of second adaptor). First adaptor 341 is positionable in the first adaptor housing 340 in a first orientation in which the first end 343 of the arm 342 extends downward from the first adaptor housing 340 and in a second orientation in which the second end 344 of the arm 342 extends downward from the first adaptor housing 340.

Figure 33B:
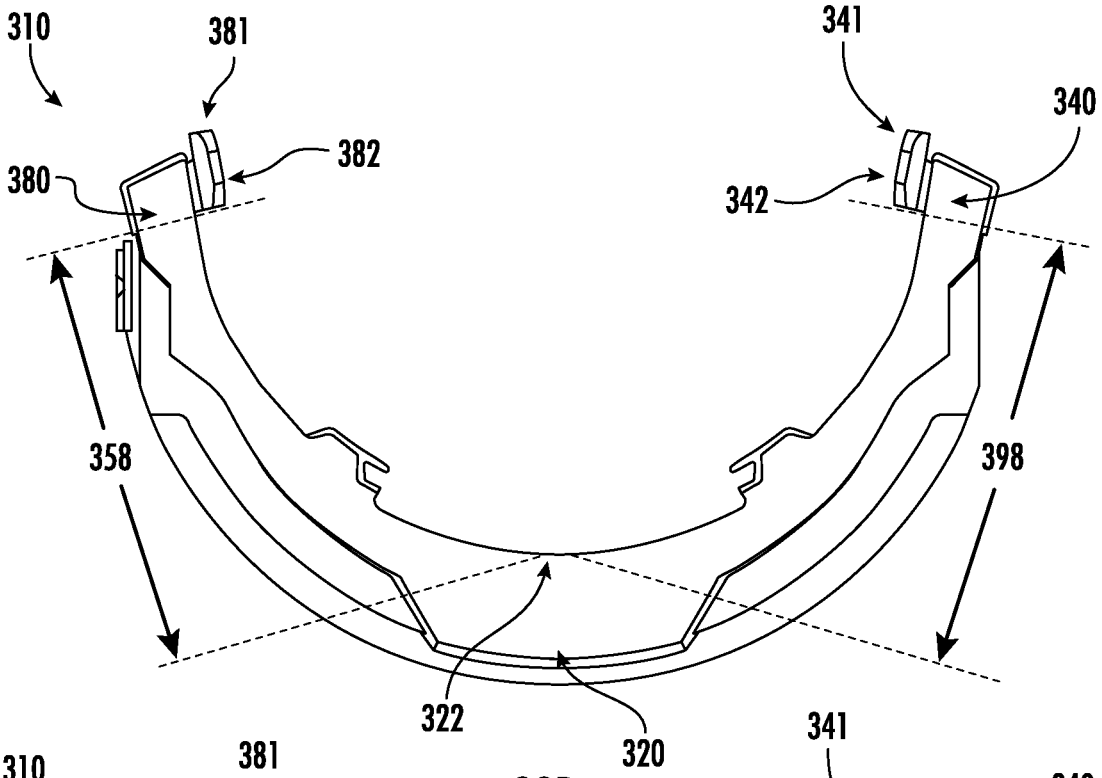
FIG. 33B is a top view of the protective system of FIG. 33A, according to an exemplary embodiment.
Figure 33C:
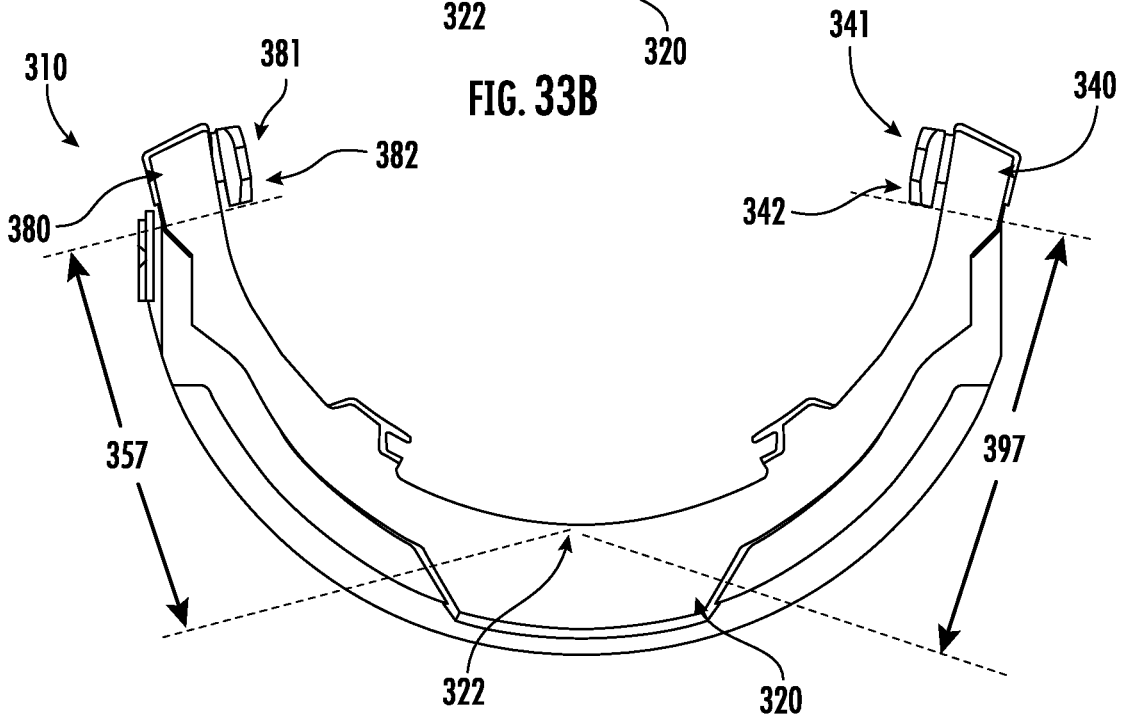
FIG. 33C is a top view of the protective system of FIG. 33A, according to an exemplary embodiment.

Referring to FIGS. 33B and 33C, adjusting the orientation of first adaptor 341 and second adaptor 381 changes a distance from the respective arm of the adaptor to a front of the brim guard 320. In particular, arm 342 of first adaptor 341 is a first distance 357 to a front 322 of brim guard 320 when the first adaptor 341 is in the first orientation (FIG. 33C) and arm 382 of second adaptor 381 is a first distance 397 to a front 322 of brim guard 320 when the second adaptor 381 is the first orientation (FIG. 33C). Referring to FIG. 33B, arm 342 of first adaptor 341 is a second distance 358 to a front 322 of brim guard 320 when the first adaptor 341 is in the second orientation, and arm 382 of second adaptor 381 is a second distance 398 to a front 322 of brim guard 320 when the second adaptor 381 is the second orientation (FIG. 33B). In various embodiments, the second distance 358 is different than the first distance 357, and more specifically second distance 358 is greater than the first distance 357. In various embodiments, first distance 357 is equal to first distance 397 and second distance 358 is equal to second distance 398.

Figure 34:
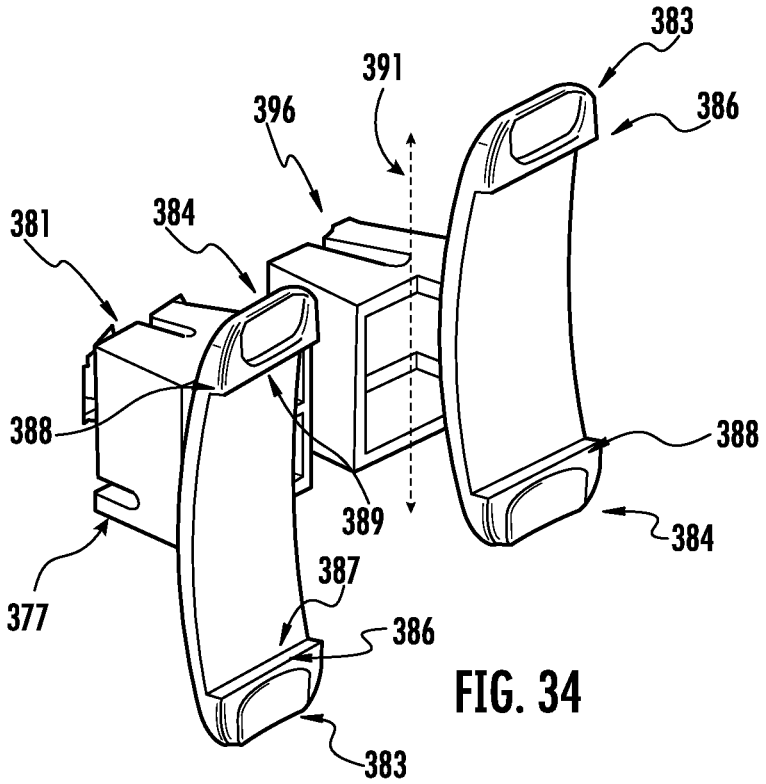
FIG. 34 is a perspective view of the second adaptor of the protective system of FIG. 33 and a silhouette of the second adaptor, according to an exemplary embodiment.

Referring to FIG. 34, various aspects of second adaptor 381 are shown. Depending on the configuration of the safety headwear that second adaptor 381 is being coupled to, second adaptor 381 is positioned in either a first orientation or a second orientation. Second adaptor 381 includes arm 382 that extends along primary longitudinal axis 391 that extends from first end 383 to an opposing second end 384. Second adaptor 381 includes a first ledge 386 near first end 383, and first ledge 386 defines first coupling surface 387. Second adaptor 381 includes a second ledge 388 near second end 384, and second ledge 388 defines second coupling surface 389. In use, the ledge (e.g., first ledge 386 or second ledge 388) that extends downward from the second adaptor housing couples within a slot of the safety headwear that the protective system 310 is being coupled to.

Figure 35:
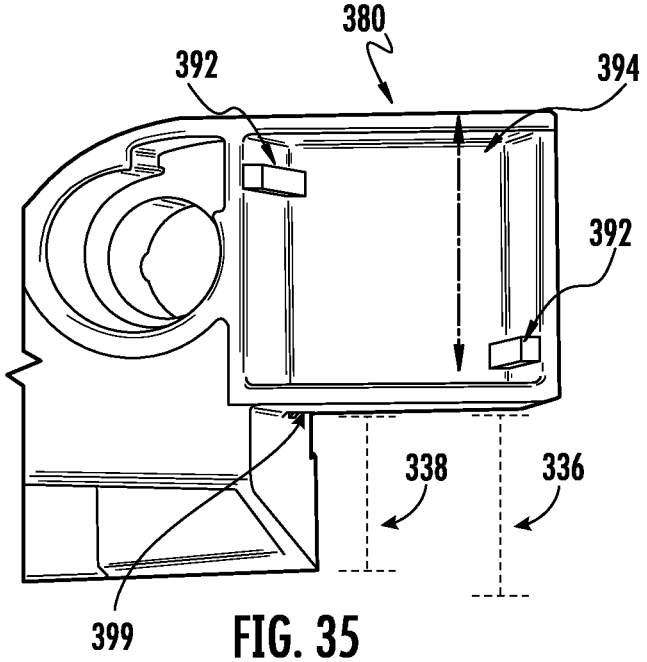
FIG. 35 is a front view of the second adaptor housing of the protective system of FIG. 33, according to an exemplary embodiment.
Figure 36:
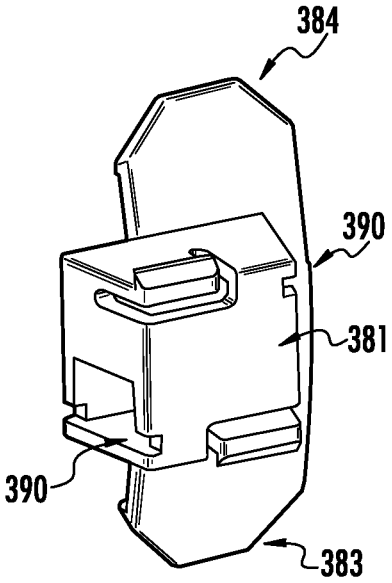
FIG. 36 is a perspective view of the second adaptor of the protective system of FIG. 33, according to an exemplary embodiment.

Referring to FIGS. 35-36, in various embodiments second adaptor housing 380 includes a coupling component that permits second adaptor 381 to be received within second adaptor housing 380 but prevents first adaptor 341 from being fully received within second adaptor housing 380. This helps ensure that the correct adaptor is being inserted into a given adaptor housing. In a specific embodiment, second adaptor housing 380 includes one or more projections, shown as ribs 392 that are aligned at non-centralized locations along the vertical axis 394 of second adaptor housing 380. Second adaptor 381 includes recesses 390 configured to receive ribs 392, thereby permitting second adaptor 381 to be fully received within second adaptor housing 380. As will be seen, first adaptor 341 does not include recesses 390 at the same location as second adaptor 381. Thus, ribs 392 prevent first adaptor 341 from being fully received within second adaptor housing 380.

In various embodiments, second adaptor 381 includes a body 377 that is fully received within the second adaptor housing 380 when the second adaptor 381 (e.g., in the first orientation and/or the second orientation), and the first adaptor housing 340 includes a first coupling component that prevents the body of the second adaptor 381 from being fully received within the first adaptor housing 341.

Referring to FIG. 35, first coupling surface 347 defines a first distance 338 from a bottom 359 of the first adaptor housing 340 when the first adaptor 341 is in the first orientation, and second coupling surface 349 defines a second distance 336 from the bottom 359 of first adaptor housing 340 when the first adaptor 341 is in the second orientation, and the second distance 336 is different than the first distance 338, and more specifically second distance 336 is greater than first distance 338.

It will be recognized that all descriptions of first adaptor 341 and first adaptor housing 340 apply equally to second adaptor 381 and second adaptor housing 380, and vice versa. For example, second adaptor 381 defines a similar first distance and second distance below a bottom of second adaptor housing 380 when second adaptor 381 is positioned in different orientations within second adaptor housing 380.

Figure 37:
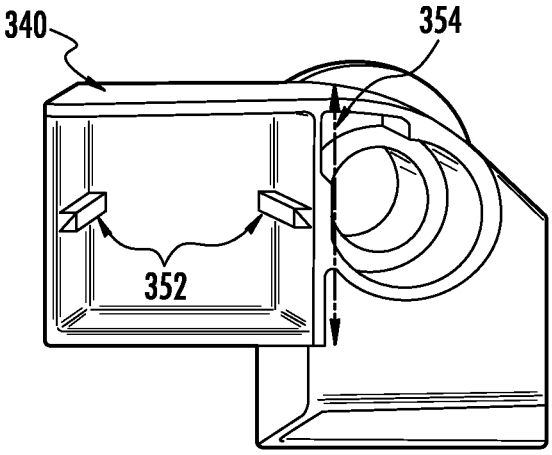
FIG. 37 is a front view of the first adaptor housing of the protective system of FIG. 33, according to an exemplary embodiment.
Figure 38:
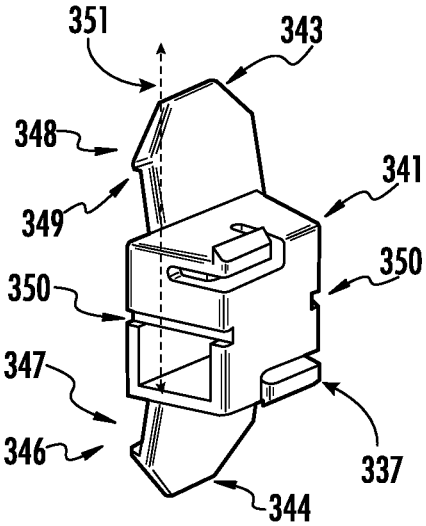
FIG. 38 is a perspective view of the first adaptor of the protective system of FIG. 33, according to an exemplary embodiment.
Figure 39:
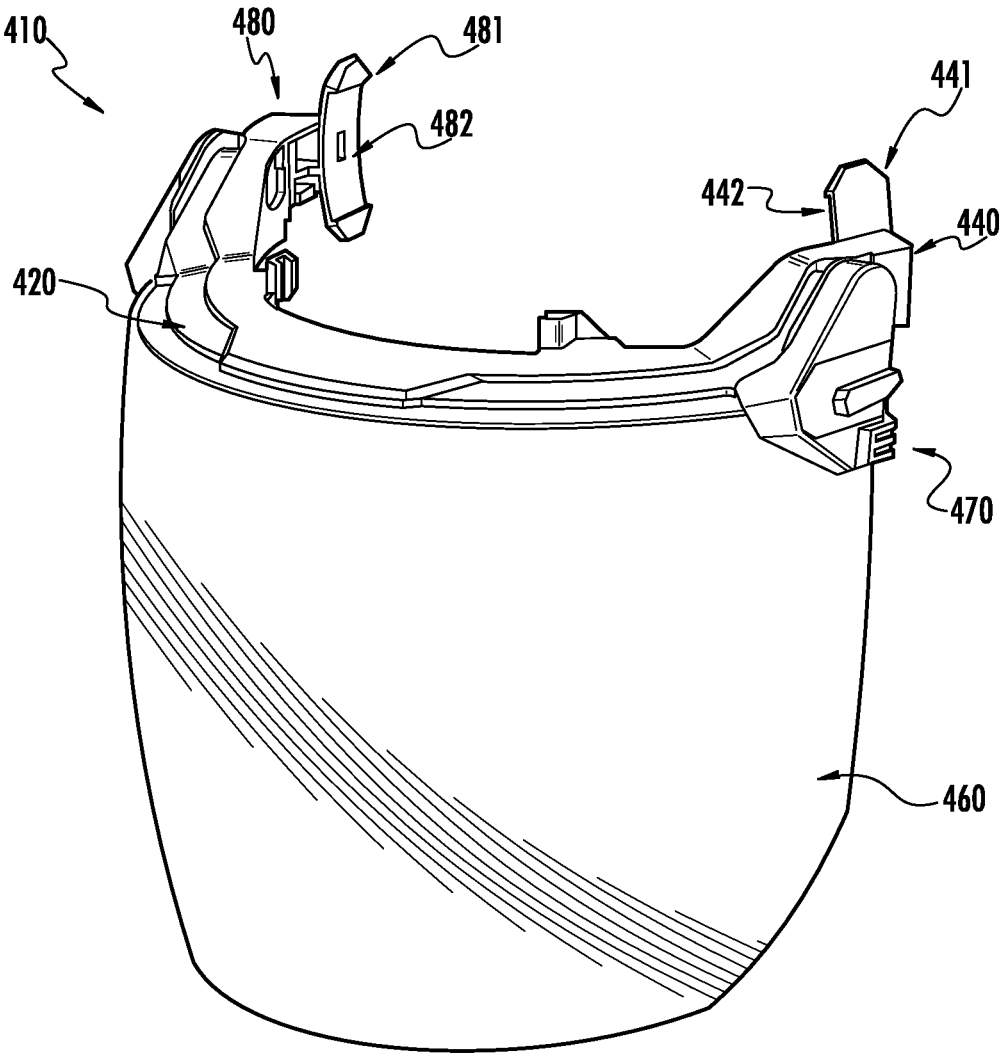
FIG. 39 is a perspective view of a protective system, according to an exemplary embodiment.

Referring to FIGS. 37-38, in various embodiments first adaptor housing 340 includes a coupling component that permits first adaptor 341 to be received within first adaptor housing 340 but prevents second adaptor 381 from being fully received within second adaptor housing 380. In a specific embodiment, first adaptor housing 340 includes one or more projections, shown as ribs 352 that are aligned at different locations than ribs 392 of second adaptor housing 380 (e.g., at centralized locations along the vertical axis 354 of first adaptor housing 340). First adaptor 341 includes recesses 350 configured to receive ribs 352, thereby permitting first adaptor 341 to be fully received within first adaptor housing 340. As can be seen in FIGS. 35-36, second adaptor 381 does not include recesses 390 at the same location as first adaptor 341. Thus, ribs 352 prevent second adaptor 381 from being fully received within first adaptor housing 340.

Referring to FIG. 38, various aspects of first adaptor 341 are shown. First adaptor 341 includes arm 342 that extends along primary longitudinal axis 351 from first end 343 to an opposing second end 344. The first adaptor 341 is positionable in the housing in a first orientation in which the first end 343 extends downward, and a second orientation in which the second end 344 extends downward. As will be explained and shown, arm 342 of first adaptor 341 is closer to a front of the brim guard when the first adaptor 341 is in the first orientation compared to when the adaptor is in the second orientation. In various embodiments, the first adaptor 341 is rotated 180 degrees when the first adaptor 341 is repositioned from the first orientation to the second orientation (e.g., when first adaptor 341 and/or second adaptor 381 transition from the first orientation to the second orientation).

First adaptor 341 includes a first ledge 346 near first end 343, and first ledge 346 defines first coupling surface 347. First adaptor 341 includes a second ledge 348 near second end 344, and second ledge 348 defines second coupling surface 349. First ledge 346 includes a first coupling surface 347 facing upward when the first adaptor 341 is in the first orientation, and second ledge 348 includes a second coupling surface 349 facing upward when the first adaptor 341 is in the second orientation. In use, the ledge (e.g., first ledge 346 or second ledge 348) that is on the portion of the arm extending downward from the first adaptor housing couples to a slot in the safety headwear that the protective system 310 is being coupled to. In particular, the coupling surface of the ledge engages with the safety headwear.

Referring to FIG. 39-44, protective system 410 is shown according to an exemplary embodiment. Protective system 410 is substantially the same as protective system 110, protective system 210, or protective system 310 except for the differences discussed herein.

Cover 470 couples face shield 460 to brim guard 420. Similar to one or more protective systems described herein, first adaptor 440 and second adaptor 480 can be rotated to adjust the positions of their arms (442, 482) with respect to brim guard 420.

Figure 40:
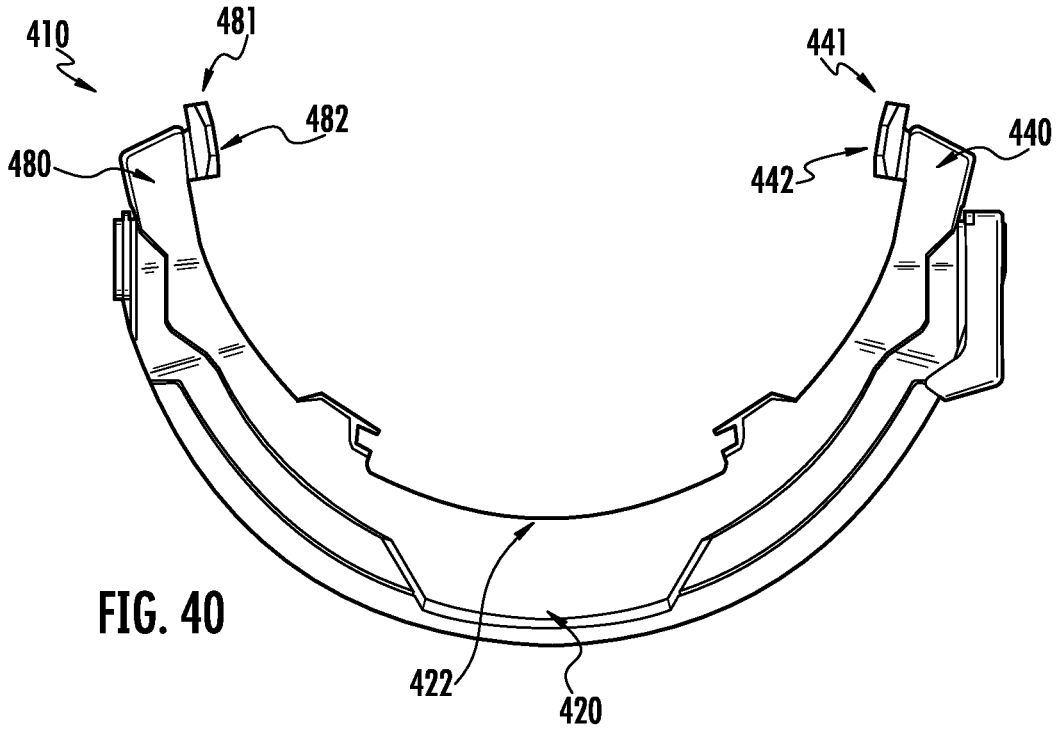
FIG. 40 is a top view of the protective system of FIG. 39, according to an exemplary embodiment.
Figure 41:
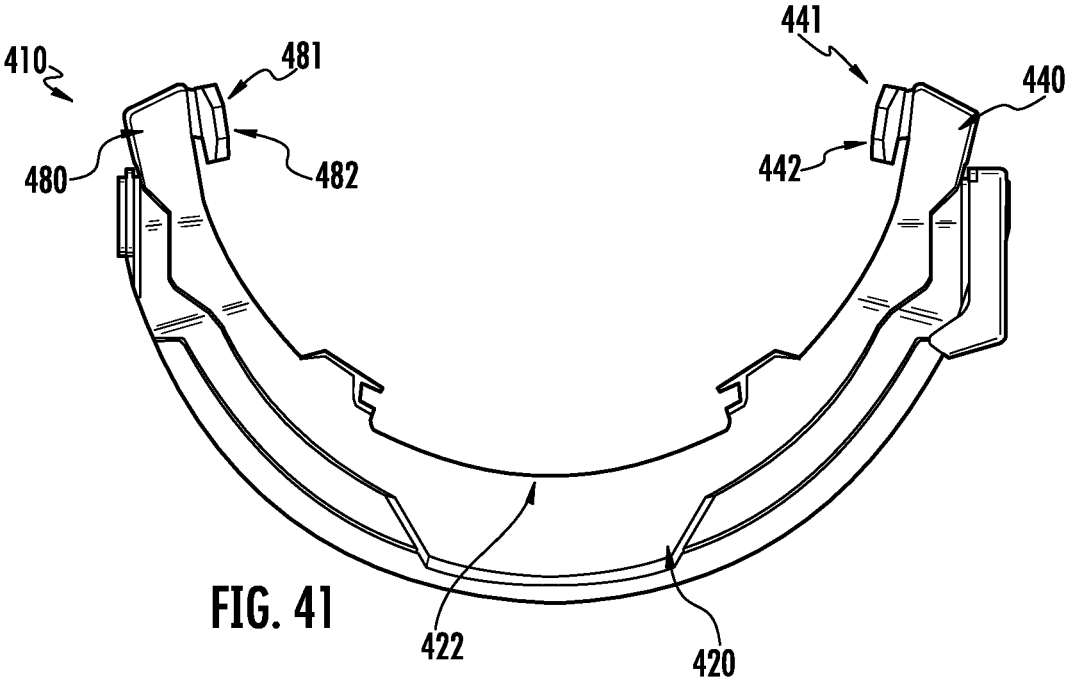
FIG. 41 is a top view of the protective system of FIG. 39, according to an exemplary embodiment.

Referring to FIGS. 40-41, various aspects are shown of how protective system 410 can be coupled to safety headwear of varying configurations. In particular, in FIG. 40 first adaptor 441 and second adaptor 481 are each coupled to brim guard 420 in a first orientation. As can be seen, arm 442 of first adaptor 441 and arm 482 of second adaptor 481 are further from front portion 422 of brim guard 420 compared to a second orientation (FIG. 41).

Referring to FIG. 41, first adaptor 441 and second adaptor 481 have been rotated 180 degrees to the second orientation. As can be seen, in this orientation the arm 442 of first adaptor 441 and arm 482 of second adaptor 481 are closer to front 422 of brim guard 420 compared to FIG. 40.

Figure 42:
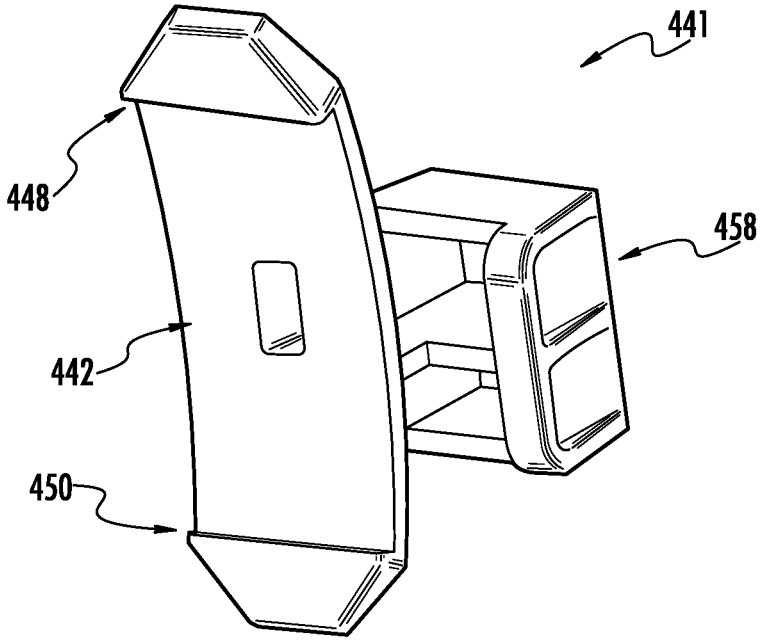
FIG. 42 is a perspective view of the first adaptor of the protective system of FIG. 39, according to an exemplary embodiment.
Figure 43:
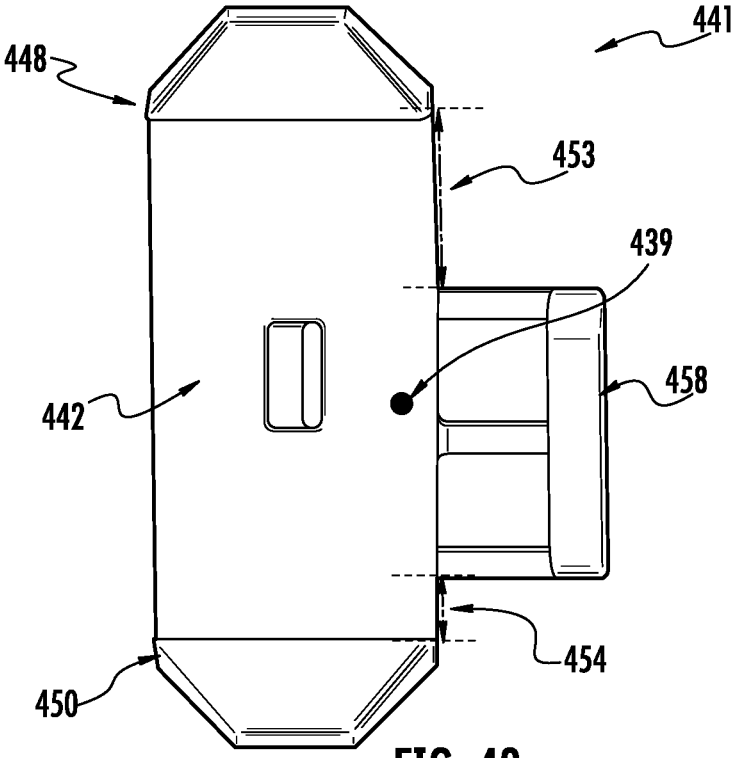
FIG. 43 is a front view of the first adaptor of the protective system of FIG. 39, according to an exemplary embodiment.
Figure 44:
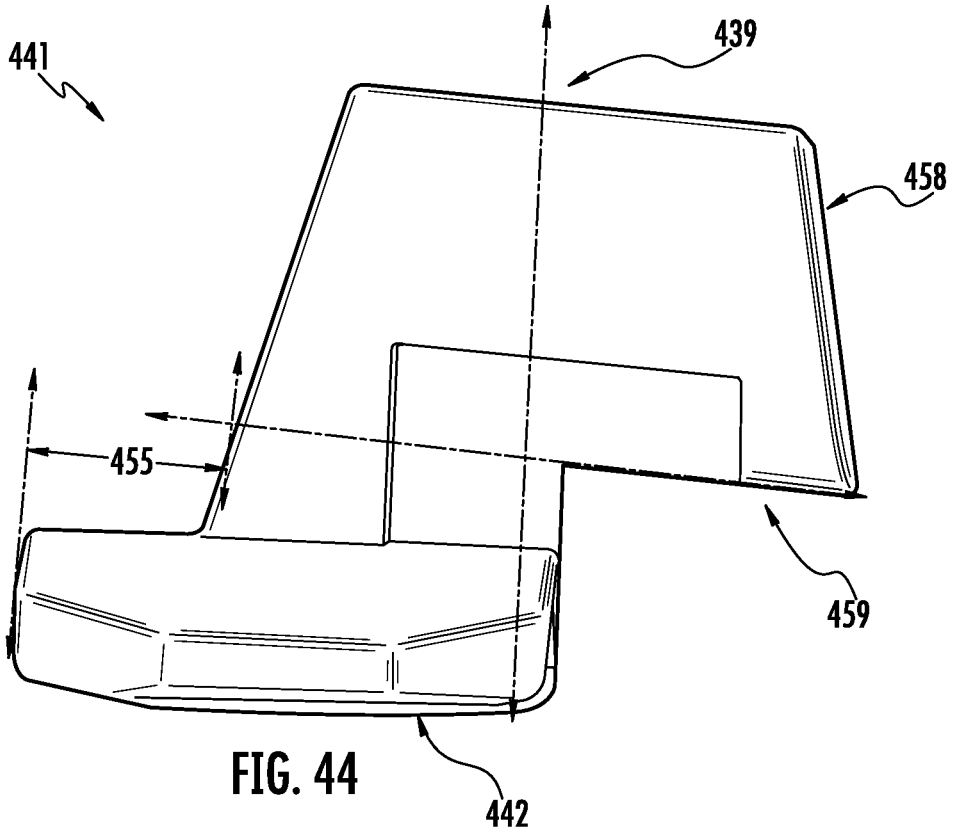
FIG. 44 is a top view of the first adaptor of the protective system of FIG. 39, according to an exemplary embodiment.

Referring to FIGS. 42-44, various aspects of first adaptor 441 are shown. In use, first adaptor 441 is actuated between a first orientation and a second orientation to facilitate coupling to safety headwear of varying configures. In various embodiments, the opposing ends of arm 442 extend differing distances from body 458.

In the first orientation (FIG. 43), second ledge 450 extends distance 454 below body 458 of first adaptor 441. When first adaptor 441 is rotated 180 degrees about axis 439 to the second orientation, first ledge 448 extends below body 458 by distance 453. These varying depths of the ledges extending downward from adaptor permit protective system 410 to be coupled to safety headwear of varying configurations (e.g., having receiving slots that are varying depths beneath the brim guard).

Referring to FIG. 44, a top view of first adaptor 441 is shown in which arm 442 of first adaptor 441 is laterally displaced from body 458 of first adaptor 441. In particular, in a first orientation the arm 442 of first adaptor 441 is laterally displaced distance 455 from body 458 of first adaptor 441. When first adaptor 441 is rotated 180 degrees about axis 439 to the second orientation, arm 442 is displaced in the opposite direction (compare FIGS. 41 and 42).

Figure 45:
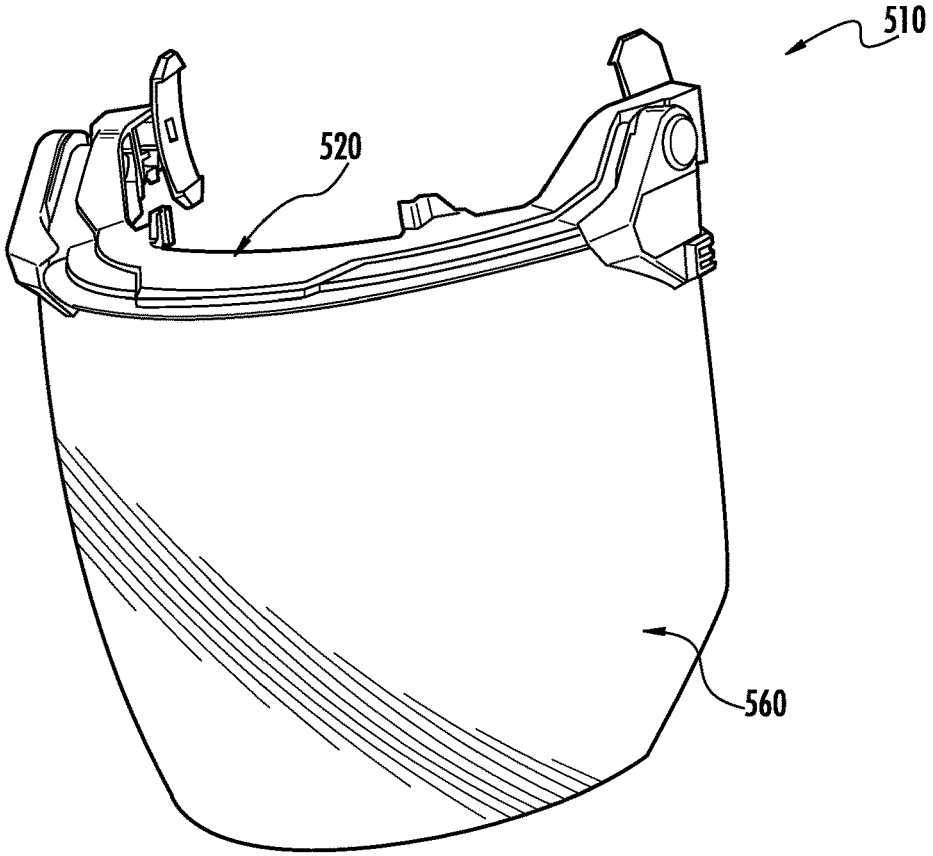
FIG. 45 is a perspective view of a protective system, according to an exemplary embodiment.
Figure 46:
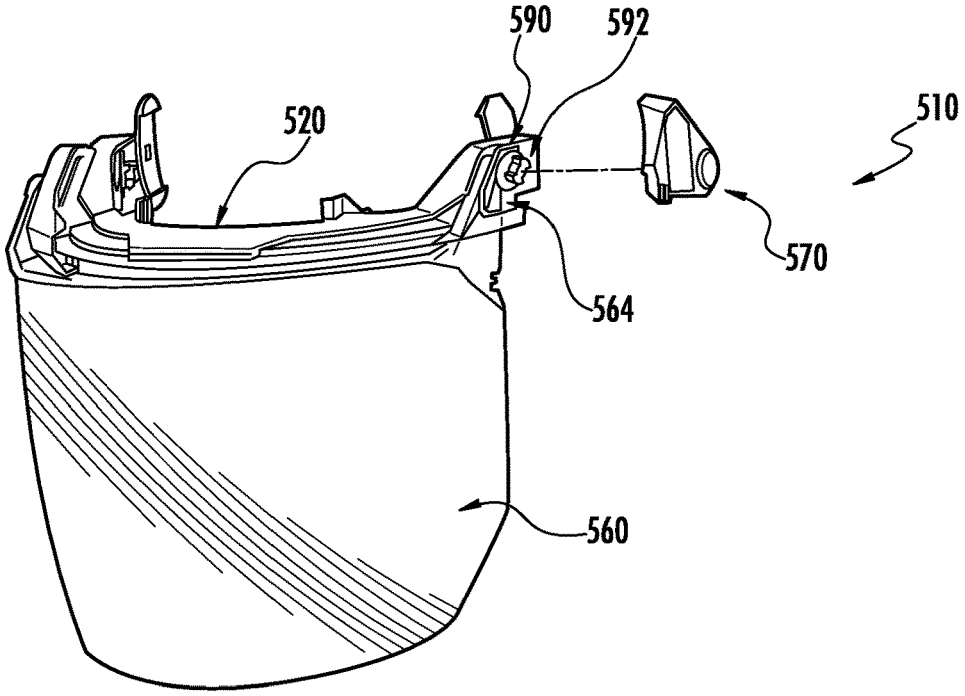
FIG. 46 is a perspective view of the protective system of FIG. 45, according to an exemplary embodiment.
Figure 47:
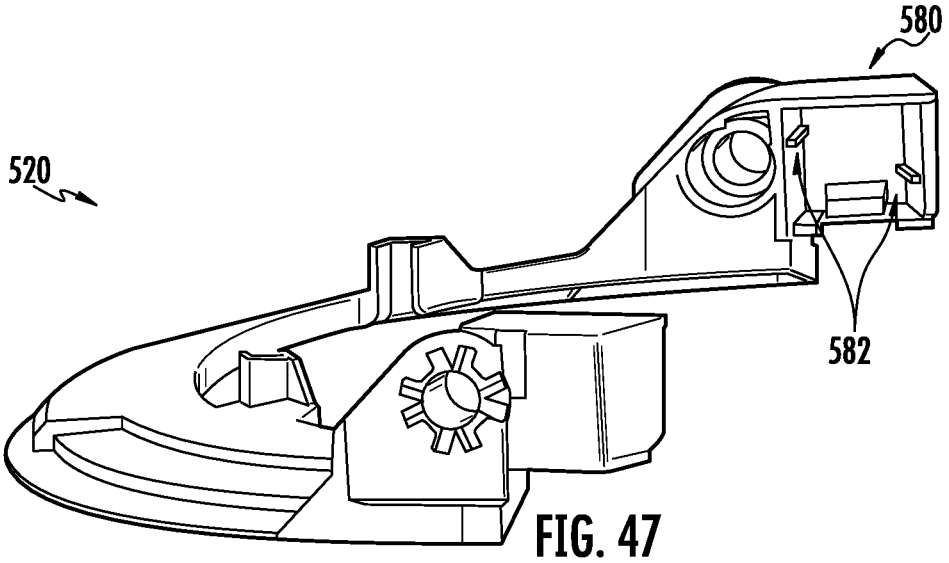
FIG. 47 is a side view of the brim guard of the protective system of FIG. 45, according to an exemplary embodiment.

Referring to FIG. 45-47, protective system 510 is shown according to an exemplary embodiment. Protective system 510 is substantially the same as protective system 110, protective system 210, protective system 310, or protective system 410 except for the differences discussed herein.

Cover 570 couples face shield 560 to pivot 590 and brim guard 520. Pivot 590 includes a projection, shown as hourglass projection 592. Second adaptor housing 580 includes one or more projections, shown as ribs 582, to prevent the incorrect adaptor (e.g., first adaptor 540) from being inserted into second adaptor housing 580.

Figure 48:
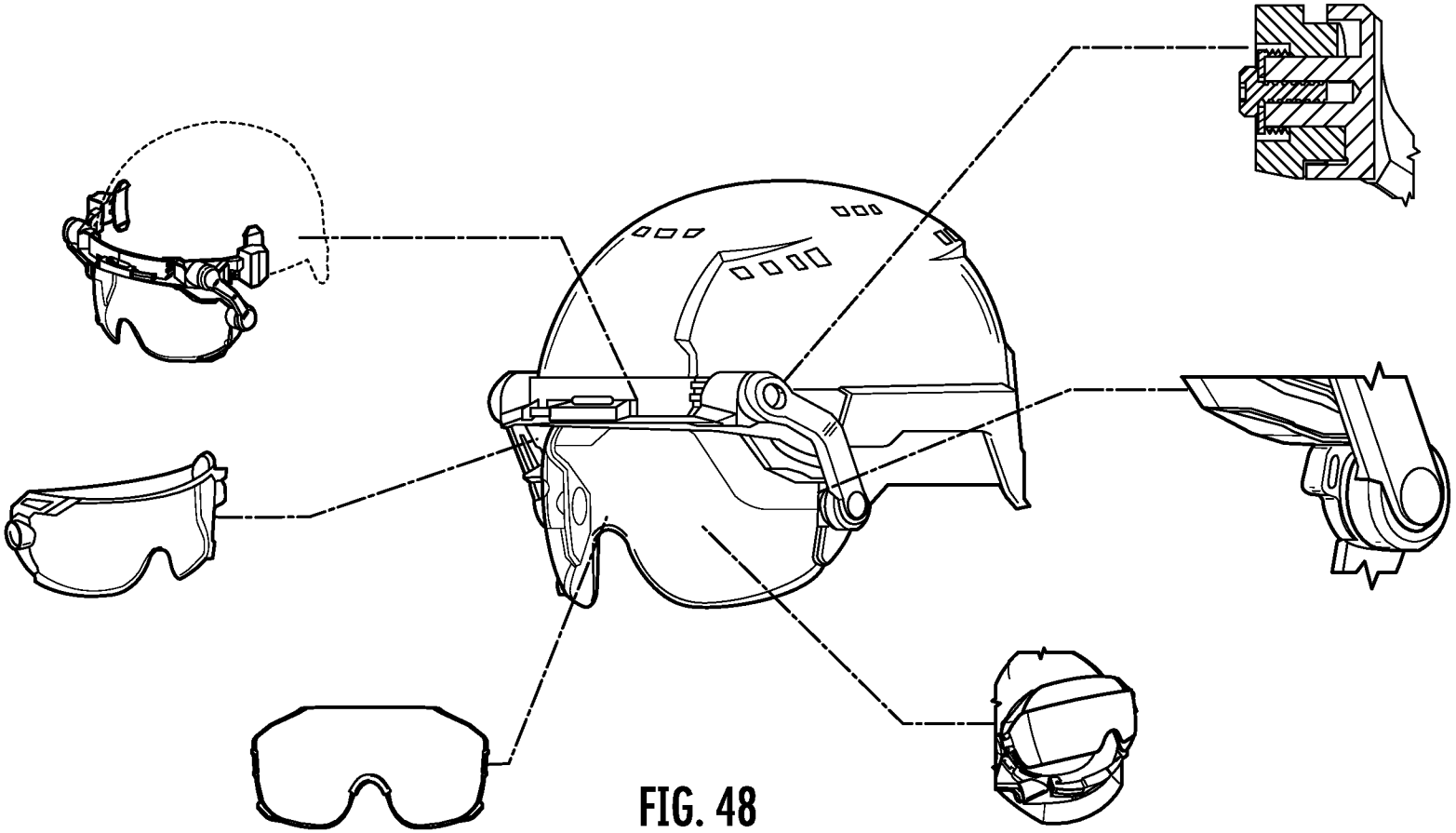
FIG. 48 is an perspective view of a protective system for safety headwear, according to an exemplary embodiment.
Figure 49:
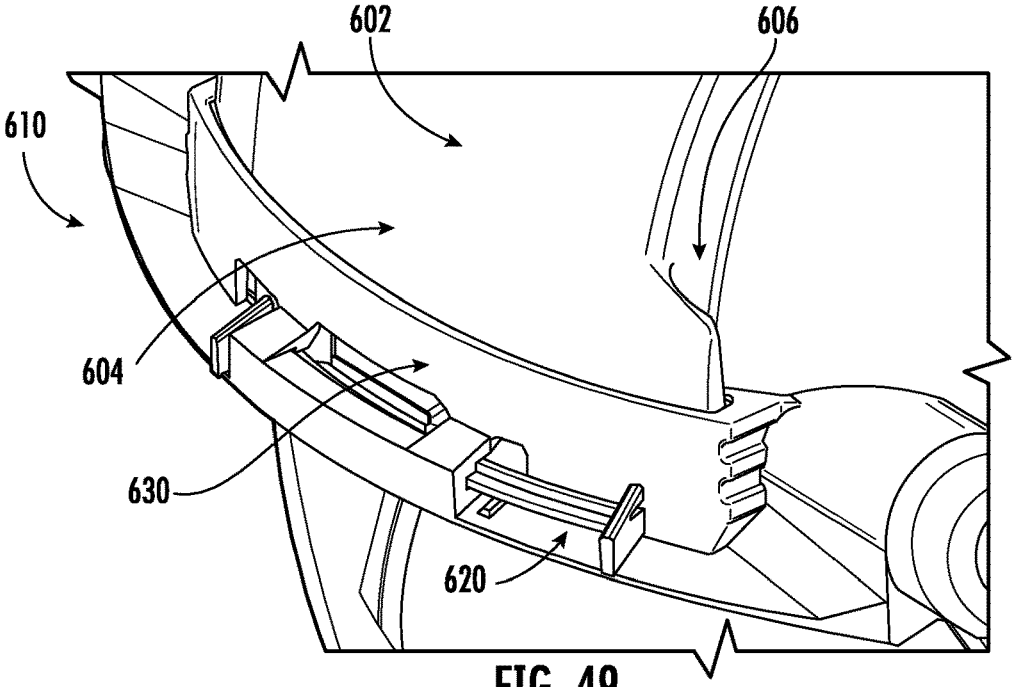
FIG. 49 is a perspective view of a protective system for safety headwear, according to an exemplary embodiment.
Figure 50:
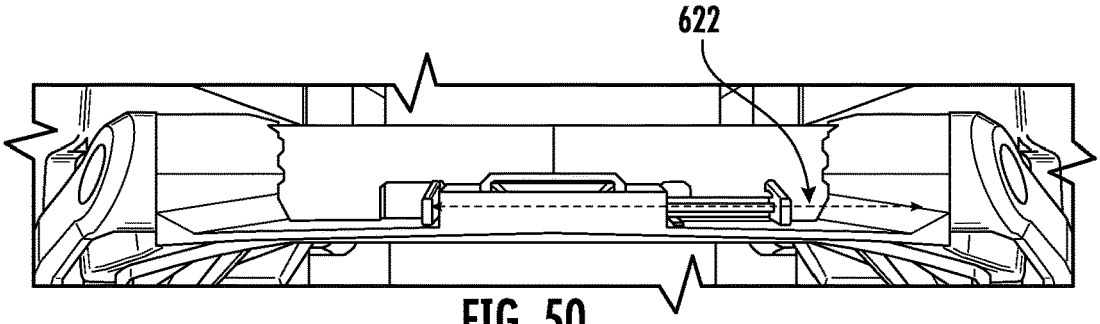
FIG. 50 is a front view of the protective system of FIG. 49, according to an exemplary embodiment.

Referring to FIG. 48, various aspects of a protective system for safety headwear are shown. The protective system includes a locking slide on the brim guard that secures the protective system to the headwear. The protective system includes a sealing mechanism, shown as a gasket, at the top of the face shield. The protective system includes a soft material on the nose-shaped recess in the face shield to provide a more comfortable fit for the wearer. The protective system includes a pivoting mechanism between the arm coupling to the brim guard (upper right). Various embodiments of the protective system include mechanisms to secure the lens, such as a C-clip from the front, a C-clip with a back side eject button, a C-clip retention in the lens, a lens back side lock, a lens front cam lock, and/or a screw boss between the frame and the lens. The protective system includes a lens face shield, such as a smoke lens.

Figure 51:
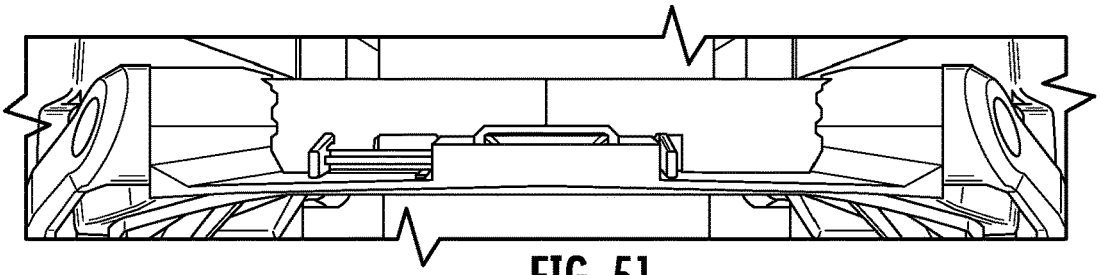
FIG. 51 is a front view of the protective system of FIG. 49, according to an exemplary embodiment.
Figure 52:
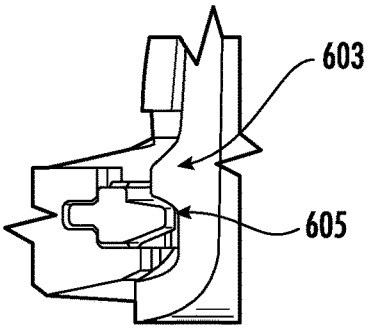
FIG. 52 is a cross-section view of the protective system of FIG. 49, according to an exemplary embodiment.

Referring to FIGS. 49-52, various aspects of a protective system for safety headwear are shown. The protective system includes a slide that locks the brim guard to the safety headwear. The slide actuates between a locked position (FIG. 50) and an unlocked position (FIG. 51). The slide interfaces with a protrusion extending from the safety headwear (FIG. 52).

In various embodiments, a hard hat system includes a hard hat, brim guard 610, a face shield, and a locking mechanism. Brim guard 610 is functionally similar to brim guard 60 except as described herein.

Locking mechanism 620 is coupled to brim guard 610, such as slideably coupled. Locking mechanism 620 is configured to actuate between a locked position (FIGS. 49-50) and an unlocked position (FIG. 51). Locking mechanism prevents the brim guard 610 from sliding vertically with respect to the hard hat when the locking mechanism 620 is in the locked position. Locking mechanism 620 slides along horizontal axis 622 when transitioning from the locked position to the unlocked position.

In a specific embodiment, hard hat 602 includes a protrusion 603 at front 604 of hard hat 602. The locking mechanism 620 interfaces with lower surface 605 of protrusion 603 when locking mechanism 620 is in the locked position. In a specific embodiment, locking mechanism 620 interfaces protrusion 603 extending from mounting element 606 of hard hat 602.

Figure 53:
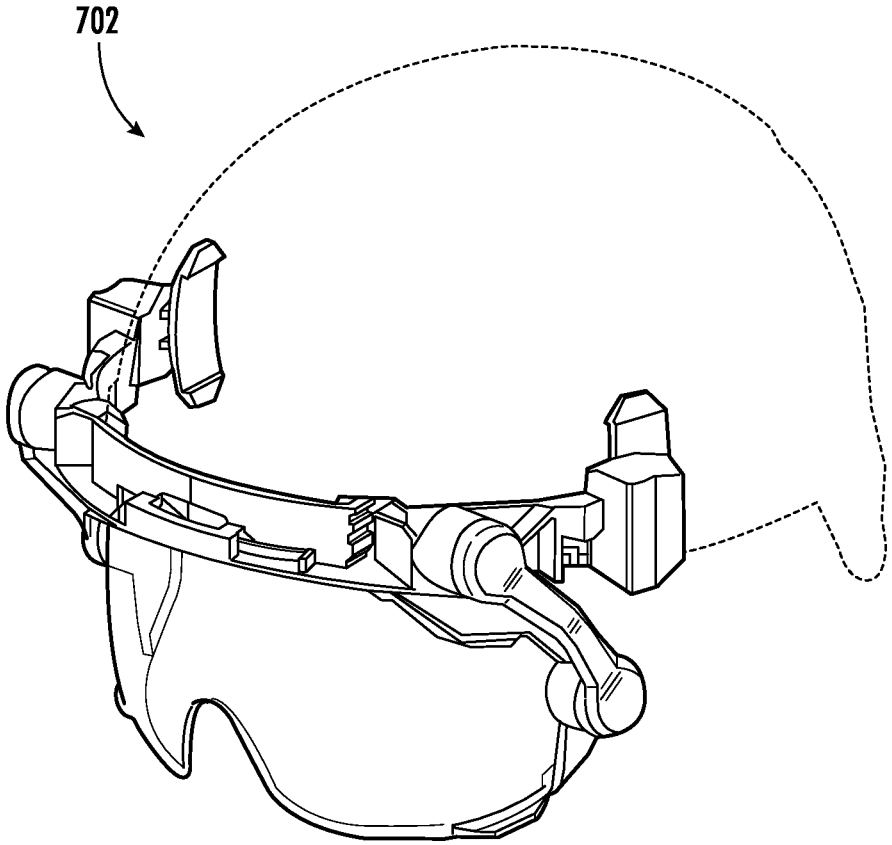
FIG. 53 is a perspective view of a protective system for safety headwear, according to an exemplary embodiment.

Referring to FIGS. 53-151, it is contemplated herein that one or more aspects of the protective systems in FIGS. 53-151 may be incorporated into the protective systems and hard hat systems described in FIGS. 1-52.

Referring to FIG. 53, various aspects of a protective system 702 for safety headwear are shown. The protective system 702 includes clips that engage with slots in the safety headwear. In various embodiments, the protective system 702 clips into front and side slots for a more secure connection to the hard hat compared to other coupling arrangements that include fewer coupling locations between the protective system and the hard hat. The face shield is pivotally coupled to the hard hat view the other elements of the protective system.

Figure 56:
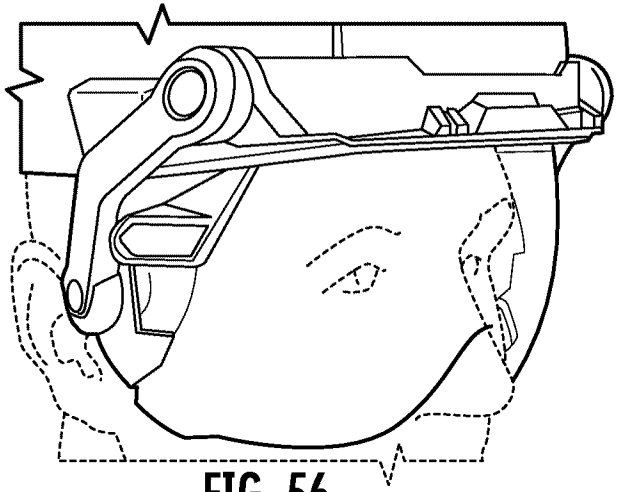
FIG. 56 is a perspective view of a protective system for safety headwear, according to an exemplary embodiment.
Figure 55:
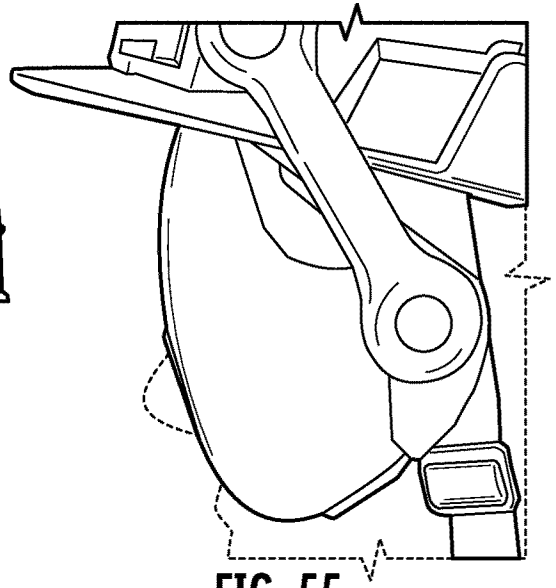
FIG. 55 is a side view of a protective system for safety headwear, according to an exemplary embodiment.
Figure 54:
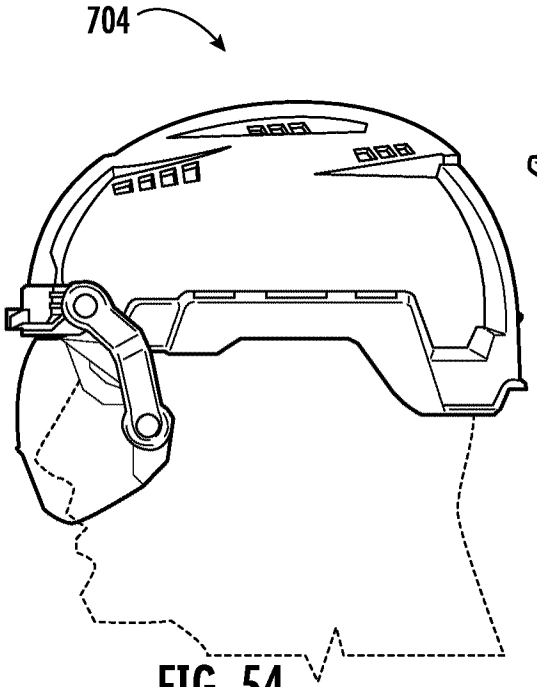
FIG. 54 is a side view of a protective system for safety headwear, according to an exemplary embodiment.
Figure 57:
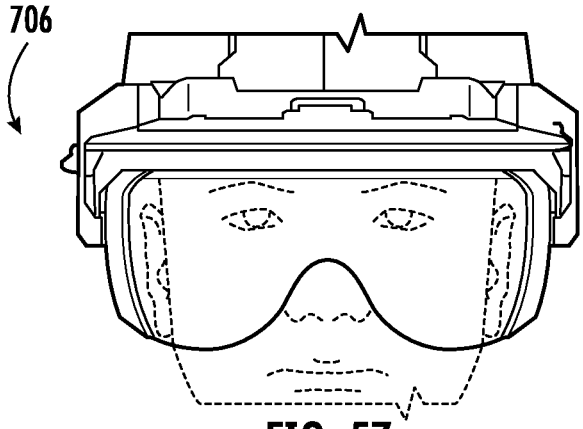
FIG. 57 is a front view of a protective system for safety headwear, according to an exemplary embodiment.
Figure 58:
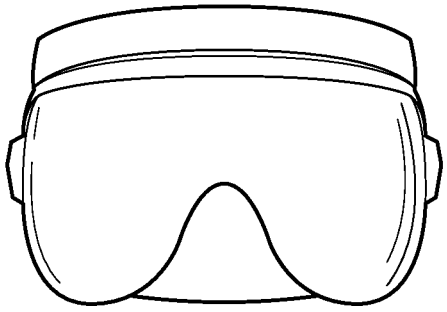
FIG. 58 is a front view of a protective system for safety headwear, according to an exemplary embodiment.
Figure 59:
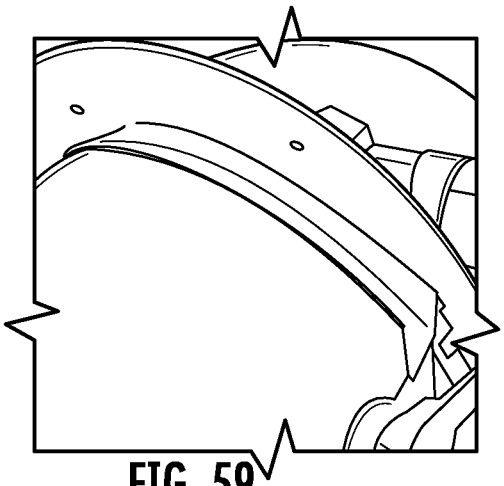
FIG. 59 is a perspective view of a protective system for safety headwear, according to an exemplary embodiment.
Figure 60:
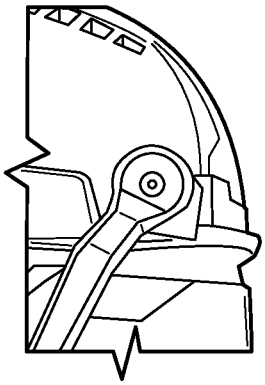
FIG. 60 is a side view of a protective system for safety headwear, according to an exemplary embodiment.
Figure 61:
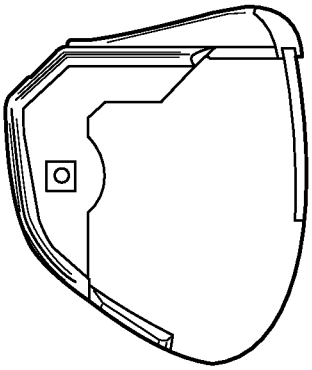
FIG. 61 is a side view of a portion of a protective system for safety headwear, according to an exemplary embodiment.
Figure 62:
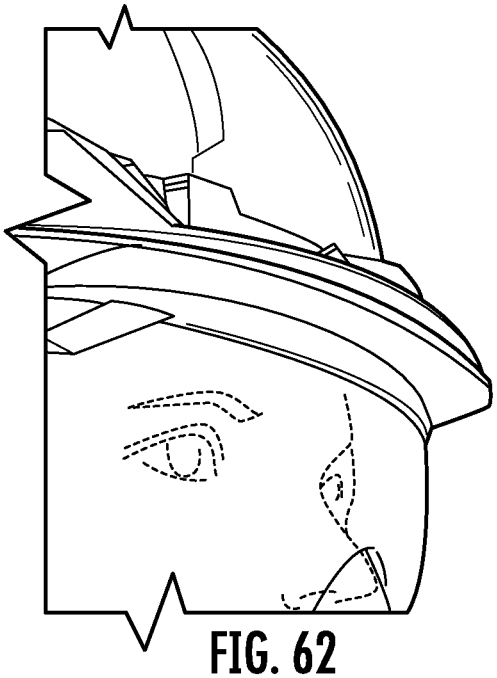
FIG. 62 is a perspective view of a protective system for safety headwear, according to an exemplary embodiment.
Figure 63:
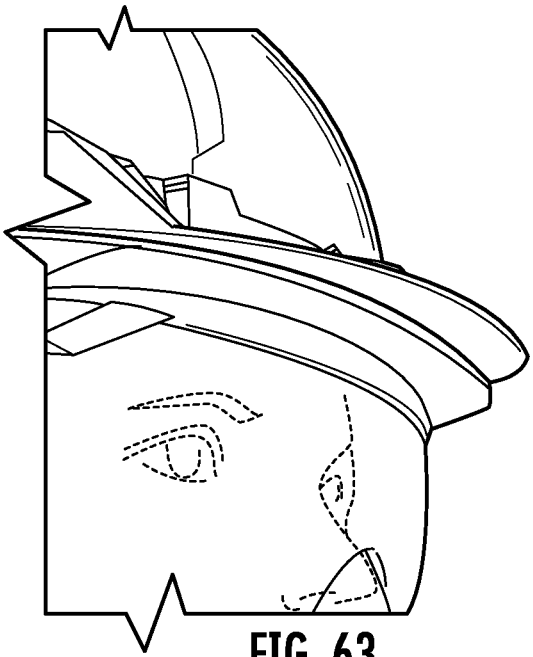
FIG. 63 is a perspective view of a protective system for safety headwear, according to an exemplary embodiment.

Referring to FIGS. 54-56, various aspects of a protective system 704 for safety headwear are shown. In various embodiments the protective system 704 does not include a gasket, so that the lens (e.g., of the face shield) stays between the shell and the suspension.

Referring to FIGS. 57-63, various aspects of a protective system 706 for safety headwear are shown. The protective system 706 includes a gasket between the lens and the safety headwear, such as a hardhat. A benefit of this approach is that there is more forehead coverage and protection compared to other designs. In a specific embodiment, the gasket is formed from a relatively soft and flexible material. In various embodiments, the gasket is coupled to the lens via a mechanism attachment method, an adhesive, and/or a two shot molded method. In various embodiments, there is a seal between the hard hat and the lens (e.g., above the ends of the fingers in FIG. 59).

Figure 64:
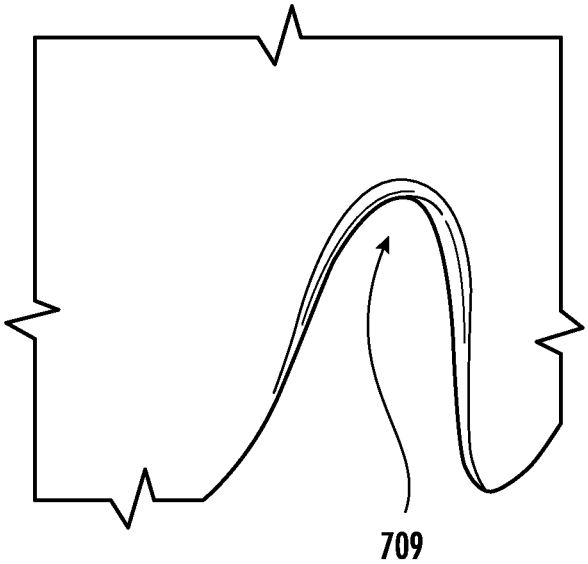
FIG. 64 is a perspective view of a portion of a protective system for safety headwear, according to an exemplary embodiment.
Figure 65:
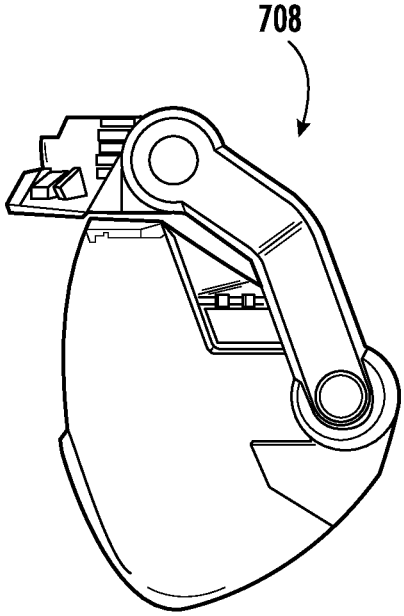
FIG. 65 is a side view of a portion of a protective system for safety headwear, according to an exemplary embodiment.

Referring to FIGS. 64-65, various aspects of a protective system 708 for safety headwear are shown. The protective system 708 includes a nose area geometry 709 tailored to be comfortable even if an additional piece or material (e.g., cushion) is used. In particular, the peripheral edge of the face shield that surrounds the nose of the wearer is slightly wider than the remainder of the face mask. In various embodiments the nose area geometry does not distort the vision of the wearer.

Figure 66:
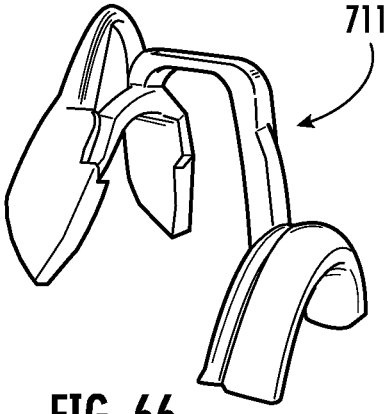
FIG. 66 is a perspective view of a portion of a protective system for safety headwear, according to an exemplary embodiment.
Figure 67:
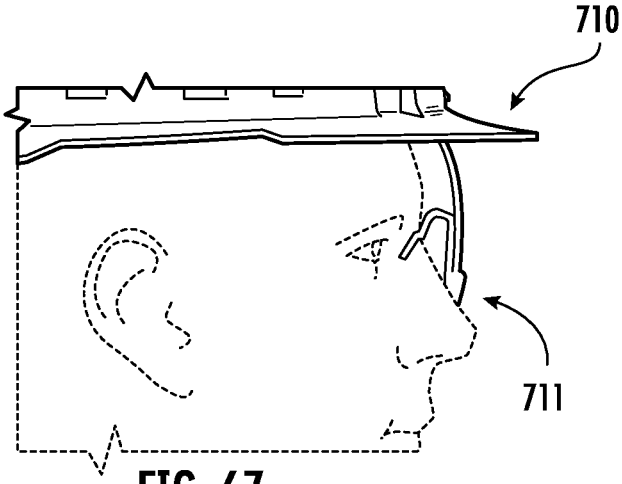
FIG. 67 is a side view of a protective system for safety headwear, according to an exemplary embodiment.
Figure 68:
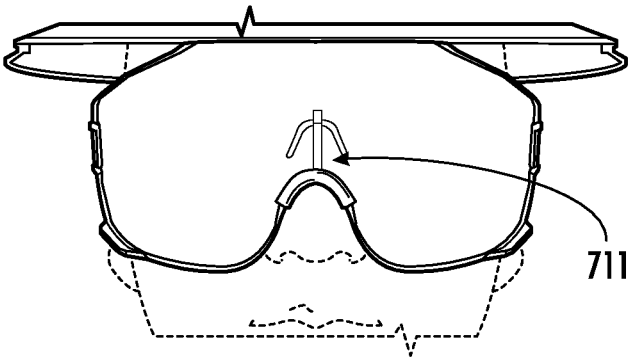
FIG. 68 is a front view of a protective system for safety headwear, according to an exemplary embodiment.

Referring to FIGS. 66-68, various aspects of a protective system 710 for safety headwear are shown. The protective system includes support for glasses, such as safety glasses, shown as pads 711. In a specific embodiment, the pads 711 are the same as those used for a nose piece for safety glasses. In a specific embodiment, the glasses support is shaped to conform to the shape of the lens, such as the geometry of the nose area of the lens. The pads 711 are coupled to a bottom of the face shield (at the nose rest area), and extend in a curved fashion to a point higher up the nose of the person wearing it. A benefit of this approach is that the interaction with the nose of the wearer is more comfortable compared to other designs.

Figure 69:
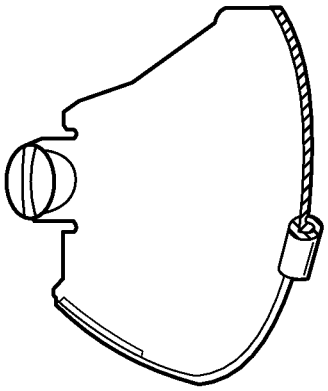
FIG. 69 is a side view of a face shield, according to an exemplary embodiment.
Figure 70:
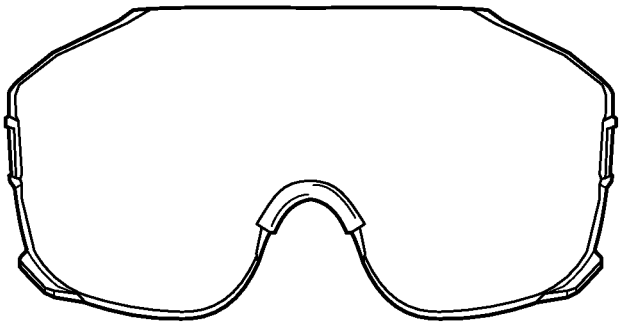
FIG. 70 is a front view of a face shield, according to an exemplary embodiment.
Figure 71:
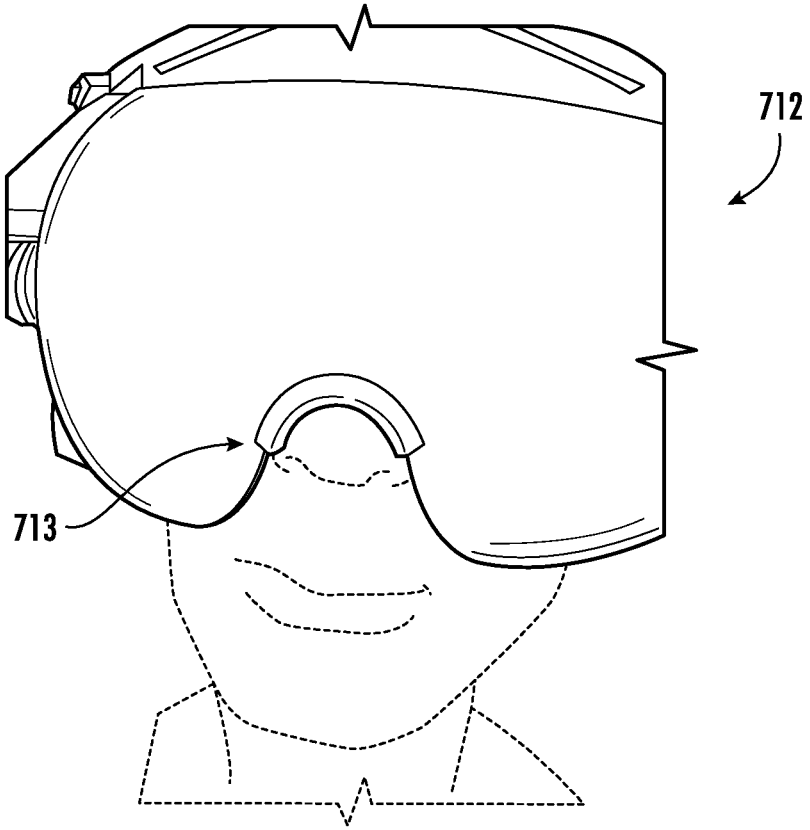
FIG. 71 is a front view of a protective system for safety headwear, according to an exemplary embodiment.

Referring to FIGS. 69-71, various aspects of a protective system 712 for safety headwear are shown. The protective system includes a softer squishy material, shown as bumper 713, that couples to the nose area of the lens and interfaces against a nose of the wearer.

Figure 72:
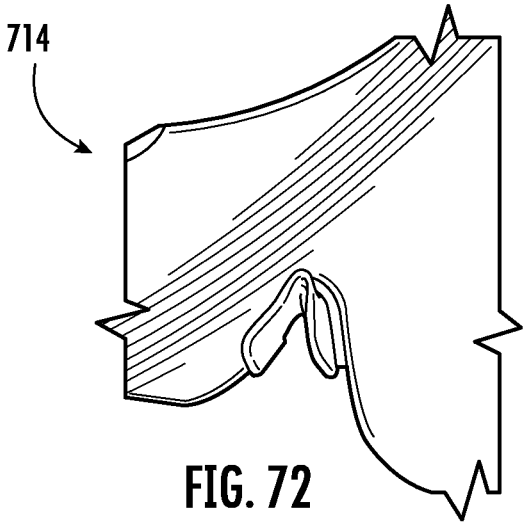
FIG. 72 is a perspective view of a portion of protective system for safety headwear, according to an exemplary embodiment.
Figure 73:
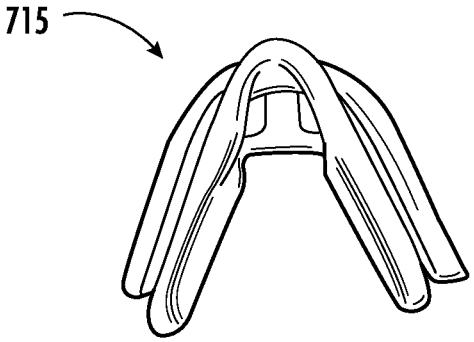
FIG. 73 is a perspective view of a portion of a protective system for safety headwear, according to an exemplary embodiment.
Figure 74:
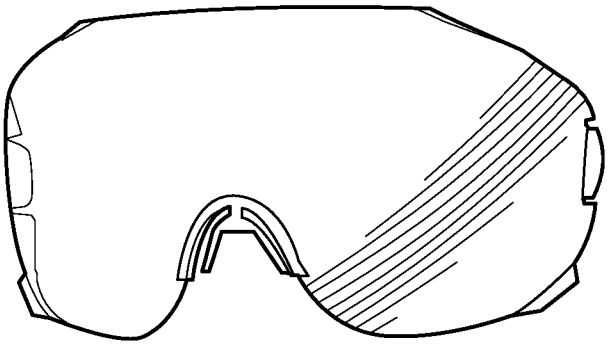
FIG. 74 is a perspective view of a portion of a protective system for safety headwear, according to an exemplary embodiment.

Referring to FIGS. 72-74, various aspects of a protective system 714 for safety headwear are shown. The protective system 714 includes a cushion 715 that couples to a bottom of the face shield and interfaces against the nose of the wearer. In a specific embodiment, cushion 715 is the same pad as the nose piece for safety glasses.

Figure 75:
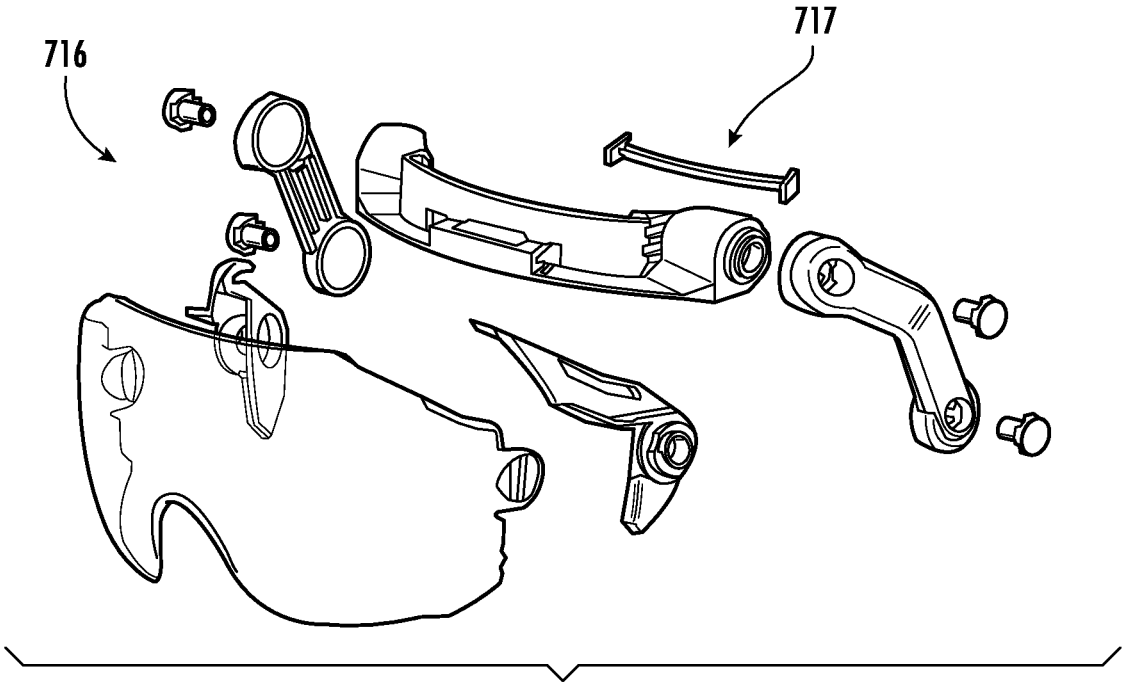
FIG. 75 is an exploded view of a protective system for safety headwear, according to an exemplary embodiment.
Figure 76:
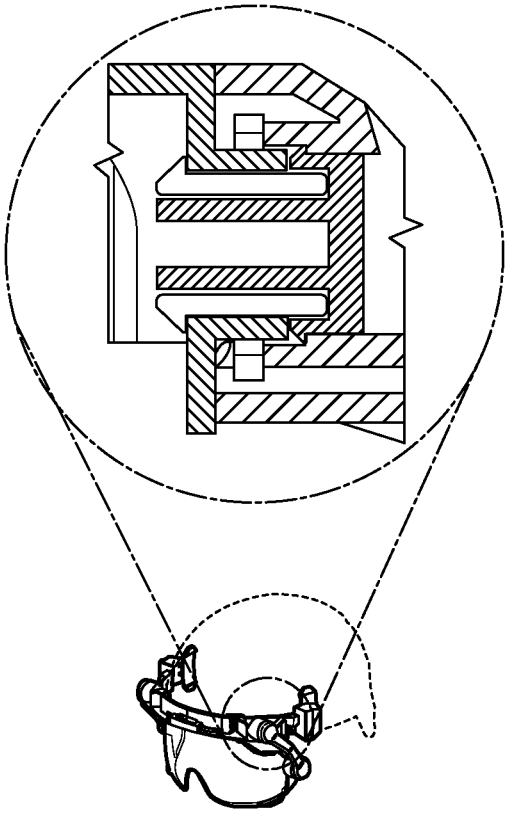
FIG. 76 is a perspective view and a cross-section view of a protective system for safety headwear, according to an exemplary embodiment.
Figure 77:
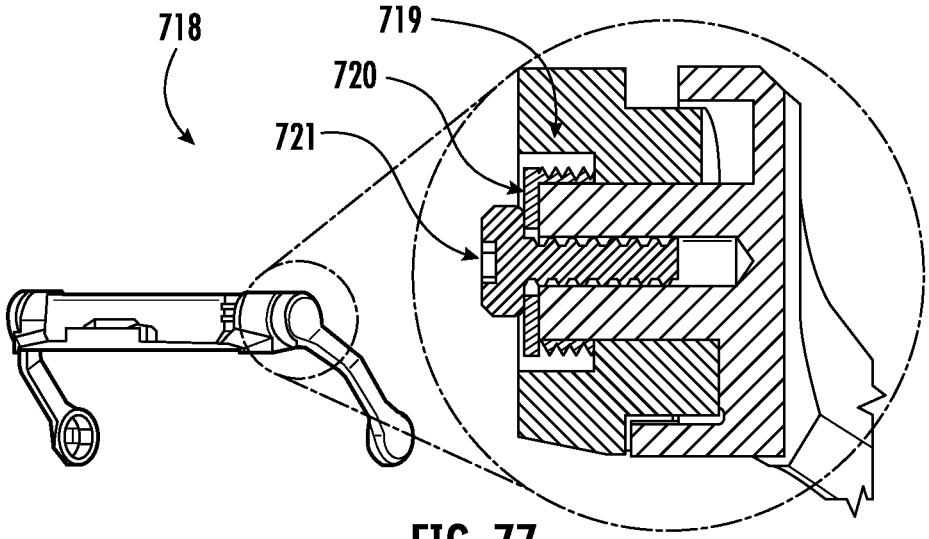
FIG. 77 is a perspective view and a cross-section view of a protective system for safety headwear, according to an exemplary embodiment.

Referring to FIGS. 75-76, various aspects of a protective system 716 for safety headwear are shown. In various embodiments, all components shown in FIG. 75 are formed from a plastic material. Referring to FIG. 76, a captive pin 717 is slideably engaged with the brim guard, and the brim guard is coupled to the arm (component on right side) via a coupling component, shown as a pivot snap plug (component in center).

Figure 78:
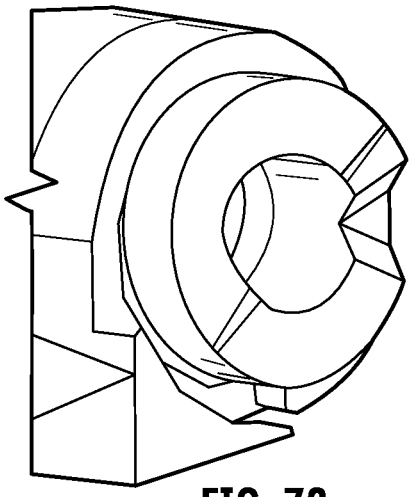
FIG. 78 is a perspective view of a portion of a protective system for safety headwear, according to an exemplary embodiment.
Figure 79:
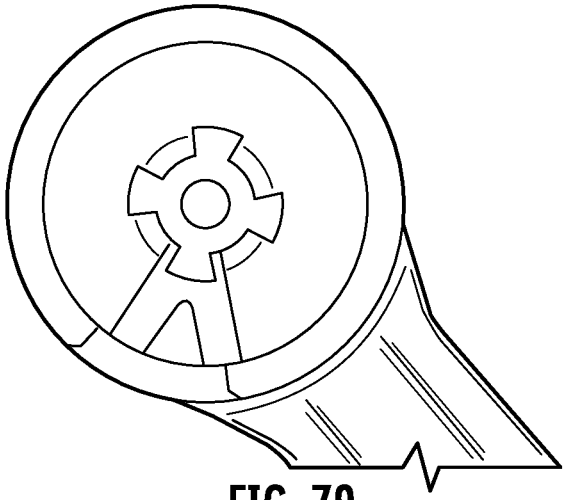
FIG. 79 is a side view of a portion of a protective system for safety headwear, according to an exemplary embodiment.
Figure 80:
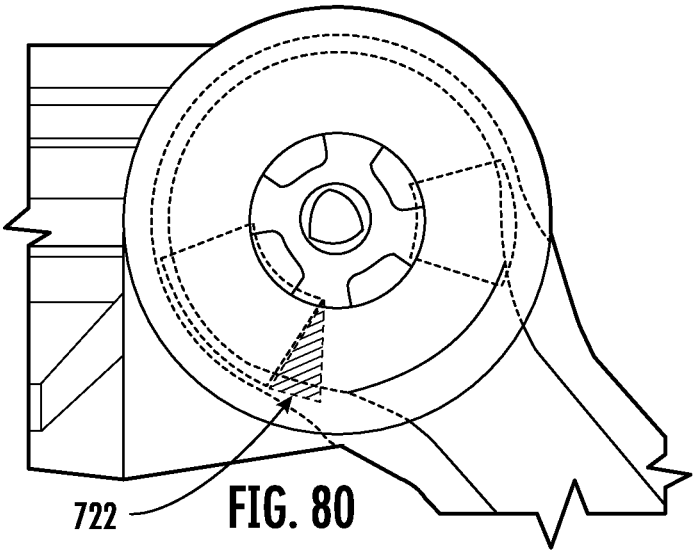
FIG. 80 is a side view in silhouette of a protective system for safety headwear, according to an exemplary embodiment.

Referring to FIGS. 77-80, various aspects of a protective system 718 for safety headwear are shown. The protective system 718 includes a wave spring 719, a washer 720, and a coupling mechanism, shown as a screw 721 that couples the arm to the brim guard. Referring to FIGS. 78-80, in various embodiments a triangular bump 722 on the arm rides along the surface on the brim guard when the brim (FIG. 78) and arm (FIG. 79) are rotating with respect to each other.

Figure 81:
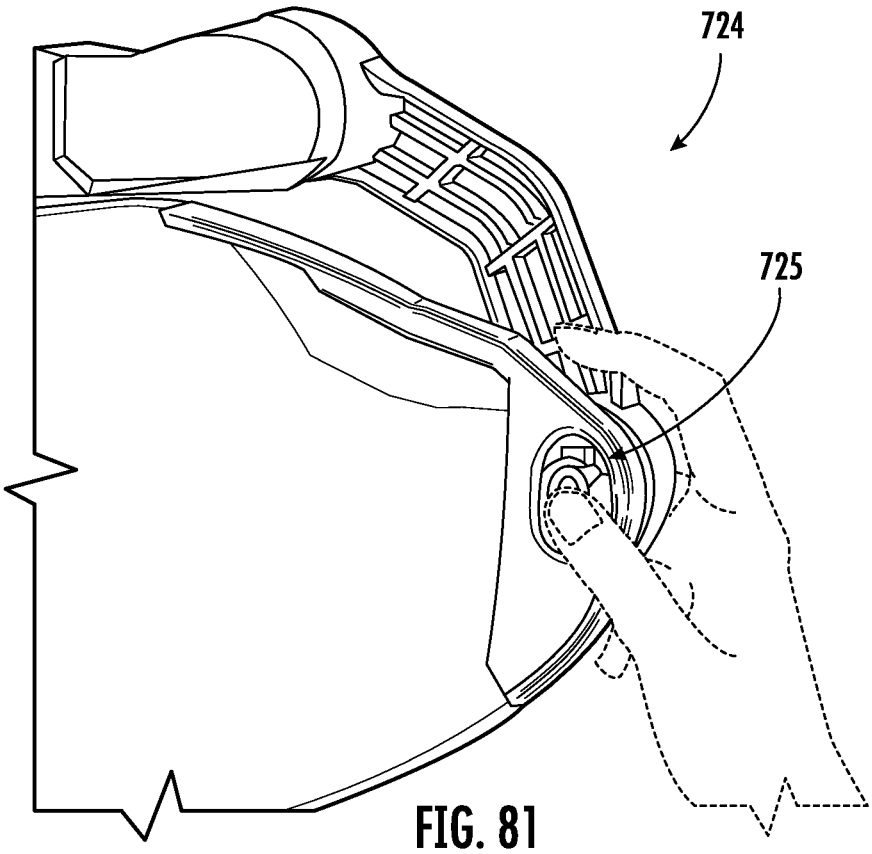
FIG. 81 is a perspective view of a portion of a protective system for safety headwear, according to an exemplary embodiment.
Figure 82:
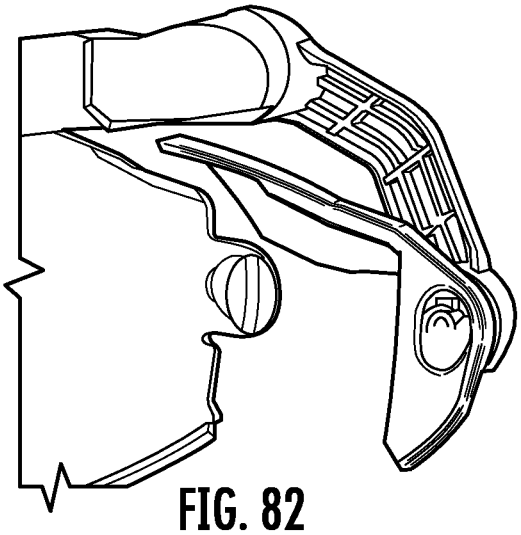
FIG. 82 is a perspective view of a portion of the protective system of FIG. 81, according to an exemplary embodiment.
Figure 83:
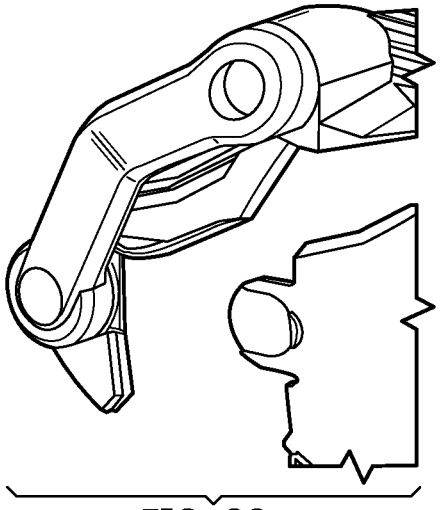
FIG. 83 is a perspective view of a portion of the protective system of FIG. 81, according to an exemplary embodiment.

Referring to FIGS. 81-83, various aspects of a protective system 724 for safety headwear are shown. The protective system includes a push tab 725 that snaps in and out of the frame (FIG. 81). The tab 725 is depressed to remove the lens.

Figure 84:
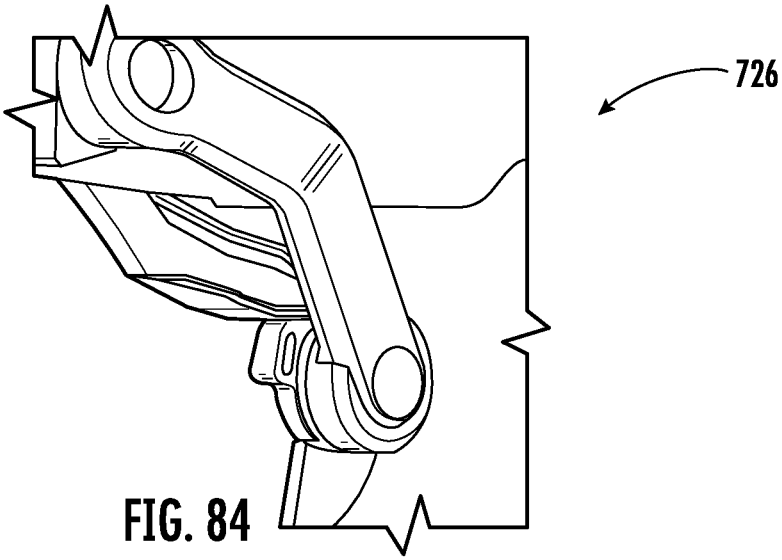
FIG. 84 is a perspective view of a portion of a protective system for safety headwear, according to an exemplary embodiment.
Figure 85:
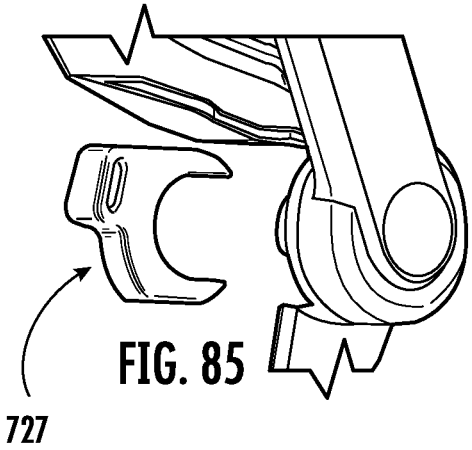
FIG. 85 is an exploded perspective view of the protective system of FIG. 84, according to an exemplary embodiment.
Figure 86:
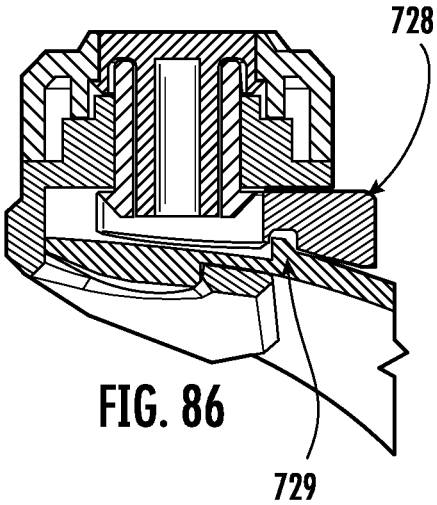
FIG. 86 is a cross-section view of a portion of the protective system of FIG. 84, according to an exemplary embodiment.
Figure 87:
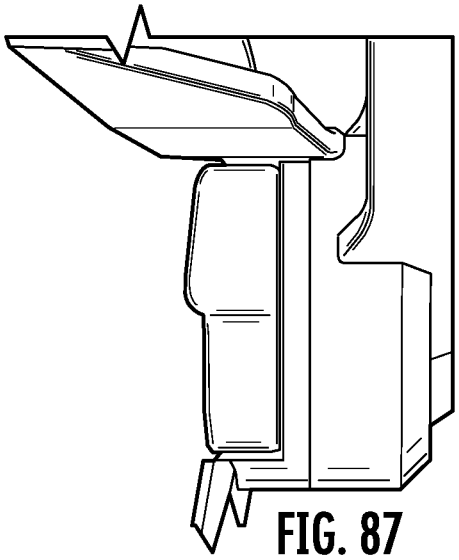
FIG. 87 is a front view of the protective system of FIG. 84, according to an exemplary embodiment.
Figure 88:
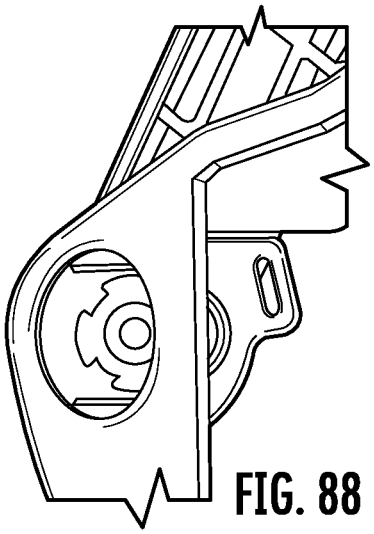
FIG. 88 is a side view of the protective system of FIG. 84, according to an exemplary embodiment.

Referring to FIGS. 84-88, various aspects of a protective system 726 for safety headwear are shown. The protective system 726 includes a C-clip 727 from the front. FIG. 85 depicts the C-clip 727 before attachment, and FIG. 84 depicts the C-clip while attached. Referring to FIG. 86, the C-clip 727 is held in place by a protrusion extending from the lens, and the lock 728 is held in place by recess 729. In various embodiments, the C-clip 727 fills gaps left by the arm snap features.

Figure 89:
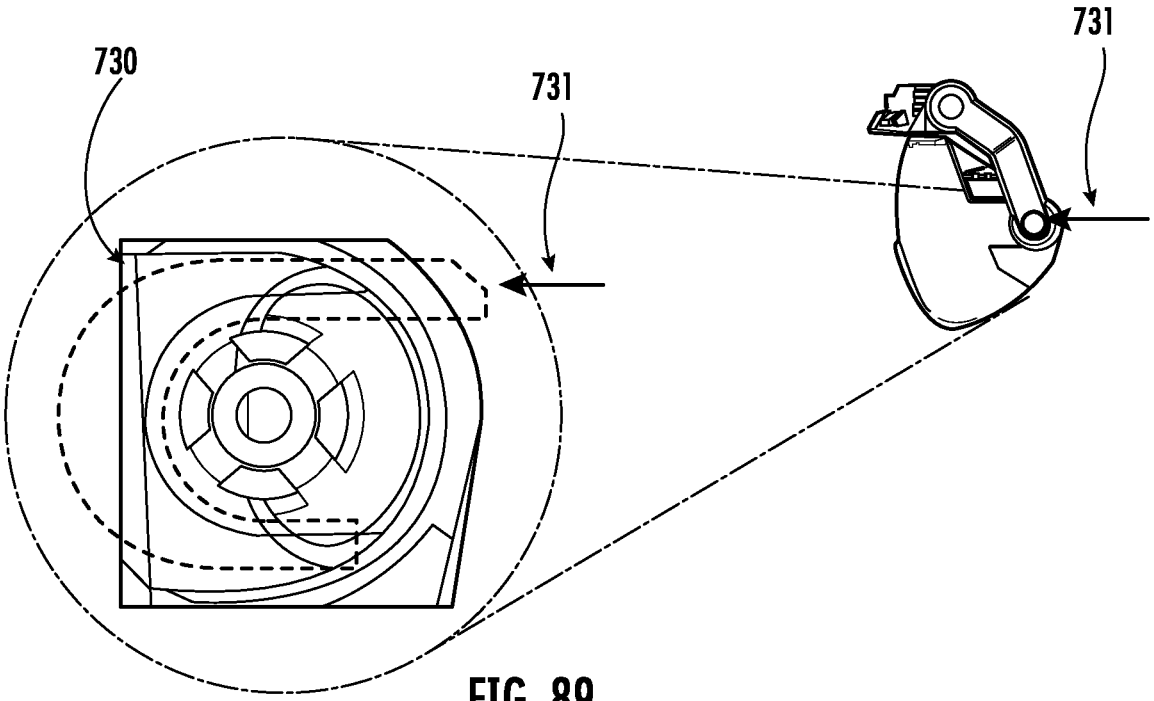
FIG. 89 is a cross-section view of a protective system for safety headwear, according to an exemplary embodiment.
Figure 90:
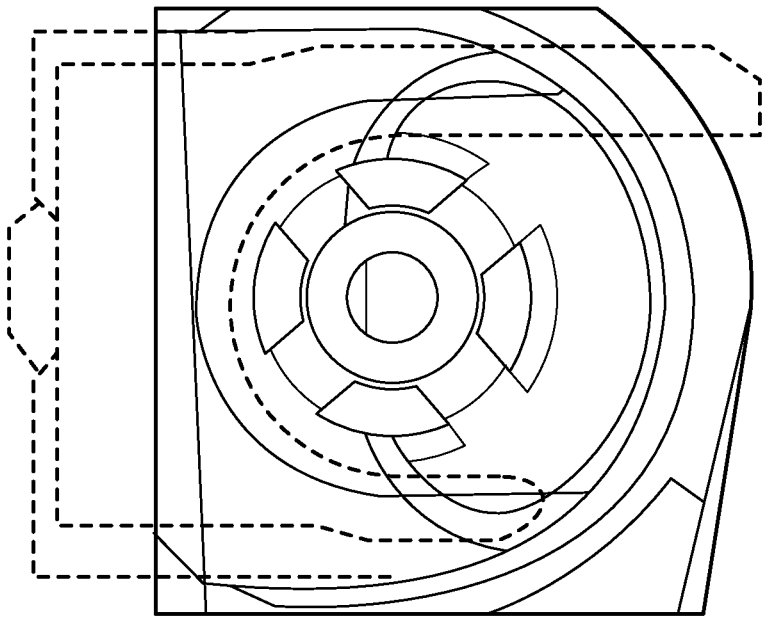
FIG. 90 is a cross-section detailed view of the protective system of FIG. 89, according to an exemplary embodiment.

Referring to FIGS. 89-90, various aspects of a protective system for safety headwear are shown. The protective system includes a C-clip 730 from the back. The C-clip 730 prevents tab on the lens from depressing and sliding out of the frame. To remove C-clip 730, C-clip 730 is pushed from the front in direction 731.

Figure 91:
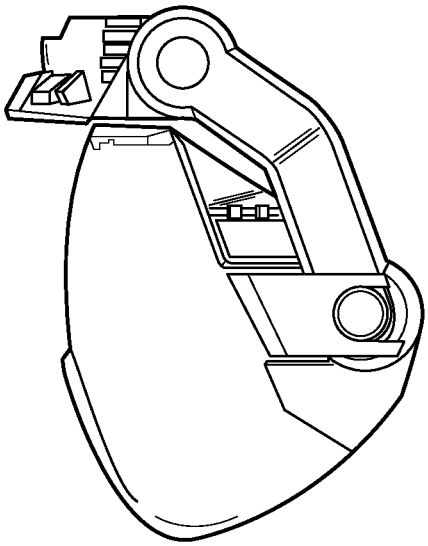
FIG. 91 is a side view of a protective system for safety headwear, according to an exemplary embodiment.
Figure 92:
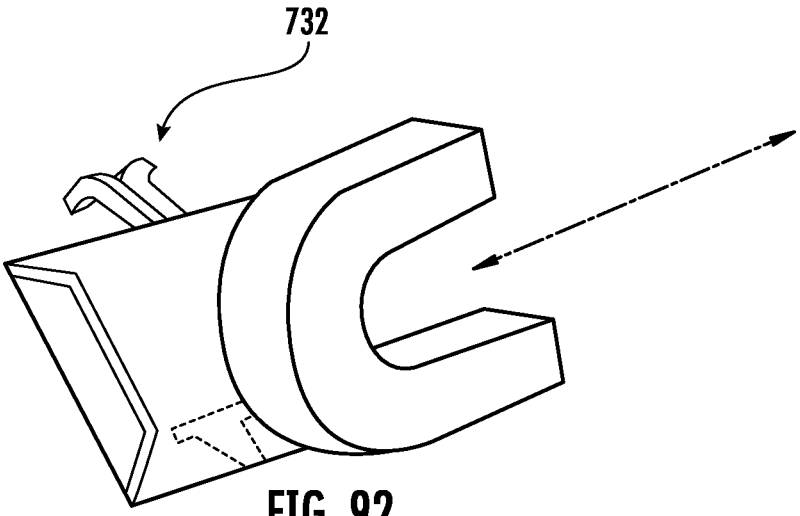
FIGS. 92 and 93 are schematic views of a protective system for safety headwear, according to an exemplary embodiment.
Figure 93:
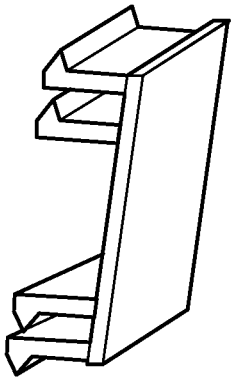

Referring to FIGS. 91-93, various aspects of a protective system for safety headwear are shown. The protective system includes a C-clip retention in the lens. In a specific embodiment, hooks 732 attach through slots in the lens (FIG. 91).

Figure 94:
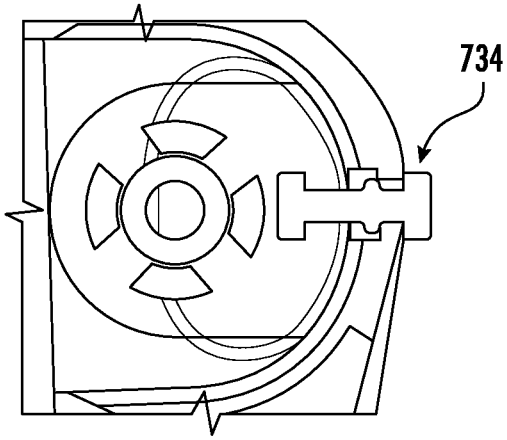
FIGS. 94-96 are cross-section perspectives view of a protective system for safety headwear, according to an exemplary embodiment.
Figure 95:
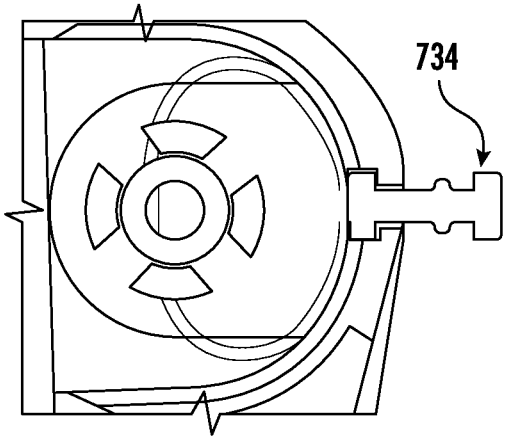
Figure 96:
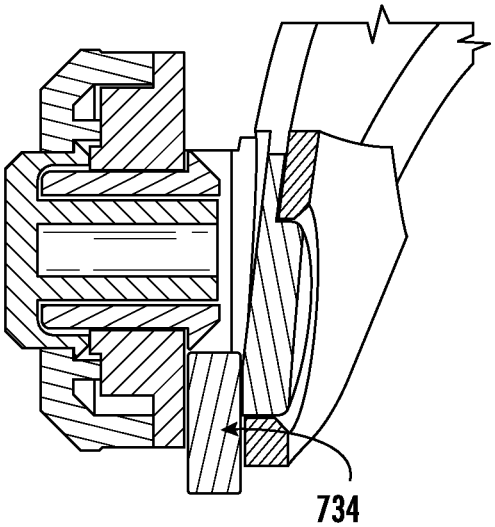
Figure 97:
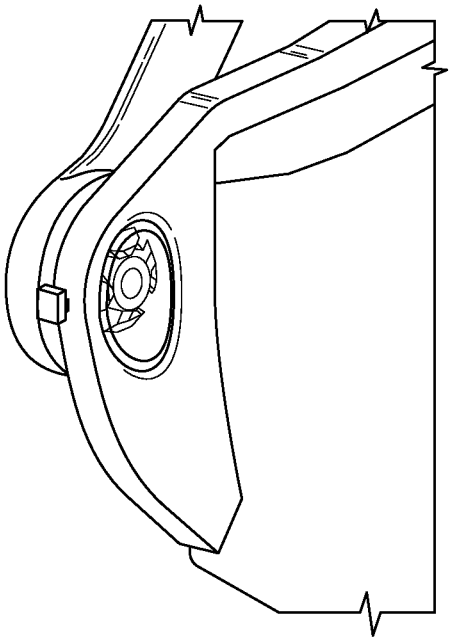
FIG. 97 is a rear view of a protective system for safety headwear, according to an exemplary embodiment.
Figure 98:
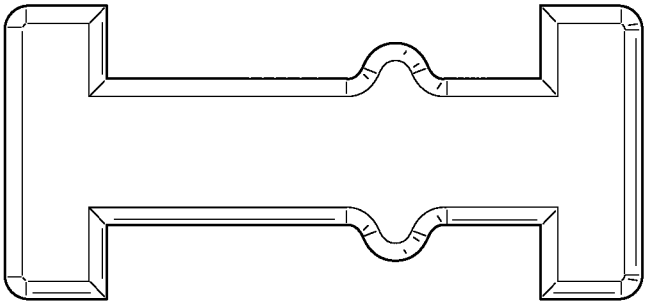
FIGS. 98-99 are schematic views of a protective system for safety headwear, according to an exemplary embodiment.
Figure 99:
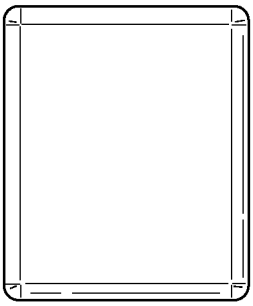
Figure 100:
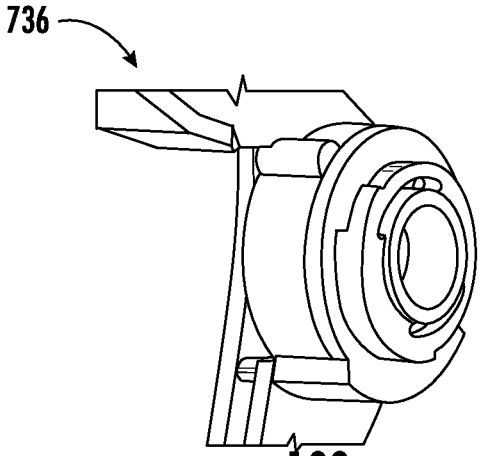
FIGS. 100-103 are a perspective views with silhouette of a protective system for safety headwear, according to an exemplary embodiment.
Figure 101:
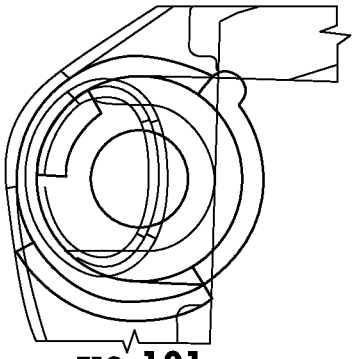
Figure 102:
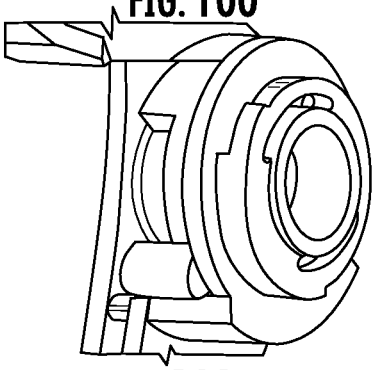

Referring to FIGS. 94-99, various aspects of a protective system for safety headwear are shown. The protective system includes a lens back side lock. FIG. 94 depicts the side lock 734 in a locked position, and FIG. 95 depicts the side lock 734 in an unlocked position. In various embodiments the side lock 734 biases the lens snap from flexing to release (FIG. 96).

Figure 103:
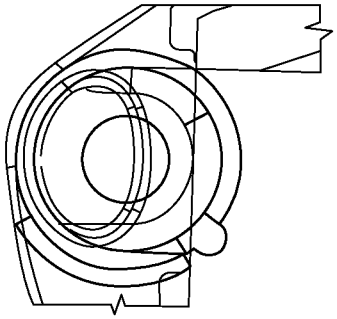
Figure 104:
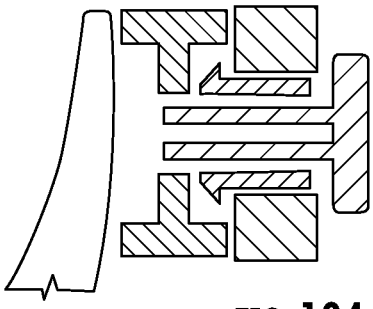
FIG. 104 is a schematic view of a protective system for safety headwear, according to an exemplary embodiment.
Figure 105:
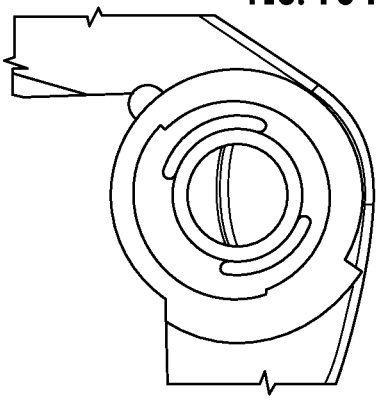
FIG. 105 is a side view of the protective system of FIG. 100, according to an exemplary embodiment.
Figure 106:
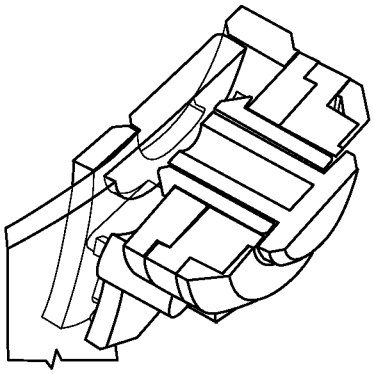
FIG. 106 is a cross-section view of the protective system of FIG. 100, according to an exemplary embodiment.

Referring to FIGS. 100-106, various aspects of a protective system 736 for safety headwear are shown. The protective system 736 includes a lens front cam lock. The cam lock actuates between a locked position (FIG. 101) and an unlocked position (FIG. 103).

Figure 107:
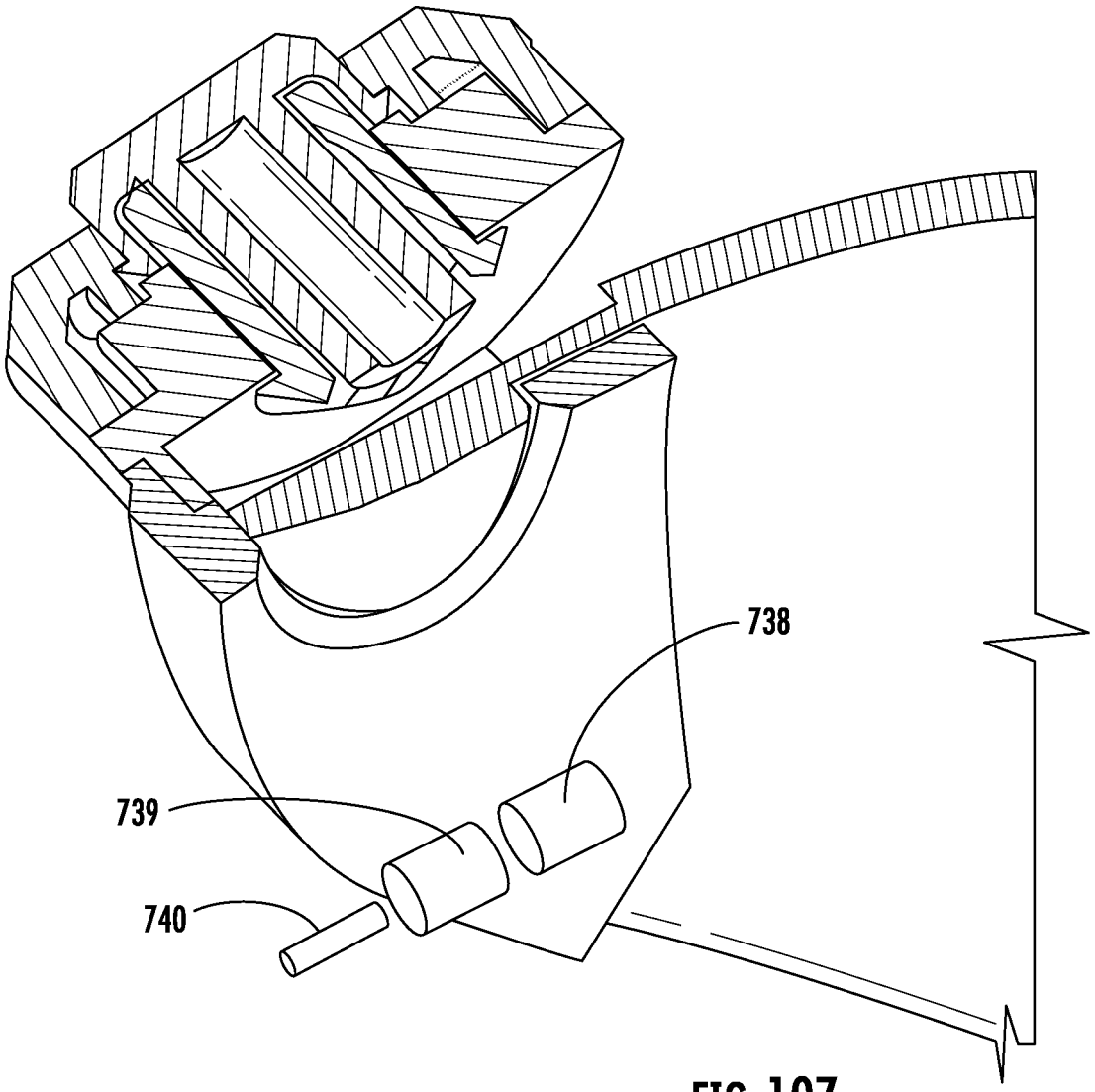
FIG. 107 is a perspective view of a cross-section of a protective system for safety headwear, according to an exemplary embodiment.
Figure 108:
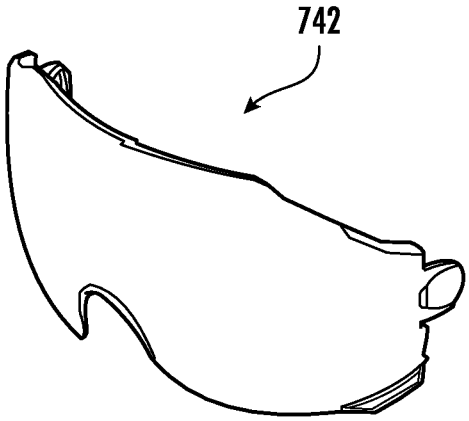
FIGS. 108-109 are perspective views of a face shield, according to exemplary embodiments.
Figure 109:
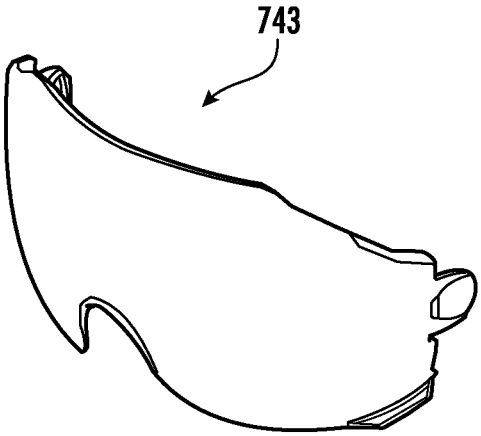
Figure 110:
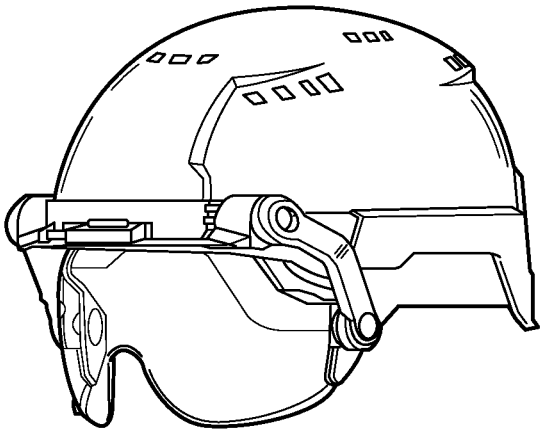
FIGS. 110-111 are perspective views of a protective system for safety headwear, according to exemplary embodiments.
Figure 111:
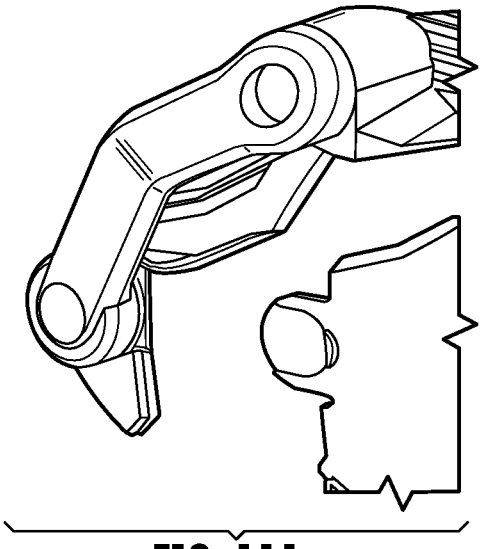

Referring to FIG. 107, various aspects of a protective system for safety headwear are shown. The protective system includes a screw boss 739 between the frame and the lens. In a specific embodiment, the screw 740 engages with the screw boss 739 on the frame, which engages with the screw boss on the lens 738.

Referring to FIGS. 108-111, various aspects of a protective system for safety headwear are shown. The protective system includes a lens that is clear 742 or a lens that is smoky 743 (e.g., slightly opaque).

Figure 112:
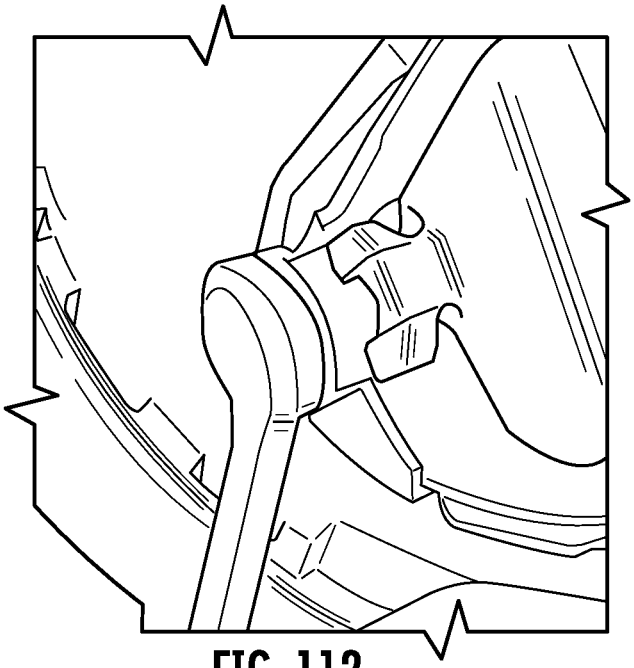
FIG. 112-113 are perspective views of a protective system for safety headwear, according to exemplary embodiments.
Figure 113:
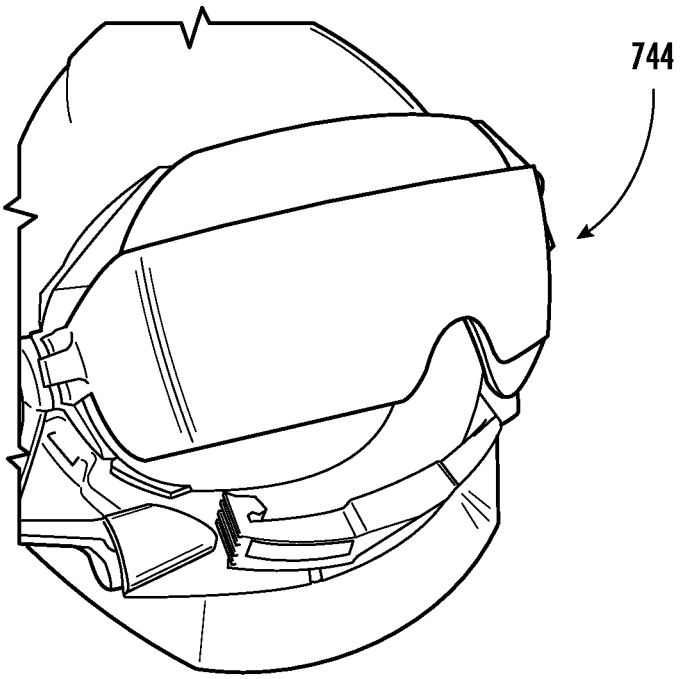

Referring to FIGS. 112-113, various aspects of a protective system for safety headwear are shown. The protective system includes a dark lens, such as a smoky dark lens 744. The lens 744 keys into an opening on the front side of the snap features between the side frame and the lens.

Figure 114:
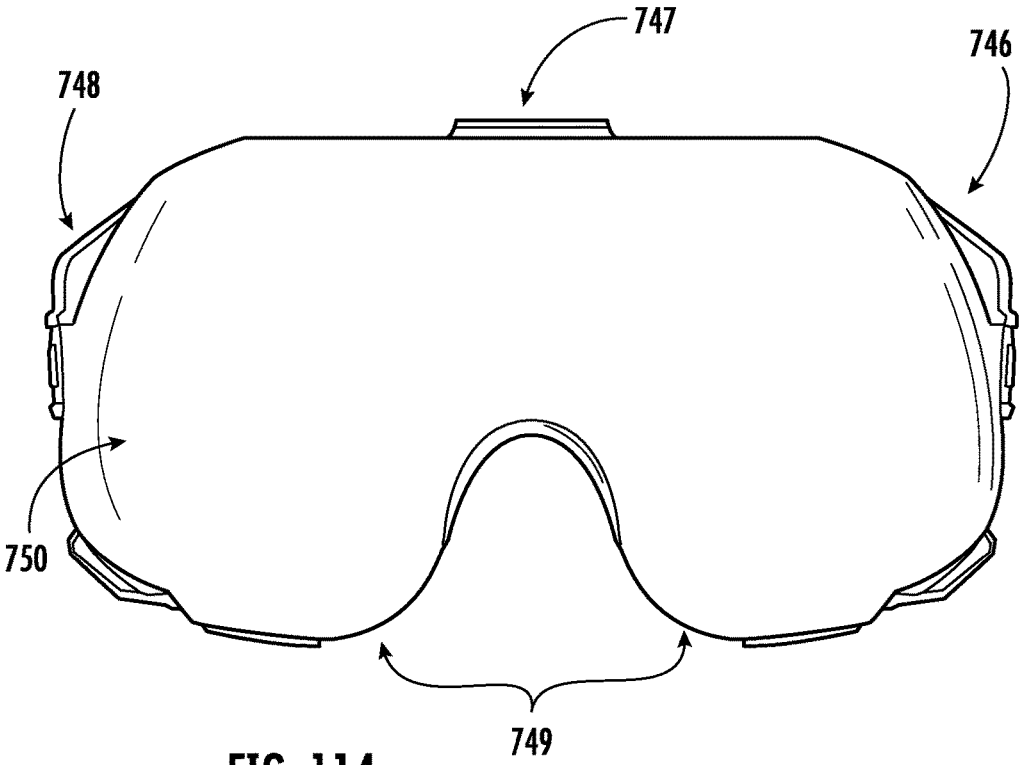
FIG. 114 is a front view of a face shield, according to an exemplary embodiment.
Figure 115:
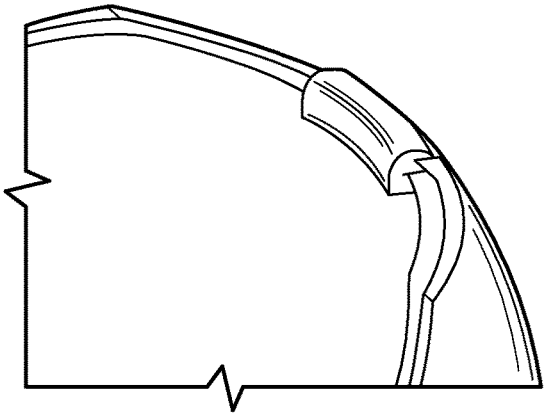
FIGS. 115-116 are perspective views of the face shield of FIG. 114, according to an exemplary embodiment.
Figure 116:
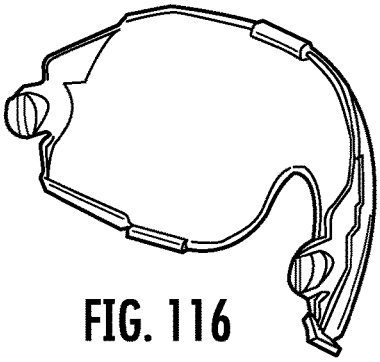

Referring to FIGS. 114-116, various aspects of a protective system for safety headwear are shown. The protective system includes a lens 746 with a snap 747 feature, an original clear lens 748 coupled to a side of lens 746, a disposable smoky lens 750 for scratch protection and/or a fogged lens for the sun, one or more snaps 749 extending from the bottom of the lens.

Figure 117:
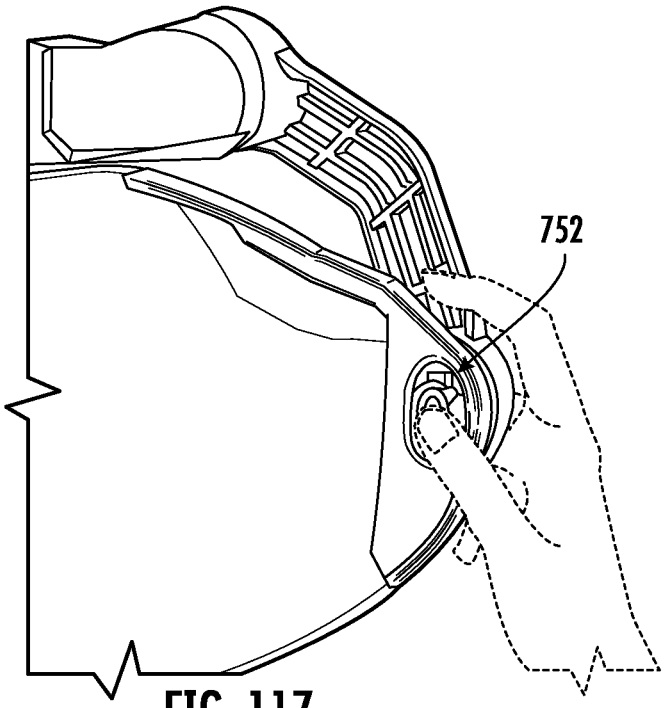
FIG. 117 is a rear view of a protective system for safety headwear, according to an exemplary embodiment.
Figure 118:
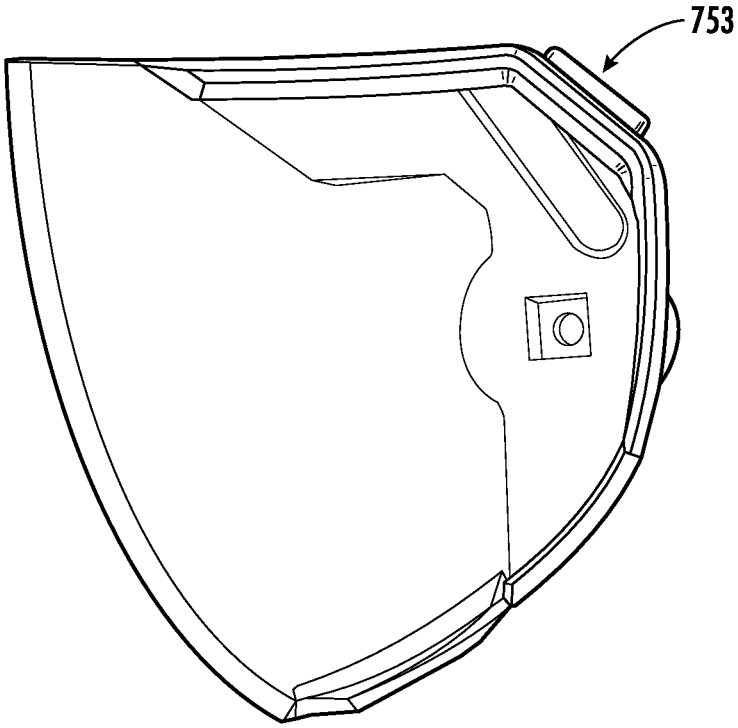
FIG. 118 is a side view of a protective system for safety headwear, according to an exemplary embodiment.

Referring to FIGS. 117-118, various aspects of a protective system for safety headwear are shown. The protective system includes tab 752 that can be depressed to remove the lens (FIG. 117). Alternatively, tab 753 can be pushed to release lens from the brim guard and/or arms. This optionality to release lens permits easier lens replacement while the visor is worn near the face compared to other coupling systems. In various embodiments the lens is replaceable.

Figure 119:
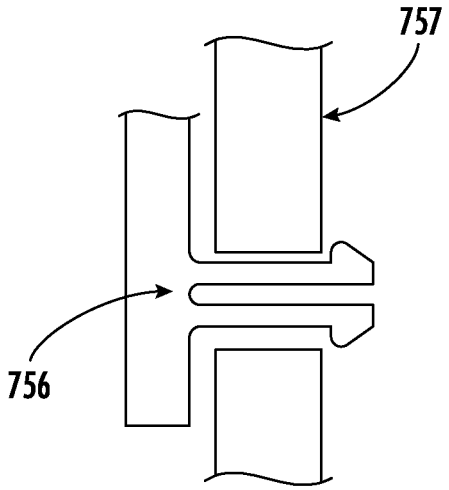
FIG. 119 is a schematic view of cross-section of a protective system for safety headwear, according to an exemplary embodiment.
Figure 120:
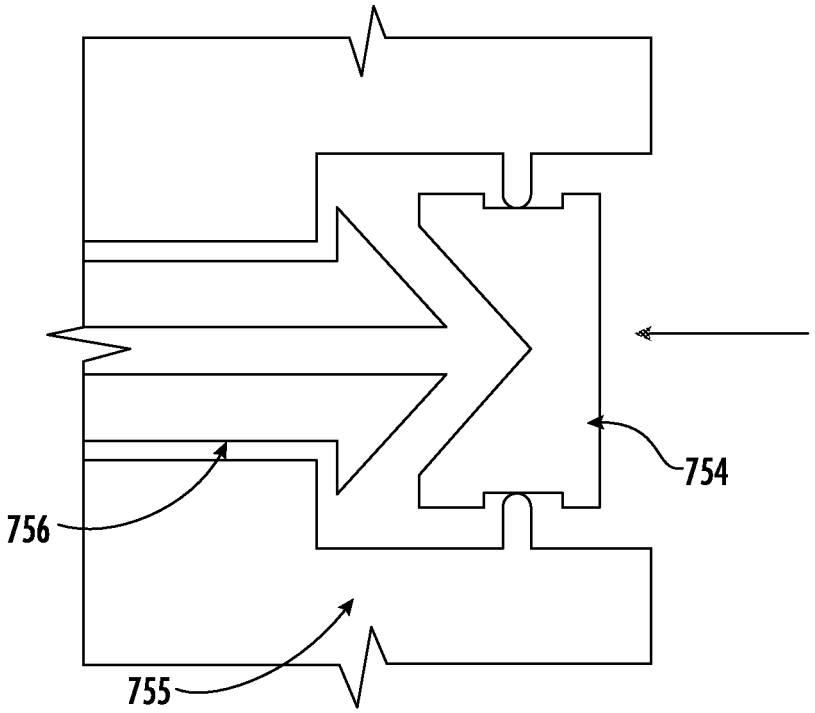
FIG. 120 is a schematic view of a cross-section of a protective system for safety headwear, according to an exemplary embodiment.
Figure 121:
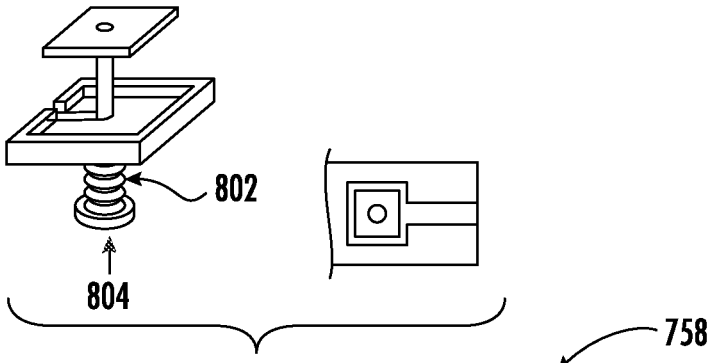
FIG. 121 is a schematic view of a protective system for safety headwear, according to an exemplary embodiment.

Referring to FIGS. 119-120, various aspects of a protective system for safety headwear are shown. The protective system includes a captive push button 754 that forces the snap 756 from the arm out of the hole and allows the lens 755 to be replaced. Interfacing with the left-side of the captive push button is snaps 756 from the arm. The lens 755 is the object beneath the push button 754 and the snaps 756. Snaps 756 extend between elements of shield 757.

Figure 122:
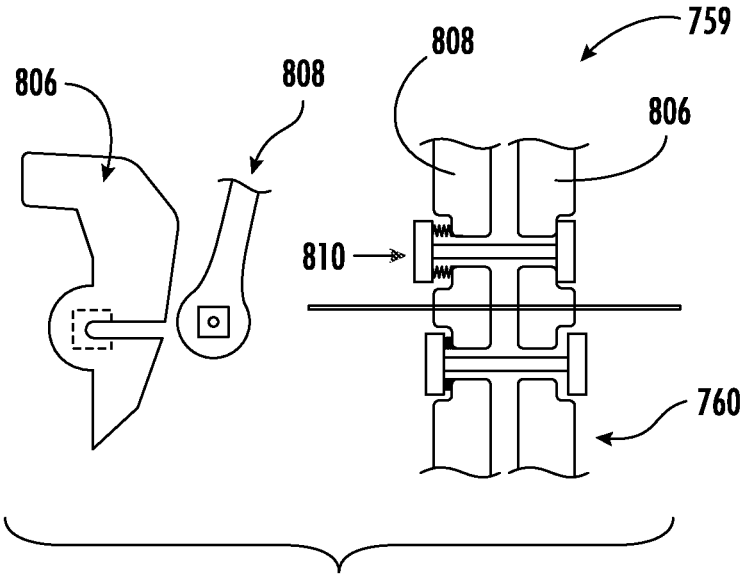
FIG. 122 is schematic views of a protective system for safety headwear, according to an exemplary embodiment.
Figure 123:
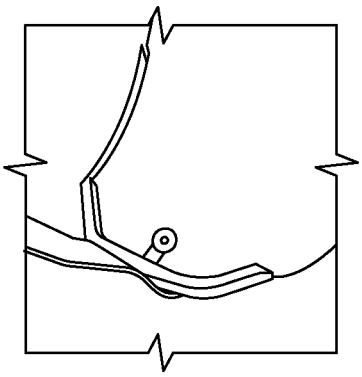
FIGS. 123-124 are perspective views of a protective system for safety headwear, according to an exemplary embodiment.
Figure 124:
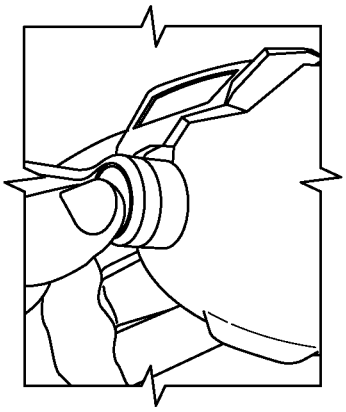
Figure 125:
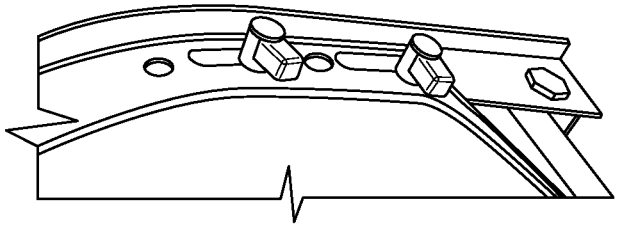
FIG. 125 is a perspective view of a protective system for safety headwear, according to an exemplary embodiment.

Referring to FIGS. 121-124, various aspects of a protective system 758 for safety headwear are shown. The protective system 758 includes a tight captive pin push button that holds a protective element, such as a shield. Referring to FIG. 122, locked configuration 759 is shown in the upper-right figure, and unlocked configuration 760 is shown in the lower-right figure. In use, a force is exerted in direction 804 against spring 802. Shield 806 is positioned proximate arm 808. Force is exerted on system in direction 810 to transition system from locked configuration 759 to unlocked configuration 760.

Figure 126:
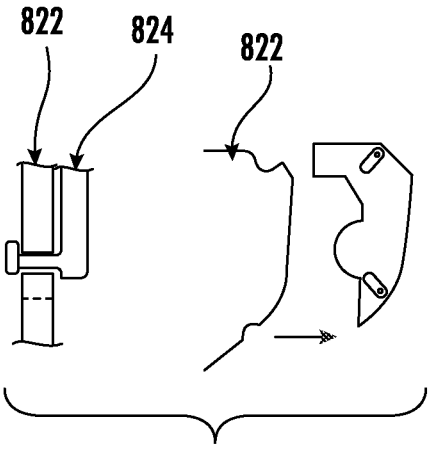
Figure 127:
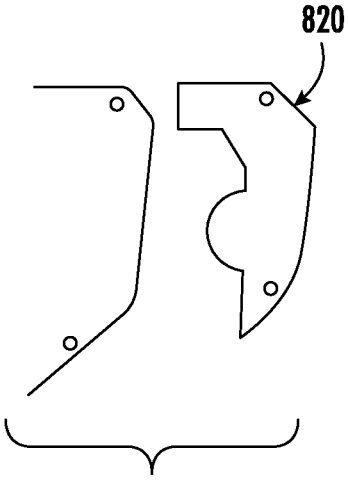
Figure 128:
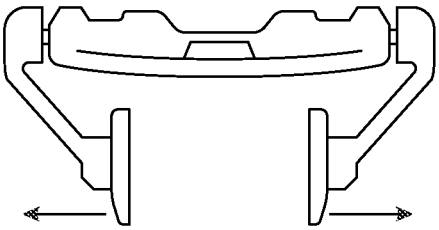
Figure 129:
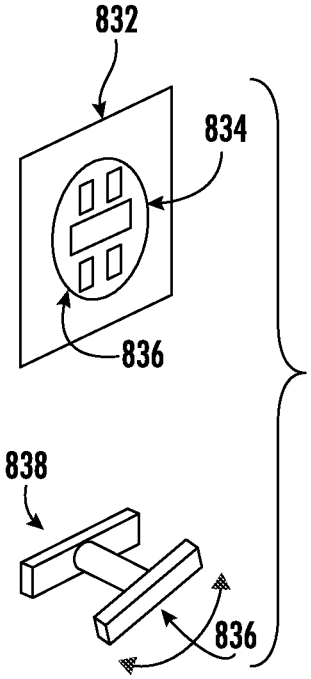

Referring to FIGS. 125-129, various aspects of a protective system for safety headwear are shown. For example, a spin pin may be used with a shield 822 and arm 824, as shown in FIG. 126, one or more magnets 820 may be used, as shown in FIG. 127, the system may be originally configured with tension to hold the lens in via friction, as shown in FIG. 128. Referring to FIG. 129, shield 129 includes a hole 834, a pivot 836 on the outside, an arm 837, and a toggle 838.

Figure 130:
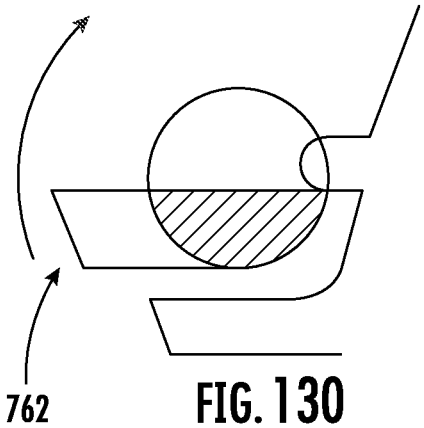
Figure 131:
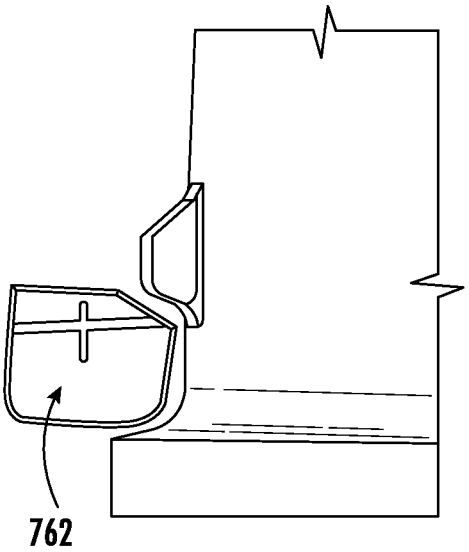
Figure 132:
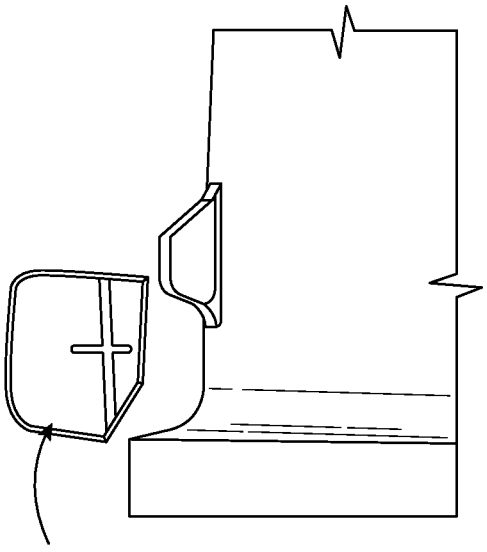
Figure 133:
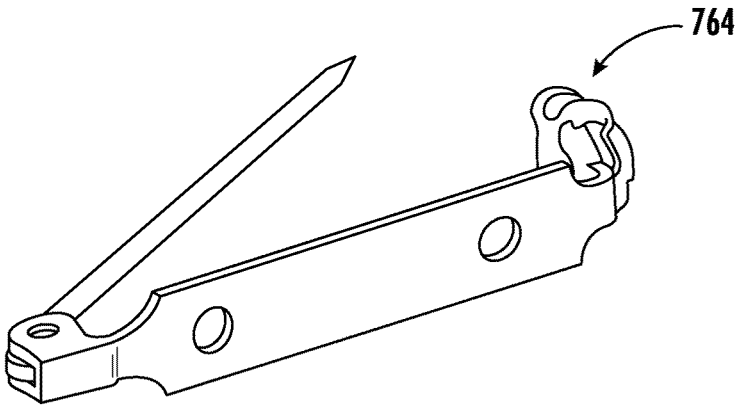

Referring to FIGS. 130-132, various aspects of a protective system for safety headwear are shown. The protective system includes a vertical cam 762 that spins out, which removes the cam 762 from under the retention protrusion at a front of the safety headwear (see transition from FIG. 131 to FIG. 132).

Figure 134:
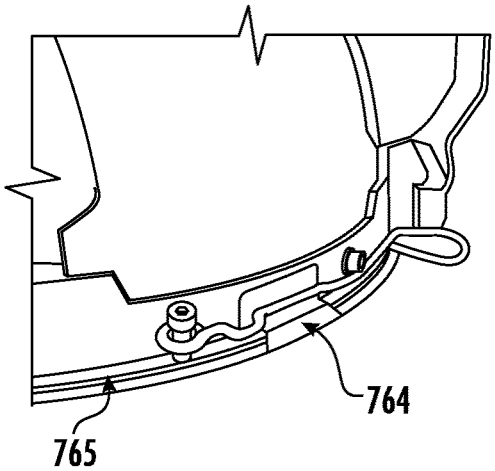
Figure 135:
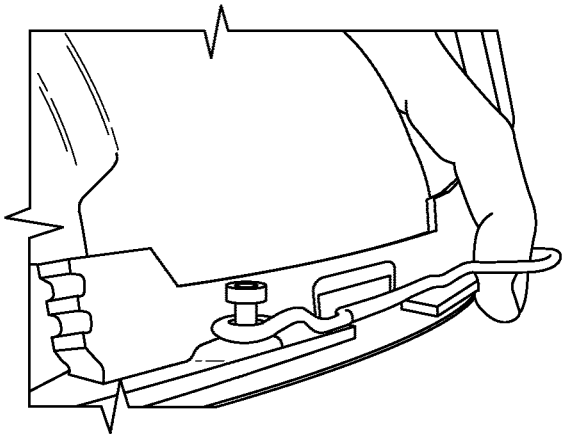
Figure 136:
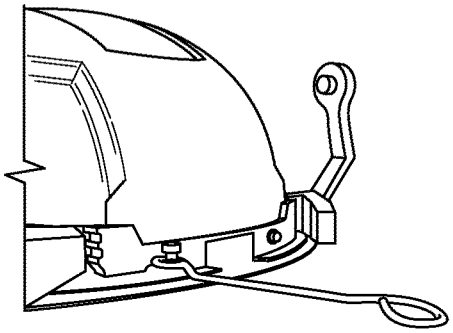

Referring to FIGS. 133-136, various aspects of a protective system for safety headwear are shown. The protective system includes a single pivot pin wire 764, which attaches to the safety headwear while maintaining a super low profile visor brim. In a specific embodiment, the pin is metal. FIGS. 134-136 depict a transition of pin wire 764 being decoupled from the hard hat, thus permitting brim guard 765 to be removed from the hard hat.

Figure 137:
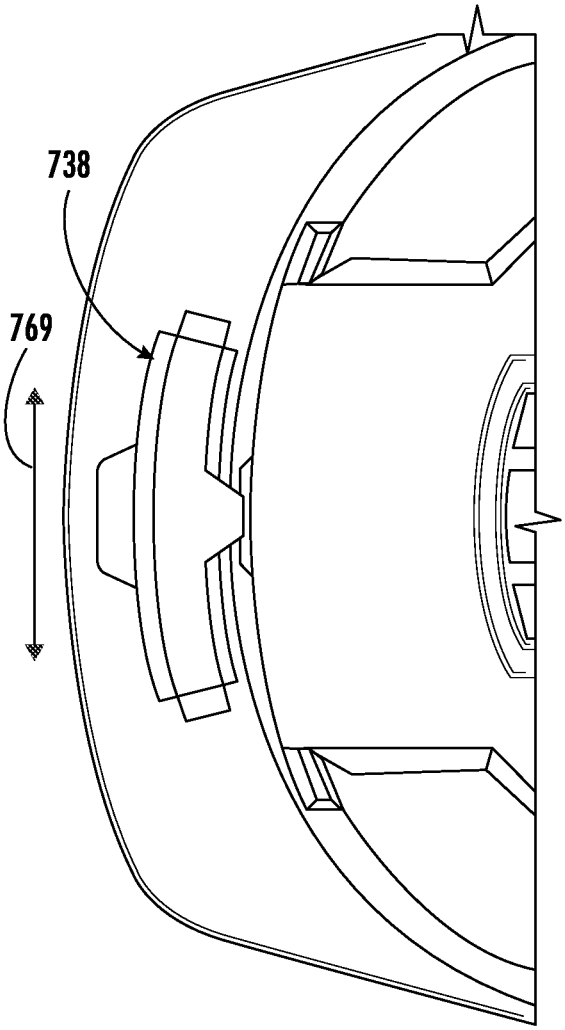
Figure 138:
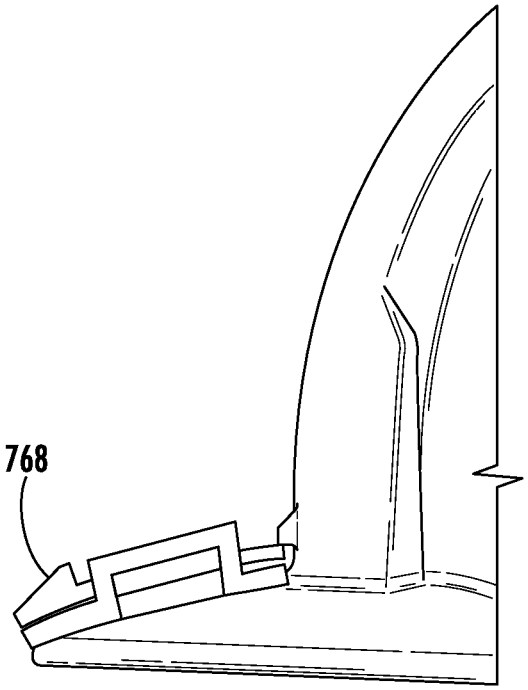
Figure 139:
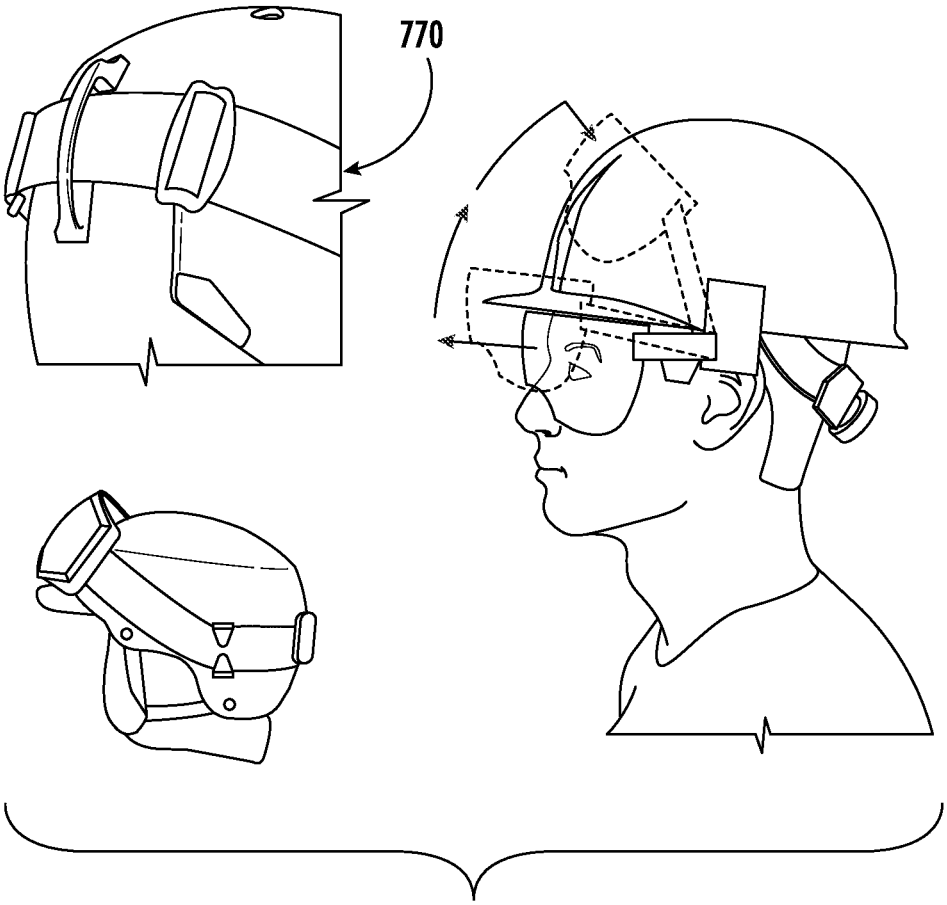
Figure 141:
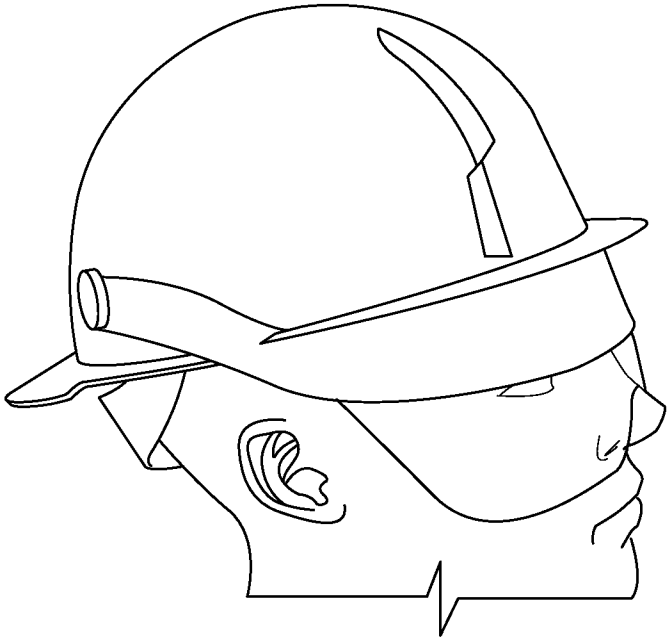
Figure 140:
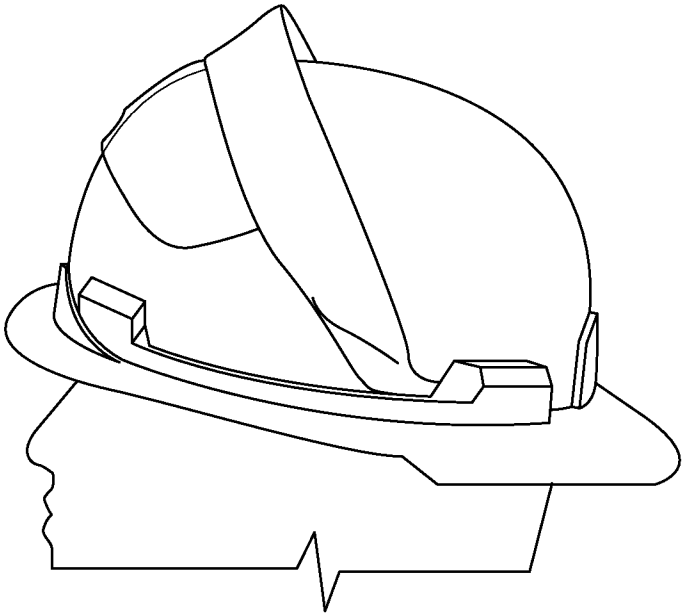

Referring to FIGS. 137-138, various aspects of a protective system for safety headwear are shown. The protective system includes a switch 768 that slides along axis 769, which removes it from under the protrusion at a front of the safety headwear, which allows the visor to be pulled straight up off the safety headwear.

Figure 142:
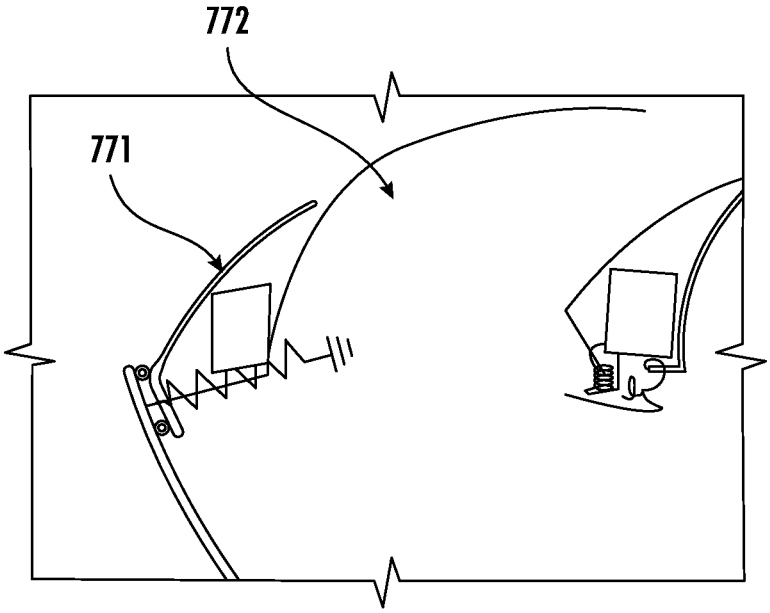

Referring to FIGS. 139-145, various aspects of a protective system for safety headwear are shown. The protective system includes an elongate structure, shown as a stretchable elastic band 770. In various embodiments, the band holds the visor in place and biases the lens closer to the face. In various embodiments, the band holds the visor along a track to constrict motion of the visor moving up and down, such as around headlamp 771 to hard hat 772 (FIG. 142).

Referring to FIGS. 146-150, various aspects of a protective system for safety headwear are shown. The protective system includes a bendable elongate structure, such as a bendable arm 774. The bendable arm holds its position and allows the user to place the visor in various locations (e.g., in front of the face, in a stowed position).

Referring to FIG. 151, various aspects of a protective system for safety headwear are shown. The protective system includes an angle poise arm that holds its position and allows the user to put the visor in various locations (e.g., in front of the face, in a stowed position). The down position of face shield is shown by 780, the up position is shown by 781, the protective system includes pin and slot area 782, the protective system includes pulley 783, a spring 784, and gravity counteracts spring 784.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions, and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths, and radii, as shown in the Figures, are to scale. Actual measurements of the Figures will disclose relative dimensions, angles, and proportions of the various exemplary embodiments. Various exemplary embodiments extend to various ranges around the absolute and relative dimensions, angles, and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A hard hat system comprising:

a hard hat comprising a shell formed from a rigid material and a mounting element extending from a front of the hard hat;

a brim guard comprising:

a visor positioned at the front of the hard hat;

a first lateral wall extending upward from the visor, the first lateral wall comprising a first inner surface; and a second lateral wall opposing the first lateral wall and extending upward from the visor, the second lateral wall comprising a second inner surface, the second inner surface and the first inner surface facing towards each other, the first lateral wall and the second lateral wall slidably engage with opposing portions of the mounting element coupling the brim guard to the hard hat; and a face shield coupled to the brim guard, the face shield moveable between a lowered position and a raised position, the face shield is positioned below the visor when the face shield is in the lowered position and the face shield is above the visor when the face shield is in the raised position.

2. The hard hat system of claim 1, the opposing portions of the mounting element comprising opposing ridges extending away from each other, and each of first lateral wall and second lateral wall includes a rib that engages between the opposing ridges and the shell.

3. The hard hat system of claim 2, each of the opposing ridges defines a primary longitudinal axis that extends vertically.

4. The hard hat system of claim 1, the hard hat comprising a second mounting element extending from a rear of the hard hat, wherein the second mounting element is configured to slideably engage with the brim guard.

5. The hard hat system of claim 1, the brim guard comprising a mounting location on an exterior of the brim guard opposite the first lateral wall and the second lateral wall, the mounting location including opposing ridges that extend away from each other.

6. The hard hat system of claim 5, each of the opposing ridges of the brim guard defines a primary longitudinal axis that extends vertically.

7. The hard hat system of claim 6, comprising a lighting element slideably engaged with the opposing ridges of the brim guard.

8. The hard hat system of claim 1, the brim guard comprising:

a mounting bracket that each of the first lateral wall and the second lateral wall extend from; and an overhang extending from the mounting bracket radially inward towards a center of the hard hat.

9. The hard hat system of claim 8, the overhang includes a generally horizontal structure.

10. The hard hat system of claim 8, the face shield is pivotally coupled to the brim guard.

11. A brim guard for hard hats comprising:

a body configured to couple to a hard hat such that a front of the body is positioned at a front of the hard hat and above a brim of the hard hat, the body includes a generally flat and horizontal structure that defines a visor, the visor configured to extend radially away from the hard hat;

a mounting bracket coupled to the body, the mounting bracket comprising:

a first channel extending vertically above the body, the first channel comprising a first lateral opening; and a second channel extending vertically above the body, the second channel comprising a second lateral opening, the second lateral opening and the first lateral opening facing towards each other, the first channel and the second channel configured to slidably engage with opposing portions of a mounting element of the hard hat.

12. The brim guard of claim 11, comprising an overhang extending from the mounting bracket radially inward and configured to extend towards a center of the hard hat.

13. The brim guard of claim 11, the mounting bracket comprising a mounting location on an exterior of the mounting bracket opposite the first channel and the second channel, the mounting location including opposing ridges that extend away from each other.

14. A hard hat system comprising:

a hard hat comprising a shell formed from a rigid material and a mounting element extending from a front of the hard hat, the mounting element including opposing ridges;

a brim guard coupled to the mounting element of the hard hat;

a lighting element slideably engaged with the brim guard; and a face shield pivotally coupled to the brim guard, the face shield moveable between a lowered position and a raised position, the face shield is positioned below the brim guard when the face shield is in the lowered position and the face shield is positioned above the brim guard when the face shield is in the raised position, the brim guard extending between the hard hat and an upper end of the face shield when the face shield is in the lowered position.

15. The hard hat system of claim 14, the brim guard comprising a mounting bracket, wherein the brim guard is coupled to the mounting element of the hard hat via the mounting bracket, the mounting bracket comprising a mounting location on an exterior of the mounting bracket opposite a first channel and a second channel, the mounting location including opposing ridges that extend away from each other.

16. The hard hat system of claim 15, comprising said lighting element is lighting element slideably engaged with the mounting location of the brim guard.

17. The hard hat system of claim 15, comprising an overhang extending from the mounting bracket radially inward towards a center of the hard hat.

18. The hard hat system of claim 15, wherein the opposing ridges of the mounting element extend away from each other, and wherein the mounting bracket engages between the opposing ridges and the shell.

* * * * *